US012805638B2

(12) United States Patent
Mullet et al.

(10) Patent No.: US 12,805,638 B2
(45) **Date of Patent: *Nov. 24, 2026**

(54) FOLDING CHAIR

(71) Applicant: Current Products Corp., Pensacola, FL (US)

(72) Inventors: Willis Jay Mullet, Pensacola, FL (US); Richard Scott Hand, Pensacola, FL (US); Phillip Dugger, Pensacola, FL (US); Jacob Kubik, Pensacola, FL (US); Wade Tyson Earnest, Pensacola, FL (US); Brian Nielsen, Pensacola, FL (US); Phil Gurvitz, Pensacola, FL (US); Marcel Mullet, Pensacola, FL (US)

(73) Assignee: Current Products Company, LLC, Pensacola, FL (US)

( * ) Notice: Subject to any disclaimer, the term of this patent is extended or adjusted under 35 U.S.C. 154(b) by 802 days.

This patent is subject to a terminal disclaimer.

(21) Appl. No.: 17/940,141

(22) Filed: Sep. 8, 2022

(65) Prior Publication Data

US 2023/0087726 A1 Mar. 23, 2023

Related U.S. Application Data

(60) Provisional application No. 63/251,360, filed on Oct. 1, 2021, provisional application No. 63/242,360, filed on Sep. 9, 2021.

(51) Int. Cl.
*A47C 4/00* (2006.01)
*A47C 1/024* (2006.01)
(Continued)

(52) U.S. Cl.
CPC ..... *A47C 4/00* (2013.01); *A47C 1/024* (2013.01); *A47C 1/0308* (2018.08);
(Continued)

(58) Field of Classification Search
CPC ..... A47C 4/00; A47C 1/024; A47C 1/0308; A47C 1/03274; A47C 5/10; A47C 7/44;
(Continued)

(56) References Cited

U.S. PATENT DOCUMENTS 349,907 A * 9/1886 Shults ..... A47C 7/444 297/292
1,372,546 A * 3/1921 Read ..... A61G 5/08 297/23
(Continued)

FOREIGN PATENT DOCUMENTS

EP 1327400 A2 7/2003
EP 1327400 4/2014
(Continued)

OTHER PUBLICATIONS

Gymax, 2PCS Patio Folding Chairs Back Adjustable Reclining Padded Garden Furniture, The Home Depot [retrieved on Jan. 15, 2026]. Retrieved from the Internet: <URL: https://www.homedepot.com/p/Gymax-2PCS-Patio-Folding-Chairs-Back-Adjustable-Reclining-Padded-Garden-Furniture-GYM04779/338992215>.
(Continued)

*Primary Examiner* — Robert Canfield
(74) *Attorney, Agent, or Firm* — Christopher A. Proskey; BrownWinick Law Firm

(57) ABSTRACT

In one or more embodiments, a folding chair is provided having a frame, a seat operably connected to the frame, a backrest operably connected to the frame, and a counterbalance assembly, among other components. The backrest is configured to move between an upright position and a reclined position. The counterbalance assembly is configured to apply a counterbalance force to the backrest. In one or more arrangements, the counterbalance assembly is configured to provide a counterbalance force to move the backrest to the upright position in absence of an opposing
(Continued)

force. In one or more arrangements the counterbalance assembly is configured to hold the backrest at one or more intermediate positions between the upright position and the reclined position. In one or more arrangements the counterbalance assembly is configured to increase the counterbalance force applied to the backrest at one or more intermediate positions between the upright and reclined positions.

26 Claims, 69 Drawing Sheets

(51) Int. Cl.
*A47C 1/03* (2006.01)
*A47C 1/032* (2006.01)
*A47C 5/10* (2006.01)
*A47C 7/44* (2006.01)

(52) U.S. Cl.
CPC ..... *A47C 1/03274* (2018.08); *A47C 5/10* (2013.01); *A47C 7/44* (2013.01); *A47C 7/444* (2018.08)

(58) Field of Classification Search
CPC ..... A47C 7/444; A47C 1/0248; A47C 1/025; A47C 4/20; A47C 7/54; A47C 4/10
See application file for complete search history.

(56) References Cited

U.S. PATENT DOCUMENTS 1,977,550 A * 10/1934 Gibb ..... A47C 1/025 5/55.1
2,143,098 A * 1/1939 Wohlk ..... A47C 1/03294 297/343
2,297,526 A * 9/1942 Bayer ..... A47C 17/17 5/47
2,675,059 A * 4/1954 Martin ..... A47C 4/50 297/18
2,710,647 A * 6/1955 Dorton ..... A47C 3/025 297/286
2,991,125 A * 7/1961 Lie ..... A47C 7/566 297/300.4
3,000,668 A * 9/1961 Croy ..... A47C 1/03272 297/320
3,072,436 A * 1/1963 Moore ..... A47C 1/03274 297/316
3,174,797 A 3/1965 Neufeld
3,240,528 A * 3/1966 Ciuffini ..... A47C 1/03277 297/303.3
3,337,266 A * 8/1967 Burns ..... A47C 1/03274 297/320
3,567,280 A 3/1971 Bradshaw
3,602,537 A * 8/1971 Kerstholt ..... A47C 1/03272 297/316
3,633,242 A 1/1972 Wasofsky
3,801,122 A 4/1974 White et al.
3,982,785 A * 9/1976 Ambasz ..... A47C 3/04 297/440.1
4,181,357 A 1/1980 Swenson
4,451,085 A * 5/1984 Franck ..... A47C 1/03279 297/285
4,533,177 A * 8/1985 Latone ..... A47C 7/443 297/285
4,565,404 A * 1/1986 Rauschenberger .... B60N 2/231 297/378.12
4,700,430 A 10/1987 Raftery
4,703,974 A 11/1987 Braeuning
4,911,500 A 3/1990 Saiger
4,938,530 A 7/1990 Snyder et al.
5,001,808 A 3/1991 Chung
5,108,149 A * 4/1992 Ambasz ..... A47C 7/441 297/297
5,335,966 A 8/1994 Vogtherr
5,370,445 A * 12/1994 Golynsky ..... A47C 3/026 297/303.3
5,407,249 A 4/1995 Bonutti
5,735,570 A * 4/1998 Tseng ..... A47C 4/20 297/39
5,855,409 A * 1/1999 Tseng ..... A47C 4/14 297/27
5,895,095 A 4/1999 Chen
5,971,475 A 10/1999 Lawson et al.
6,089,666 A 7/2000 Scot
6,145,930 A * 11/2000 Su ..... A47C 1/026 297/367 R
6,419,319 B1 7/2002 Sakurai
6,692,068 B1 * 2/2004 Tang ..... A47C 1/03244 297/16.2
6,729,688 B2 * 5/2004 Erne ..... A47C 1/03277 297/320
6,742,839 B2 * 6/2004 Piretti ..... A47C 3/04 297/354.11
6,840,578 B1 * 1/2005 Su ..... A47C 1/025 297/316
7,021,712 B2 * 4/2006 Spendlove ..... A47C 7/445 297/285
7,641,284 B2 1/2010 Jones et al.
7,815,259 B2 10/2010 Fookes et al.
D659,444 S 5/2012 James
8,256,845 B2 9/2012 Wang
9,738,116 B1 8/2017 Rivera, Jr. et al.
9,861,542 B2 1/2018 Christian
9,980,583 B2 5/2018 Rivera, Jr. et al.
10,327,970 B2 6/2019 Christian et al.
10,376,062 B2 8/2019 Rivera, Jr. et al.
11,166,559 B1 11/2021 Kadoch
11,317,722 B2 * 5/2022 Grace ..... A47C 1/0342
11,794,521 B2 10/2023 Keich
12,022,959 B2 * 7/2024 Mullet ..... A47C 7/4454
12,319,088 B2 6/2025 Keich
2002/0121800 A1 * 9/2002 Yu ..... A47C 4/22 297/27
2003/0146652 A1 * 8/2003 Su ..... A47C 1/027 297/302.7
2005/0099048 A1 5/2005 Schneider et al.
2006/0202536 A1 * 9/2006 Luchetti ..... A47C 7/70 297/354.11
2007/0222266 A1 * 9/2007 Lucci ..... A47C 3/045 297/331
2008/0252124 A1 * 10/2008 Chen ..... A47C 7/443 297/301.4
2009/0091173 A1 * 4/2009 Mackert ..... A47C 31/126 297/354.1
2009/0195040 A1 * 8/2009 Birkbeck ..... A47C 1/03255 297/316
2009/0302654 A1 * 12/2009 Piretti ..... A47C 7/445 297/301.3
2009/0302655 A1 * 12/2009 Gorgi ..... A47C 1/03266 297/303.1
2010/0237680 A1 9/2010 Pedersen
2011/0018313 A1 * 1/2011 Tseng ..... A47C 4/42 297/51
2011/0089736 A1 4/2011 Seibold et al.
2011/0121627 A1 * 5/2011 Konagai ..... B60N 2/4235 297/354.1
2011/0127820 A1 * 6/2011 Moreschi ..... A47C 1/03255 297/354.1
2011/0187170 A1 * 8/2011 Lin ..... A47C 1/121 297/333
2012/0068509 A1 * 3/2012 Hsiao ..... A47C 1/03274 297/303.3
2012/0187733 A1 * 7/2012 Lin ..... A47C 4/04 297/332
2013/0001994 A1 * 1/2013 Wu ..... A47C 7/443 297/285
2013/0328360 A1 12/2013 Kim
2014/0159437 A1 * 6/2014 Humphreys ..... A47C 1/0342 297/78
2014/0265505 A1 9/2014 Li et al.

(56) References Cited

U.S. PATENT DOCUMENTS

| | | | | |
|---|---|---|---|---|
| 2015/0035332 | A1* | 2/2015 | Piretti | A47C 7/44 297/299 |
| 2015/0035335 | A1* | 2/2015 | Weng | A47C 1/027 297/354.12 |
| 2016/0066692 | A1* | 3/2016 | Lin | A47C 7/5068 297/354.1 |
| 2017/0172304 | A1* | 6/2017 | Piretti | A47C 4/04 |
| 2017/0273462 | A1* | 9/2017 | Omori | A47C 7/441 |
| 2019/0021502 | A1* | 1/2019 | Piretti | A47C 4/20 |
| 2022/0354254 | A1* | 11/2022 | Collier | A47C 1/03205 |
| 2023/0020288 | A1* | 1/2023 | Galiotto | A47C 1/024 |
| 2023/0103963 | A1* | 4/2023 | Mullet | A47C 7/4454 297/301.3 |
| 2024/0225285 | A1* | 7/2024 | Mullet | A47C 1/025 |
| 2024/0277154 | A1* | 8/2024 | Diggins | A47C 7/443 |
| 2024/0365981 | A1* | 11/2024 | Doyon | A47C 7/566 |
| 2024/0423373 | A1* | 12/2024 | Mullet | A47C 7/4454 |
| 2025/0127302 | A1* | 4/2025 | Beyer | A47C 1/03272 |
| 2025/0134261 | A1* | 5/2025 | Pan | A47C 7/14 |
| 2025/0143467 | A1* | 5/2025 | Yang | A47C 1/024 |

FOREIGN PATENT DOCUMENTS

| | | | |
|---|---|---|---|
| FR | 2686833 | A1 | 8/1993 |
| GB | 889897 | A | 2/1962 |
| GB | 1370940 | A | 10/1974 |
| GB | 2537799 | A | 11/2016 |
| JP | 2000016003 | A | 1/2000 |
| WO | 9304613 | A1 | 3/1993 |
| WO | 02052987 | A1 | 7/2002 |
| WO | 2007109699 | A2 | 9/2007 |

OTHER PUBLICATIONS

Freestyle Rocker with Side Table, GCI Outdoor [retrieved on Jan. 15, 2026]. Retrieved from the Internet: <URL: https://gcioutdoor.com/products/freestyle-rocker-with-side-table>.

Haute Juice—Set of 4 Chrome Tubular Cantilever Wire Vintage Arm Chairs Dining Chairs—Mar. 10, 2015.

* cited by examiner

DETAIL A
SCALE 1:1

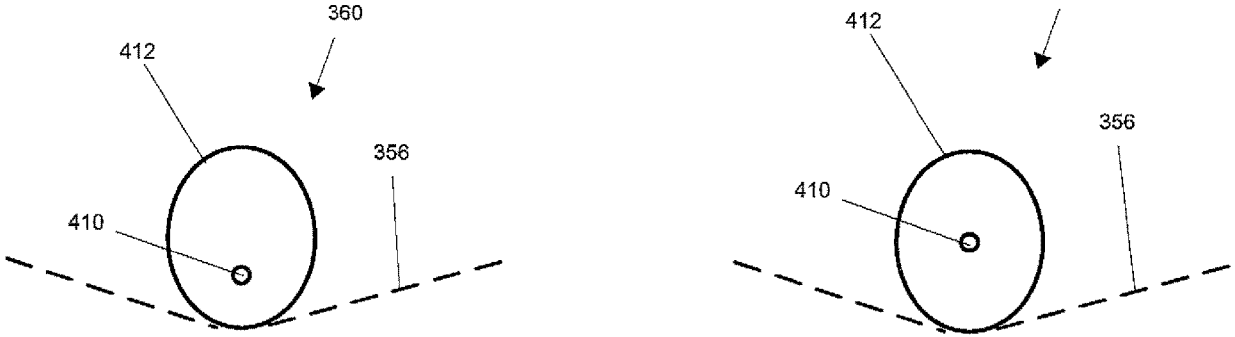
FIG. 17A
FIG. 17B
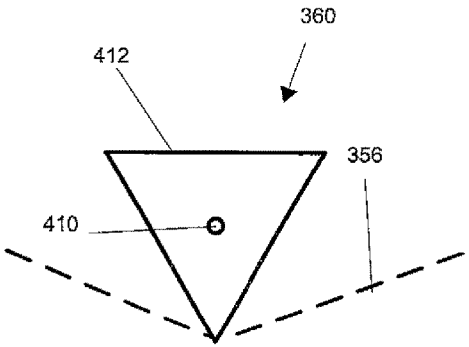
FIG. 17C
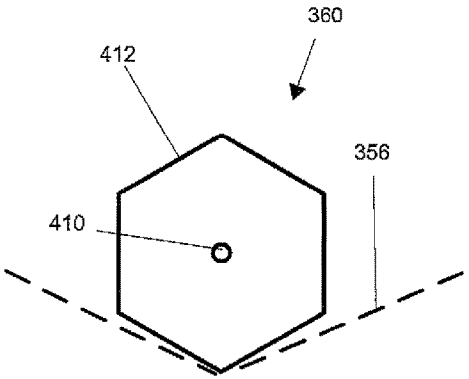
FIG. 17D
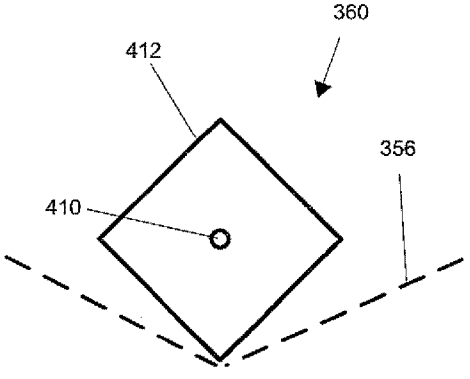
FIG. 17E

FOLDING CHAIR

CROSS-REFERENCE TO RELATED APPLICATIONS

The present application claims priority to U.S. Provisional Application 63/242,360 titled FOLDING CHAIR filed on Sep. 9, 2021, and U.S. Provisional Application 63/251,360 titled SEATING SYSTEM filed on Oct. 1, 2021, the entirety of each of which are hereby incorporated by reference herein, including any figures, tables, drawings, and other information.

FIELD OF THE DISCLOSURE

This disclosure relates generally to furniture. More specifically, and without limitation, this disclosure is directed to folding chairs.

OVERVIEW OF THE DISCLOSURE

Folding chairs are configured to collapse and/or fold into a more compact arraignment, thereby permitting the chairs to be stored and/or transported more easily than non-folding chairs. However, many folding chairs can be uncomfortable to use for extended periods of time due to the inability to properly support an occupant in both upright and reclined positions. Folding chairs that can recline can be cumbersome and difficult to move between upright and reclined positions.

Therefore, for all the reasons stated above, and the reasons stated below, there is a need in the art for a folding chair configured to be folded into a compact form for storage and/or transportation and which has an easy to use reclining mechanism that is configured to support an occupant in upright and reclined positions.

It is an object of the disclosure to provide a folding chair that improves upon the prior art.

Another object of the disclosure is to provide a folding chair having a compact internal reclining mechanism configured to support an occupant in upright and reclined positions.

Yet another object of the disclosure is to provide a folding chair that is strong, robust, and durable.

Another object of the disclosure is to provide a folding chair that is comfortable.

Yet another object of the disclosure is to provide a folding chair that is easy and intuitive to use.

Another object of the disclosure is to provide a folding chair that is easy to manufacture.

Yet another object of the disclosure is to provide a folding chair that is cost effective.

Another object of the disclosure is to provide a folding chair that is high quality.

Yet another object of the disclosure is to provide a folding chair that has a long useful life.

Another object of the disclosure is to provide a folding chair that is that is aesthetically pleasing.

These and other objects, features, and/or advantages of the disclosure will become apparent from the specification, figures, and claims.

BRIEF DESCRIPTION OF THE DRAWINGS

FIG. 17A is an elevation view of the cam in accordance with one or more arrangements, the view showing the cam having an oval shape with an axis positioned away from the geometric center of the cam and a perimeter edge.

FIG. 17B is an elevation view of the cam in accordance with one or more arrangements, the view showing the cam having an oval shape with an axis positioned at, or approximately at, the geometric center of the cam and a perimeter edge.

FIG. 17C is an elevation view of the cam in accordance with one or more arrangements, the view showing the cam having a triangular shape with an axis and a perimeter edge.

FIG. 17D is an elevation view of the cam in accordance with one or more arrangements, the view showing the cam having a hexagonal shape with an axis and a perimeter edge.

FIG. 17E is an elevation view of the cam in accordance with one or more arrangements, the view showing the cam having a square shape with an axis and a perimeter edge.

SUMMARY OF THE DISCLOSURE

Figure 1:
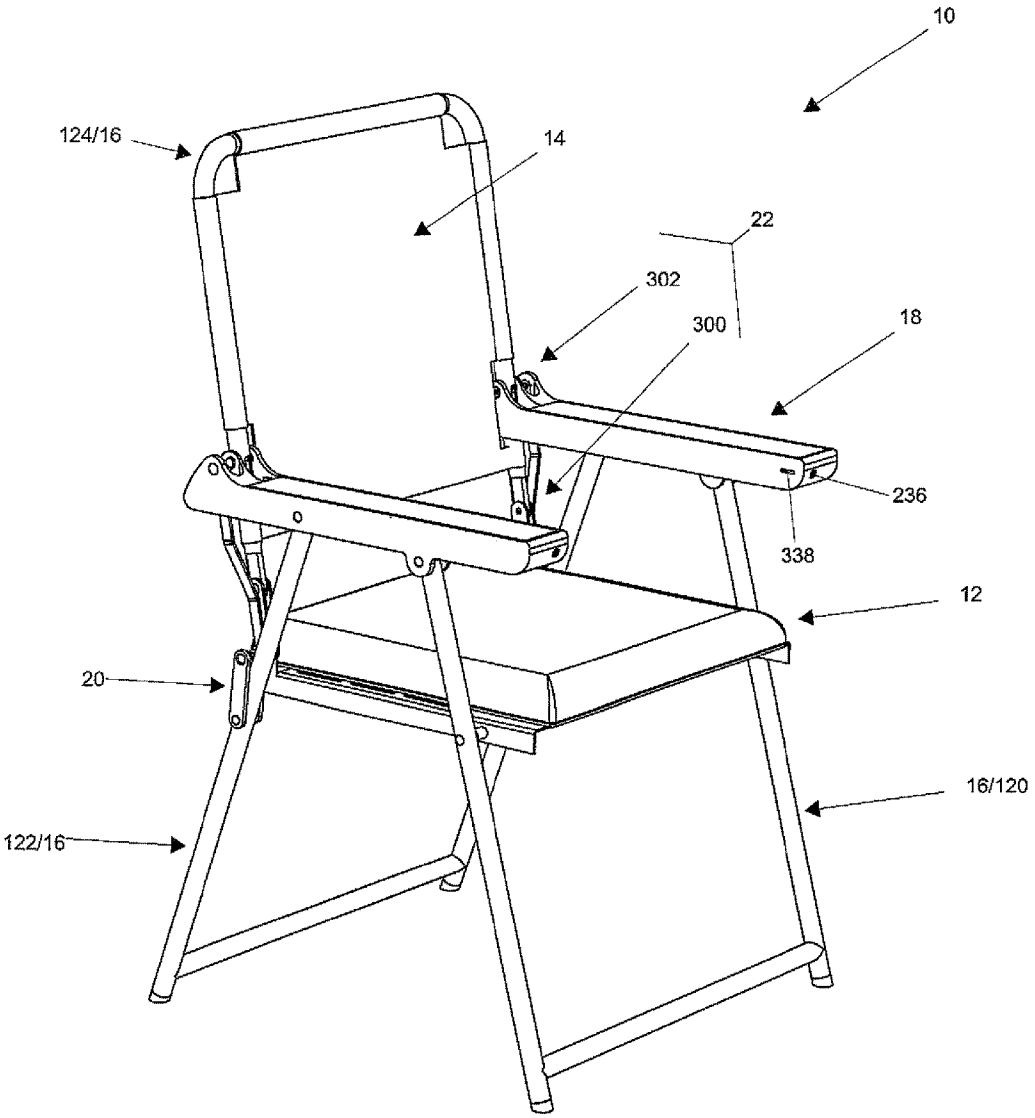
FIG. 1 is a perspective view of the folding chair in accordance with one or more arrangements, the view showing the folding chair having a seat assembly, a backrest, a frame assembly, an armrest assembly, a lock assembly, and a reclining mechanism.

In one or more embodiments, a folding chair is provided having a frame, a seat operably connected to the frame, a backrest operably connected to the frame, and a counterbalance assembly, among other components. The backrest is configured to move between an upright position and a reclined position relative to the frame. The counterbalance assembly is configured to apply a counterbalance force to the backrest. In one or more arrangements, the counterbalance assembly is configured to move the backrest to the upright position in absence of an opposing force. In one or more arrangements the counterbalance assembly is configured to increase the counterbalance force applied to the backrest at one or more intermediate positions between the upright and reclined positions.

In one or more arrangements, the backrest is operably connected to the frame by a reclining mechanism configured to move the backrest between an upright position and a reclined position relative to the frame. In one or more arrangements, the reclining mechanism includes an upper guide assembly and a lower guide assembly. The upper guide assembly is configured to move an upper end of the backrest upward and forward when the backrest is moved to the upright position. The upper guide assembly is configured to move the upper end of the backrest downward and rearward when the backrest is moved to the reclined position. The reclining mechanism includes a lower guide assembly. The lower guide assembly is configured to move a lower end of the backrest upward and rearward when the backrest is moved to the upright position. The lower guide assembly is configured to move the lower end of the backrest downward and forward when the backrest is moved to the reclined position.

In one or more arrangements, the lower guide assembly includes a lower axle that extends through the backrest from side to side. The lower guide assembly includes a pair of rollers connected to opposite ends of the lower axle. The pair of rollers are configured to move along a slotted track within the frame.

In one or more arrangements, the frame includes a front leg section, a rear leg section, and a back section. The front leg section, rear leg section, and back section are connected to the seat and backrest by hinged connections. The hinged connections allow the front leg section, the rear leg section, and the back section to be folded into a compact position.

DETAILED DESCRIPTION OF THE DISCLOSURE

In the following detailed description of the embodiments, reference is made to the accompanying drawings which form a part hereof, and in which is shown by way of illustration specific embodiments in which the disclosure may be practiced. The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure. It will be understood by those skilled in the art that various changes in form and details may be made without departing from the principles and scope of the invention. It is intended to cover various modifications and similar arrangements and procedures, and the scope of the appended claims therefore should be accorded the broadest interpretation so as to encompass all such modifications and similar arrangements and procedures. For instance, although aspects and features may be illustrated in and/or described with reference to certain figures and/or embodiments, it will be appreciated that features from one figure and/or embodiment may be combined with features of another figure and/or embodiment even though the combination is not explicitly shown and/or explicitly described as a combination. In the depicted embodiments, like reference numbers refer to like elements throughout the various drawings.

It should be understood that any advantages and/or improvements discussed herein may not be provided by various disclosed embodiments, and/or implementations thereof. The contemplated embodiments are not so limited and should not be interpreted as being restricted to embodiments which provide such advantages and/or improvements. Similarly, it should be understood that various embodiments may not address all or any objects of the disclosure and/or objects of the invention that may be described herein. The contemplated embodiments are not so limited and should not be interpreted as being restricted to embodiments which address such objects of the disclosure and/or invention. Furthermore, although some disclosed embodiments may be described relative to specific materials, embodiments are not limited to the specific materials and/or apparatuses but only to their specific characteristics and capabilities and other materials and apparatuses can be substituted as is well understood by those skilled in the art in view of the present disclosure.

It is to be understood that the terms such as "left, right, top, bottom, front, back, side, height, length, width, upper, lower, interior, exterior, inner, outer, and the like as may be used herein, merely describe points of reference and do not limit the present invention to any particular orientation and/or configuration.

As used herein, "and/or" includes all combinations of one or more of the associated listed items, such that "A and/or B" includes "A but not B," "B but not A," and "A as well as B," unless it is clearly indicated that only a single item, subgroup of items, or all items are present. The use of "etc." is defined as "et cetera" and indicates the inclusion of all other elements belonging to the same group of the preceding items, in any "and/or" combination(s).

As used herein, the singular forms "a," "an," and "the" are intended to include both the singular and plural forms, unless the language explicitly indicates otherwise. Indefinite articles like "a" and "an" introduce or refer to any modified term, both previously-introduced and not, while definite articles like "the" refer to a same previously-introduced term; as such, it is understood that "a" or "an" modify items that are permitted to be previously-introduced or new, while definite articles modify an item that is the same as immediately previously presented. It will be further understood that the terms "comprises," "comprising," "includes," and/or "including," when used herein, specify the presence of stated features, characteristics, steps, operations, elements, and/or components, but do not themselves preclude the presence or addition of one or more other features, characteristics, steps, operations, elements, components, and/or groups thereof, unless expressly indicated otherwise. For example, if an embodiment of a system is described as comprising an article, it is understood the system is not limited to a single instance of the article unless expressly indicated otherwise, even if elsewhere another embodiment of the system is described as comprising a plurality of articles.

It will be understood that when an element is referred to as being "connected," "coupled," "mated," "attached," "fixed," etc. to another element, it can be directly connected to the other element, and/or intervening elements may be present. In contrast, when an element is referred to as being "directly connected," "directly coupled," "directly engaged" etc. to another element, there are no intervening elements present. Other words used to describe the relationship between elements should be interpreted in a like fashion (e.g., "between" versus "directly between," "adjacent" versus "directly adjacent," "engaged" versus "directly engaged," etc.). Similarly, a term such as "operatively", such as when used as "operatively connected" or "operatively engaged" is to be interpreted as connected and/or engaged, respectively, in any manner that facilitates operation, which may include being directly connected, indirectly connected, electronically connected, wirelessly connected and/or connected by any other manner, method and/or means that facilitates desired operation. Similarly, a term such as "communicatively connected" includes all variations of information exchange and routing between two electronic devices, including intermediary devices, networks, etc., connected wirelessly or not. Similarly, "connected" or other similar language particularly for electronic components is intended to mean connected by any means, either directly or indirectly, wired and/or wirelessly, such that electricity and/or information may be transmitted between the components.

It will be understood that, although the ordinal terms "first," "second," etc. may be used herein to describe various elements, these elements should not be limited to any order by these terms unless specifically stated as such. These terms are used only to distinguish one element from another; where there are "second" or higher ordinals, there merely must be a number of elements, without necessarily any difference or other relationship. For example, a first element could be termed a second element, and, similarly, a second element could be termed a first element, without departing from the scope of example embodiments and/or methods.

Similarly, the structures and operations discussed herein may occur out of the order described and/or noted in the figures. For example, two operations and/or figures shown in succession may in fact be executed concurrently and/or may sometimes be executed in the reverse order, depending upon the functionality/acts involved. Similarly, individual operations within example methods described below may be executed repetitively, individually, and/or sequentially, to provide looping and/or other series of operations aside from single operations described below. It should be presumed that any embodiment and/or method having features and functionality described below, in any workable combination, falls within the scope of example embodiments.

As used herein, various disclosed embodiments may be primarily described in the context of folding chairs. However, the embodiments are not so limited. It is appreciated that the embodiments may be adapted for use in other applications which may be improved by the disclosed structures, arrangements and/or methods. The system is merely shown and described as being used in in the context of folding chairs for ease of description and as one of countless examples.

System 10:

With reference to the figures, a folding chair 10 (or "seating system 10" or simply "system 10") is presented. The system 10 is formed of any suitable size, shape, and/or design and is configured to hold and support an occupant in a seated position as well as facilitate movement between an upright position and a reclined position. In the arrangement shown, as one example, system 10 includes the following component pieces: a seat assembly 12, a backrest 14, a frame assembly 16, armrest assemblies 18, a lock assembly 20, and a reclining mechanism 22, among other components.

Seat Assembly 12:

Seat assembly 12 is formed of any suitable size, shape, and/or design and is configured to provide a surface for seating of an occupant thereupon. In the arrangement shown, as one example, seat assembly 12 includes a support assembly 26 and a cushion 28 among other components. In this example arrangement, support assembly 26 is configured to operably connect with frame assembly 16 and support cushion 28 on a top 30 of support assembly 26.

Support Assembly 26:

Support assembly 26 is formed of any suitable size, shape, and/or design and is configured to provide a surface for seating of an occupant thereupon. In the arrangement shown, as one example, support assembly 26 has a generally rectangular planar shaped top 30 and a bottom 32 extending between a front edge 34, a back edge 36, and opposing side edges 38. In this example arrangement, support assembly 26 has an outer portion 40 positioned in an upper plane and a center indent 42, in which support assembly 26 extends downward to a bottom wall 48 positioned in a lower plane. In this example arrangement, center indent 42 has sidewalls 44 that extend downward to bottom wall 48. In this example arrangement, center indent 42 includes holes 46 in bottom wall 48 to facilitate draining of liquids (e.g., rainwater) from center indent 42.

Center indent 42 forms a recess in an upper surface of support assembly 26 to accommodate flexing of webbing (not shown) on support assembly 26 of seat assembly 12. Center indent 42 also provides structural rigidity to support assembly 26 and avoids the need to have frame assembly 16 extend across the front and back of seat assembly 12 in order to support webbing.

In one or more arrangements, support assembly 26 includes connection features 50. Connection features 50 are formed of any suitable size, shape, and/or design and are configured to facilitate connection of webbing to outer portion 40 of support assembly 26. In the arrangement shown, as one example, connection features 50 includes a plurality of slots 64 positioned around center indent 42 and a plurality of tabs 62 positioned inward from slots 64. In this example arrangement, tabs 62 extend downward from outer portion 40 on bottom 32 of support assembly 26. When system 10 is assembled, webbing is stretched across center indent 42 and through the slots 64. Webbing is then stretched and pulled over tabs 62 so that tabs 62 are pushed through webbing. Tabs 62 are then folded over the ends of webbing thereby securing webbing in place in a taut manner. Webbing provides a strong seating base while providing some give to provide a more comfortable seating surface for an occupant.

In this example arrangement, support assembly 26 includes flanges extending downward from opposing side edges 38 to form connection members 54. In one or more arrangements, connection members 54 are configured to engage frame assembly 16 in a manner to hold seat assembly 12 in place on the frame assembly 16. In this example arrangement, connection members 54 include holes 56 to facilitate a hinged connection of connection members 54 of seat assembly 12 to front legs 130 of frame assembly 16 (e.g., by a fastener extending through the holes 56 and holes 144 of front legs 130). In this example arrangement, support assembly 26 also includes tabs 58 that extends upward from a rearward end of connection members 54. In this example arrangement, tabs 58 include holes 60 to facilitate a hinged connection with lock assembly 20 and reclining mechanism 22.

In the arrangement shown, as one example, support assembly 26 is formed as a single unitary member. For example, in one or more arrangements, support assembly 26 may be stamped from a single sheet of metal (e.g., 0.075 inch steel) to facilitate easy, fast, and lower cost manufacture of support assembly 26. However, the embodiments are not so limited. Rather, it is contemplated that in various arrangements, support assembly 26 may be formed of various natural and/or synthetic materials including but not limited to metals, woods, plastics, rubbers, composites, laminins, of any other material. Moreover, it is further contemplated that that in various arrangements, support assembly 26 may be formed of multiple component pieces that are connected together.

Cushion 28:

Cushion 28 is formed of any suitable size, shape, and/or design and is configured to comfortably support a person sitting thereon. In the arrangement shown, as one example, cushion 28 has a generally cuboid shape having a top 74, a bottom 76, and sides 78. In this example arrangement, cushion 28 includes a foam core (not shown) covered by upholstery material (not shown) on at least one side.

Foam Core:

Foam core (not shown) is formed of any suitable size, shape, and/or design and is configured to provide comforting support when seated upon. In one or more arrangements, foam core is also configured to prevent water from becoming trapped within the foam core. For instance, in some various arrangement, foam core may be comprised of one or more foams (e.g., reticulated foam, polyurethane foam, open cell rubber and/or any other foam material), feathers, fibers, polyester, batting and/or any other fill material for cushions.

Upholstery Material:

Upholstery material (not shown) is formed of any suitable size, shape, and/or design and is configured to provide a comfortable seating surface and aesthetically pleasing appearance. In some various arrangements, upholstery material may include but is not limited to, for example, natural materials such as cotton, silk, wool, linen, and/or leather, and/or synthetic materials such as polyester, polypropylene, nylon, acrylic, rayon, vinyl, and/or synthetic leathers, and/or any other upholstery material.

In one or more arrangements, bottom 76 of cushion 28 is attached to a top 30 of support assembly 26. It is contemplated that in various arrangements, cushion 28 may be attached to support assembly 26 using various methods and/or means including but not limited to, for example, screws, bolts, clamps, pins, rivets, welding, snap connectors, friction fit connectors, stitching, hook and loop connectors, adhesives, chemical bonding, and/or any other process and/or means that results in a permanent or semi-permanent connection.

Backrest 14:

The backrest 14 is formed of any suitable size, shape, and/or design and is configured to provide a surface to provide backrest support for an occupant seated on seat assembly 12. In the arrangement shown, as one example, backrest 14 includes a fabric panel 90 stretched between and connected to side bars 166 and upper crossbar 170 of frame assembly 16.

In this example arrangement, fabric panel 90 has a generally rectangular planar shape having a front surface 92 and rear surface 94 extending between a top edge 96, a bottom edge 98, and opposing side edges 100. In this example arrangement, fabric panel 90 includes a top tab 106 extending upward from top edge 96, upper side tabs 108 extending outward to the side from side edges 100, and lower side tabs 110 extending outward to the side from side edges 100 proximate to bottom edge 98. During assembly of system 10, upper side tabs 108 are wrapped around and connected to side bars 166 of frame assembly 16. Upper side tabs 108 are similarly wrapped around and connected to upper crossbar 170 of frame assembly 16 with fabric panel 90 stretched between side bars 166. Lower side tabs 110 are similarly wrapped around and connected to lower ends 174 of side bars 166 of frame assembly 16 at a position that is below armrest assemblies 18. In this position, lower side tabs 110 help prevent fabric panel 90 from moving upward and thereby keeping fabric panel 90 taut.

Top tab 106, upper side tabs 108 and lower side tabs 110 may be attached to frame assembly 16 using various methods and/or means including but not limited to, for example, screws, bolts, clamps, pins, rivets, welding, snap connectors, friction fit connectors, stitching, hook and loop connectors, adhesives, chemical bonding, and/or any other process and/or means that results in a permanent or semi-permanent connection. Additionally or alternatively, top tab 106, upper side tabs 108 and lower side tabs 110 may be wrapped around side bars 166 and/or upper crossbar 170 of frame assembly 16 and connect to themselves to form a loop through which frame assembly 16 extends.

However, the embodiments are not limited to the arrangements shown. Rather, it is contemplated that in one or more arrangements, backrest 14 may be implanted with a rigid support member connected to frame assembly 16 and/or with a cushion connected thereto.

Frame Assembly 16:

Frame assembly 16 is formed of any suitable size, shape, and/or design and is configured to operably connect with and support seat assembly 12, backrest 14, armrest assemblies 18 and facilitate moving of the system 10 between a folded position and an unfolded position. In the arrangement shown, as one example, frame assembly 16 has a front leg section 120, a rear leg section 122, and a back section 124.

Front Leg Section 120:

Front leg section 120 of frame assembly 16 is formed of any suitable size, shape, and/or design and is configured to provide stable support of a front end of system 10 on a floor. In the arrangement shown, as one example, front leg section 120 include a pair of front legs 130 and a front cross bar 132.

In this example arrangement, front legs 130 have a generally elongated tube shape extending from respective upper ends 136 to lower ends 138. In this example arrangement, front cross bar 132 is connected to and extends between front legs 130 proximate to lower ends 138. In this example arrangement, front legs 130 have holes 144 positioned at upper ends 136 and at seat level height to facilitate a hinged connection with armrest assemblies 18 and seat assembly 12.

In this example arrangement, front legs 130 have feet 142 connected to lower ends 138 of front legs 130. Feet 142 are formed of any suitable size, shape, and/or design and are configured to connect with lower ends 138 and provide a surface for contacting the floor without scratching and/or otherwise damaging the floor. In the arrangement shown, as one example, feet 142 are plastic members having an upper end that is inserted into lower ends 138 and frictionally held in place.

However, the embodiments are not so limited. Rather, it is contemplated that in various arrangements, feet 142 may be formed of various natural and/or synthetic materials including but not limited to metals, woods, plastics, rubbers, fibers, composites, laminins, of any other material.

Moreover, it is contemplated that in various arrangements, feet 142 may be connected to lower ends 138 of front legs using various methods and/or means including but not limited to, for example, screws, bolts, clamps, pins, rivets, welding, snap connectors, interconnects (e.g., slide connectors, rotational connectors, and/or any other type of interconnect), friction fit connectors, adhesives, chemical bonding, and/or any other process and/or means that results in a permanent or semi-permanent connection.

Rear Leg Section 122:

Rear leg section 122 of frame assembly 16 is formed of any suitable size, shape, and/or design and is configured to provide stable support of a rear end of system 10 on a floor. In the arrangement shown, as one example, rear leg section 122 includes a pair of rear legs 150 and a rear cross bar 152.

In this example arrangement, rear legs 150 have a generally elongated tube shape extending from respective upper ends 154 to lower ends 156. In this example arrangement, rear cross bar 152 is connected to and extends between rear legs 150 proximate to lower ends 156. In this example arrangement, rear legs 150 have holes 146 positioned at upper ends 154 and holes 146 slightly below at seat level height to facilitate a hinged connection with armrest assemblies 18 and seat assembly 12. In this example arrangement, rear legs 150 have feet 160 connected to lower ends 156 of rear legs 150. In this example arrangement, feet 160 are similar to feet 142 and provide a surface for contacting the floor without scratching and/or otherwise damaging the floor.

Back Section 124:

Back section 124 of frame assembly 16 is formed of any suitable size, shape, and/or design and is configured to provide stable support of backrest 14. In the arrangement shown, as one example, back section 124 includes a pair of side bars 166, upper bends 168, and an upper crossbar 170 connected between upper bends 168. In this example arrangement, side bars 166 each have an elongated shape extending upward at a slight angle rearward from a lower end 174 to an upper end 176. Upper bends 168 have a generally elongated tube shape extending from upper ends 176 of side bars 166 inward toward each other before connecting to opposing ends 178 of upper crossbar 170. In this example arrangement, upper crossbar 170 has an elongated tube shape extending between the opposing ends 178 to operably connect right and left sides of the back section 124 of frame assembly 16 together.

In one or more arrangements shown, components of back section 124 of frame assembly 16 are illustrated as separate components and/or sections that are connected together. However, the embodiments are not so limited. Rather, it is contemplated that, in one or more arrangements, components back section 124 and/or other components of frame assembly 16 may be formed as a unitary component, for example, formed by bending a single tube.

In the arrangement shown, side bars 166 of back section 124 include a lower set of holes 182 positioned at lower ends 174 of side bars 166 and an upper set of holes 184 to facilitate connection of back section 124 with reclining mechanism 22. In this example arrangement, side bars 166 of back section 124 also include forward slots 186 configured to facilitate connection of back section 124 with a counterbalance assembly 304 of reclining mechanism 22.

Armrest Assemblies 18:

In the arrangement shown, system 10 includes armrest assemblies 18 connected to frame assembly 16. Armrest assemblies 18 are formed of any suitable size, shape, and/or design and is configured to provide comfortable arm rests for an occupant seated in seat assembly 12 while. In one or more arrangements, as examples, armrest assemblies 18 may also be configured to provide a housing for counterbalance assembly 304 of reclining mechanism 22.

In the arrangement shown, as one example, armrest assemblies 18 each have a generally elongated rectangular shape having a top 200, a bottom 202, a front 206, a back 208, an inner side wall 212, and an outer side wall 214 forming a hollow interior 216. In this example arrangement, a partition wall 220 extends from front 206 to back 208 to form an inner partition 222 and an outer partition 224 within hollow interior 216.

In this example arrangement, each armrest assembly 18 has a pair of tabs 228 that extend downward from outer side wall 214 and partition wall 220. In this example arrangement, tabs 228 include holes 230 to facilitate a hinged connection with holes 144 at upper ends 136 of front legs 130. In the example arrangement, outer partition 224 of armrest assemblies 18 have an open bottom thereby permitting a portion of front legs 130 to be received within outer partition 224 when system 10 is folded.

In this example arrangement, each armrest assembly 18 has a cover 232 that is removable from top 200, for example, a counterbalance assembly 304 of reclining mechanism 22, which is positioned within inner partition 222 of hollow interior 216. Covers 232 are formed of any suitable size, shape, and/or design and are configured to connect with tops 200 and cover hollow interior 216 of each armrest assembly 18. In the arrangement shown, as one example, covers 232 have a generally rectangular planar shape with rounded corners. In this example arrangement, covers 232 are configured to be received and held within complementary shaped recesses 234 within tops 200 with frictional and/or snap fitting. However, the embodiments are not so limited. Rather, it is contemplated that in one or more arrangements, covers 232 may connect with tops 200 of armrest assemblies 18 using various methods and/or means including but not limited to, for example, screws, bolts, clamps, pins, rivets, welding, snap connectors, interconnects (e.g., slide connectors, rotational connectors, and/or any other type of interconnect), friction fit connectors, adhesives, chemical bonding, and/or any other process and/or means that results in a permanent or semi-permanent connection. In this example arrangement, each armrest assembly 18 also has a hole 236 in the front 206 to provide access for adjustment of counterbalance assembly 304 of reclining mechanism 22, which is positioned within inner partition 222 of hollow interior 216.

In the arrangement shown, as one example, a rear portion of each armrest assembly 18 includes a connection assembly 238. Connection assembly 238 is formed of any suitable size, shape, and/or design and is configured to connect with backrest 14, over lock assembly 20, and reclining mechanism 22, and facilitate reclining of backrest 14 as well as folding and unfolding of system 10. In the arrangement shown, as one example, connection assembly 238 is formed by rear portions of inner side wall 212, outer side wall 214, and partition wall 220, which extend upward from tops 200 of armrest assemblies 18. In this example arrangement, connection assembly 238 includes a hole 244 in an upper portion of outer side wall 214 to facilitate a hinged connection with lock assembly 20. In this example arrangement, connection assembly 238 includes slotted tracks 242 in inner side wall 212 and partition wall 220, which facilitate connection with guide members 330 attached to upper set of holes 184 of side bars 166 of back section 124 of frame assembly 16, and which forms part of reclining mechanism 22.

Lock Assemblies 20:

Lock assemblies 20 are formed of any suitable size, shape, and/or design and are configured to lock system 10 in the unfolded position, for example, to prevent unintentional folding of system 10 while in use. In the arrangement shown, as one example, lock assemblies 20 are a pair of over center braces that are each formed by a lower link 248 and an upper link 250.

Lower links 248 are formed of any suitable size, shape, and/or design, and are configured to provide a dual axial hinged connection between holes 60 of tabs 58 of support assembly 26 of seat assembly 12 and holes 146 of rear legs 150. In this example arrangement, lower links 248 have a pair of parallel arms 252 having a rectangular planar shape extending between upper ends 254 and lower ends 256. In this example arrangement, lower ends 256 of arms 252 of lower links 248 have holes 258 to facilitate a hinged connection with holes 146 of rear legs 150 (e.g., by a fastener extending through holes 258 and 146).

In this example arrangement, upper ends 254 of arms 252 are connected by a stop member 262. In this example arrangement, holes 260 extend through upper ends 254 of arms 252 of lower links 248 and stop member 262 and facilitate a hinged connection with holes 60 of tabs 58 of support assembly 26 of seat assembly 12 (e.g., by a fastener extending through holes 260 and 60).

Upper links 250 are formed of any suitable size, shape, and/or design, and are configured to provide a dual axial hinged connection between holes 60 of tabs 58 of support assembly 26 of seat assembly 12 and holes 240 of connection assembly 238 of armrest assemblies 18. In this example arrangement, upper links 250 have a generally elongated planar shape extending between an upper end 270 and a lower end 272.

In this example, arrangement, upper links 250 have two bends between upper end 270 and lower end 272, to form an upper vertical portion 274 and a lower vertical portion 276, which are connected by an angled portion 278. In this example arrangement, upper ends 270 of upper links 250 have holes 282 to facilitate a hinged connection with holes 240 of connection assembly 238 of armrest assemblies 18 (e.g., by a fastener extending through holes 240 and 282).

In this example arrangement, lower ends 272 of upper links 250 have holes 284 to facilitate a hinged connection with holes 60 of tabs 58 of support assembly 26 of seat assembly 12 (e.g., by a fastener extending through holes e.g., by a fastener extending through holes 260, 60, and 284).

In operation, when system 10 is unfolded, lock assembly 20 locks system 10 in the unfolded position by moving stop member 262 at the pivot connection between upper link 250 and lower link 248 forward until stop member 262 contacts rear legs 150. In this position, a portion of downward force placed on the system 10 by an occupant transfers to lock assembly 20 and presses stop member 262 against rear legs 150. When there is no occupant of system 10, stop member 262 may be moved rearward to facilitate folding of system 10.

Reclining Mechanism 22:

Reclining mechanism 22 is formed of any suitable size, shape, and/or design and is configured to facilitate connection of backrest 14 with frame assembly 16 and facilitate movement of backrest 14 between up upright position and a reclined position. In the arrangement shown, as one example, reclining mechanism 22 is configured to recline backrest 14 by moving an upper end of backrest 14 (e.g., top edge 96) downward and rearward while also moving a lower end of backrest 14 (e.g., bottom edge 98) downward and forward. In the arrangement shown, as one example, reclining mechanism 22 includes an upper guide assembly 302, a lower guide assembly 300, and a counterbalance assembly 304.

Lower Guide Assembly 300:

Lower guide assembly 300 is formed of any suitable size, shape, and/or design and is configured to connect with and guide a lower portion of backrest 14 downward and forward along a defined path when backrest 14 is moved from an upright position to a reclined position. In the arrangement shown, as one example, lower guide assembly 300 includes links 310 operably connecting the lower portion of backrest 14 with tabs 58 of support assembly 26 of seat assembly 12.

Links 310 are formed of any suitable size, shape, and/or design, and are configured to provide a dual axial hinged connection between holes 60 of tabs 58 of support assembly 26 of seat assembly 12 and lower set of holes 182 of side bars 166 of back section 124 of frame assembly 16. In this example arrangement, links 310 have a pair of parallel arms 312 having a rectangular planar shape extending between upper ends 314 and lower ends 316. In this example arrangement, arms 312 are connected together by central member 318 extending between arms 312. In this example arrangement, lower ends 316 of arms 312 of links 310 have holes 320 to facilitate a hinged connection with holes 60 of tabs 58 of support assembly 26 of seat assembly 12 (e.g., by a fastener extending through holes 320 and 60). In this example arrangement, upper ends 314 of arms 312 of links 310 have holes 322 to facilitate a hinged connection with lower set of holes 182 of side bars 166 of back section 124 of frame assembly 16.

Upper Guide Assembly 302:

Upper guide assembly 302 is formed of any suitable size, shape, and/or design and is configured to connect with and guide an upper portion of backrest 14 along a designated path when backrest 14 is moved from an upright position to a reclined position.

In the arrangement shown, as one example, upper guide assembly 302 includes a guide member 330 connected to upper set of holes 184 of back section 124 and positioned within slotted track 242. In this example arrangement, guide member 330 is configured to move within slotted track 242 from an upper end 332 of slotted track 242 to a lower end 334 of slotted track 242.

In operation, when backrest 14 is reclined, guide member 330 is moved rearward and downward along a curved path within slotted track 242 from upper end 332 to lower end 334, thereby moving an upper portion of backrest 14 rearward and downward. At the same time, links 310 of lower guide assembly 300 guide lower ends 174 of side bars 166 of frame assembly 16, which are connected to backrest 14, forward and down along a curved path, thereby reclining backrest 14.

Counterbalance Assembly 304:

Counterbalance assembly 304 is formed of any suitable size, shape, and/or design and is configured to apply a bias force sufficient to move backrest 14 to an upright position in the absence of a sufficient opposing force placed on backrest 14 (e.g., by an occupant leaning backward). In the arrangement shown, as one example, counterbalance assembly 304 includes a pulley arrangement configured to pull an upper portion of backrest 14 forward. In this example arrangement, the counterbalance assembly 304 includes a biasing member 350, a tensioner assembly 352, a pulley assembly 354, a first cable 356, a second cable 358, and a cam 360, among other components.

Biasing Member 350:

Biasing member 350 is formed of any suitable size, shape, and/or design, and is configured to provide a bias force to facilitate operation of counterbalance assembly 304. In the arrangement shown, as one example, biasing member 350 is a tension spring having a rearward end 364 connected to a first end 390 of first cable 356 and a forward end 362 connected to tensioner assembly 352. However, embodiments are not so limited. Rather, it is contemplated that in various different arrangements, counterbalance assembly 304 may utilize various mechanisms to move backrest 14 to the upright position including but not limited to, for example, one or more springs, one or more gas pistons, one or more gas springs, one or more hydraulic pistons, one or more actuators, one or more solenoids, one or more pneumatic members, and/or any other force generating means or combination thereof.

Tensioner Assembly 352:

Tensioner assembly 352 is formed of any suitable size, shape, and/or design, and is configured to connect a forward end 362 of biasing member 350 to a fixed position of armrest assembly 18 and allow adjustment of a distance between the forward end 362 of biasing member 350 and such fixed position. In the arrangement shown, as one example, tensioner assembly 352 is configured to connect forward end 362 of biasing member 350 to a forward end of inner partition 222 of hollow interior 216 within armrest assembly 18. In this example arrangement, tensioner assembly 352 includes a movable member 372 having an elongated shape extending between a rearward end 374, connected to forward end 362 of biasing member 350, and a forward end 376. In this example arrangement, movable member 372 is configured to move forward and rearward within a channel 378 positioned proximate to hole 236 in front 206 of each armrest assembly 18.

In this example arrangement, movable member 372 includes a threaded opening 380 extending rearward from forward end 362. In this example arrangement, tensioner assembly 352 includes a bolt 382 extending through a hole 236 and connects with threaded opening 380. A lip 384 inside hole 236 engages a head of bolt 382 and prevents bolt 382 from being pulled through hole 236 by biasing member 350.

In this example arrangement, bolt 382 is accessible by a user through hole 236 in the front 206 of armrest assemblies 18. By rotating bolt 382, a user may move movable member 372 forward and/or rearward to move forward end 362 of biasing member 350 forward and/or rearward and thereby adjust the amount of bias force to be applied to counterbalance assembly 304.

In this example arrangement, armrest assembly 18 includes a slot in inner side wall 212, which extends into channel 378. In this example arrangement, system 10 includes an indicator 388 connected to movable member 372 and positioned within slot 386. Indicator 388 allows a user to easily see where movable member 372 is positioned within channel 378 and accordingly, how much force tensioner assembly 352 has configured biasing members 350 of counterbalance assemblies 304 to apply to backrest 14. In this manner, a user may more easily adjust and balance forces applied by counterbalance assemblies 304 in right and left armrest assemblies 18.

First Cable 356:

First cable 356 is formed of any suitable size, shape, and/or design and is configured to operably connect biasing member 350 to pulley assembly 354. In the arrangement shown, as one example, first cable 356 extends from a first end 390, where first cable 356 is connected to rearward end 364 of biasing member 350, past cam 360, around pulley 396 of movable pulley assembly 354 to a second end 392, where first cable 356 is connected to a fixed position within inner partition 222 of one of the armrest assemblies 18.

Pulley Assembly 354:

Pulley assembly 354 is formed of any suitable size, shape, and/or design, and is configured to operably connect first cable 356 to second cable 358. In the arrangement shown, pulley assembly 354 is a single pulley 396 and a block 398 in a configuration that applies approximately twice the force applied by first cable 356 to second cable 358. However, the embodiments are not so limited. Rather, it is contemplated that movable pulley assembly 354 may include any number of pulleys in any number of different arrangements to increase and/or decrease the force applied to second cable 358.

Second Cable 358:

Second cable 358 is formed of any suitable size, shape, and/or design and is configured to operably connect block 398 of movable pulley assembly 354 to back section 124 of frame assembly 16 and backrest 14. In the arrangement shown, as one example, second cable 358 extends from a first end 402, where second cable 358 is connected to block 398, to a second end 404, where second cable 358 is connected to back section 124 of frame assembly 16 through forward slots 186.

Although tensioner assembly 352 is described as using first cable 356 and second cable 358 to operably connect components and facilitate operation of counterbalance assembly 304, the embodiments are not so limited. Rather, it is contemplated that components of counterbalance assembly 304 may operably connect various components using various methods and/or means including but not limited to, for example, cables, cords, lines, wires, ropes, chains, strings, belts, screws, bolts, clamps, pins, rivets, welding, snap connectors, interconnects (e.g., slide connectors, rotational connectors, and/or any other type of interconnect), friction fit connectors, adhesives, chemical bonding, and/or any other process and/or means that results in a permanent or semi-permanent connection.

Cam 360:

In one or more arrangements, counterbalance assembly 304 includes a cam 360. Cam 360 is formed of any suitable size shape, and/or design and is configured to engage first cable 356, rotate as first cable 356 is moved forward and/or rearward as movable pulley assembly 354 is moved forward and/or rearward as backrest 14 is moved between upright and reclined positions.

In one or more arrangements, cam 360 of counterbalance assembly 304 is configured to modify the tension of first cable 356 as backrest 14 is moved between upright and reclined positions. In one or more arrangements, cam 360 is configured to cause counterbalance assembly 304 to apply a larger counterbalance force to backrest 14 at one or more intermediate positions, the upright position, and the reclined position. Due to a slightly larger counterbalance force, counterbalance assembly 304 helps hold backrest 14 at one or more defined intermediate positions, thereby increasing reclining options for the occupant.

In one or more arrangements, counterbalance assembly 304 is configured to modify the tension of first cable 356 as backrest 14 is moved between upright and reclined positions. For example in some arrangements shown, cam 360 extends outward from an axis 410, about which cam 360 rotates, to a perimeter edge 412. In one or more arrangements, cam 360 includes a recess 414 (and/or channel 414) extending around perimeter edge 412 and in which first cable 356 is positioned and engages cam 360.

Figure 11B:
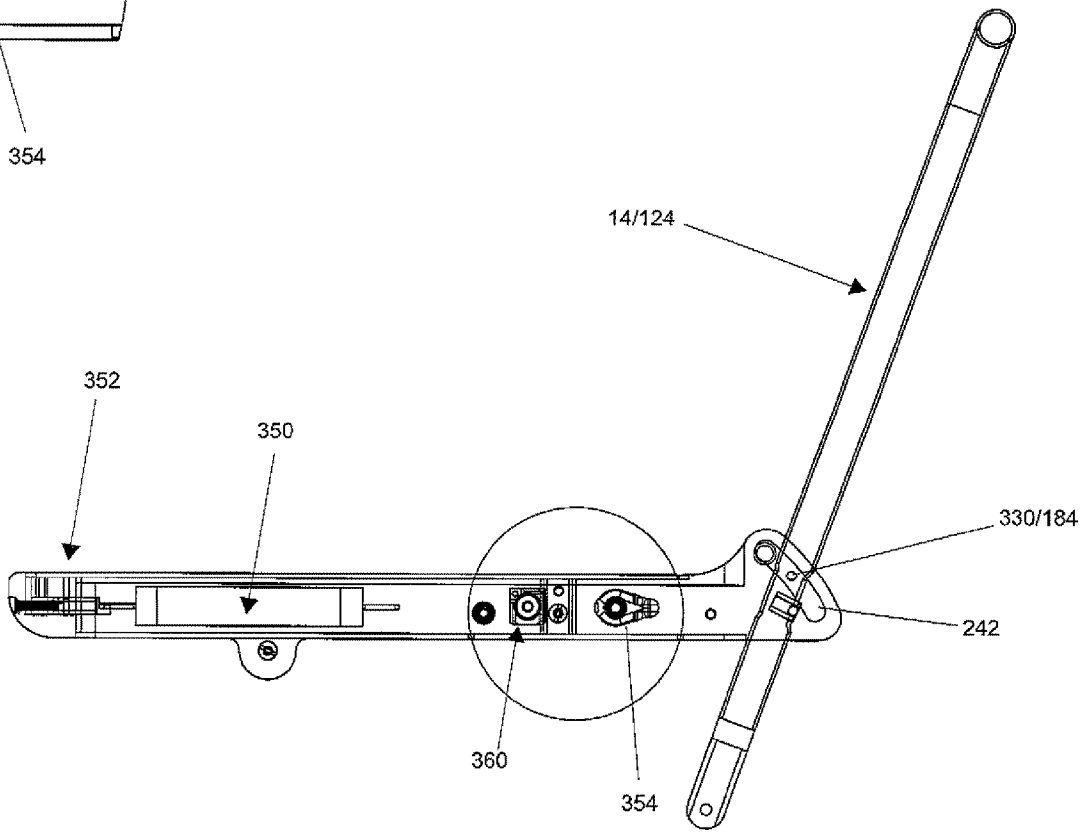
FIG. 11B is a section view of backrest in accordance with one or more arrangements, the armrest assembly, and the counterbalance assembly while the folding chair is in a partially reclined position.
Figure 11A:
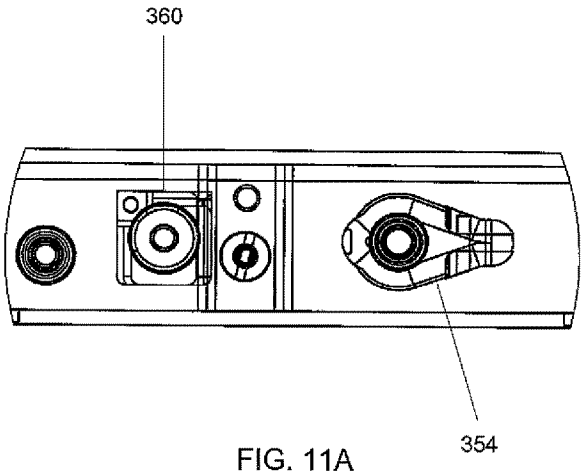
FIG. 11A is a section view of the counterbalance assembly of the folding chair in accordance with one or more arrangements; the view showing the positioning of the cam and pulley assembly of the counterbalance assembly while the folding chair is in a partially reclined position.
Figure 12B:
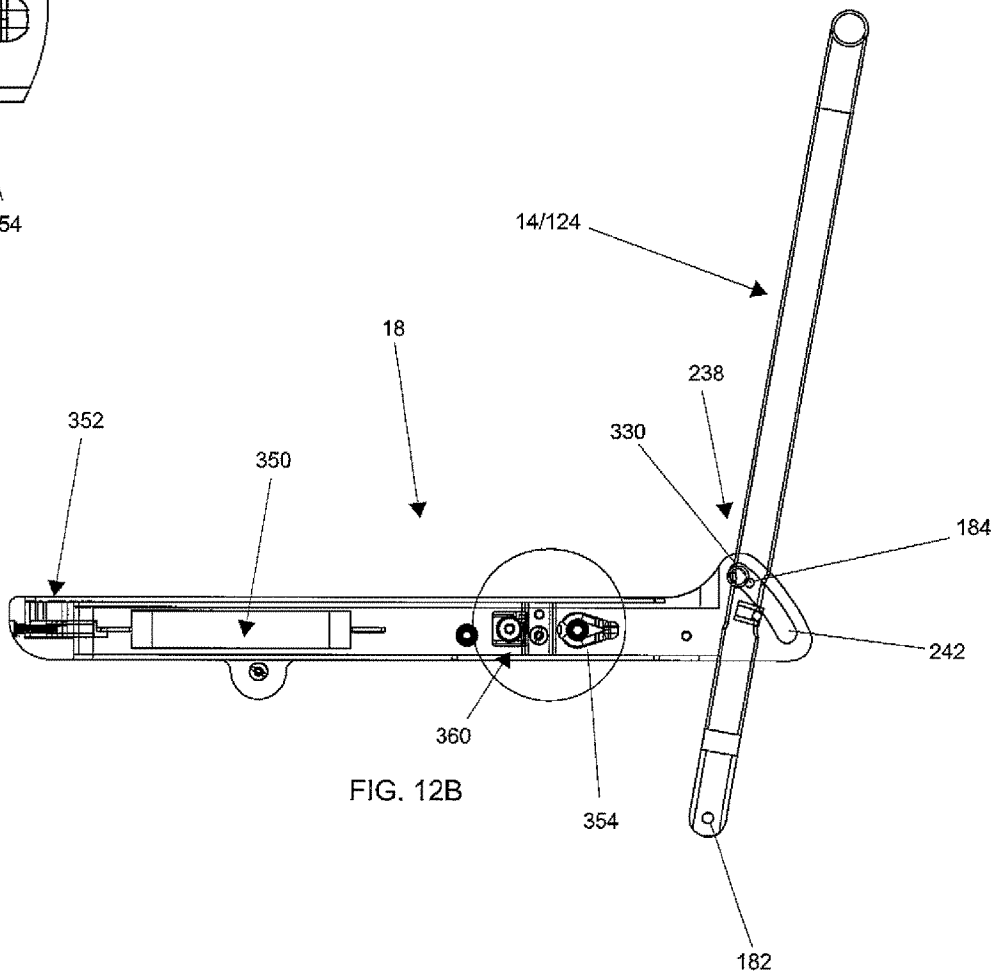
FIG. 12B is a section view of backrest, the armrest assembly in accordance with one or more arrangements, and the counterbalance assembly while the folding chair is in an upright position.
Figure 12A:
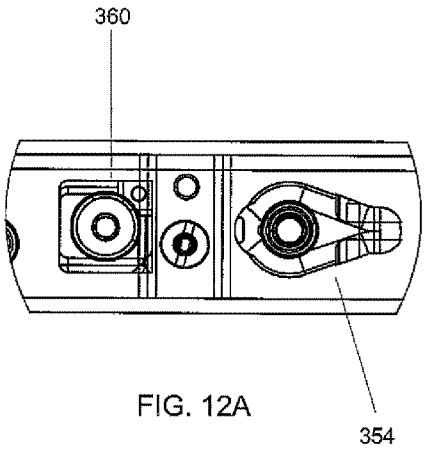
FIG. 12A is a section view of the counterbalance assembly of the folding chair in accordance with one or more arrangements; the view showing the positioning of the cam and pulley assembly of the counterbalance assembly while the folding chair is in an upright position.
Figure 13A:
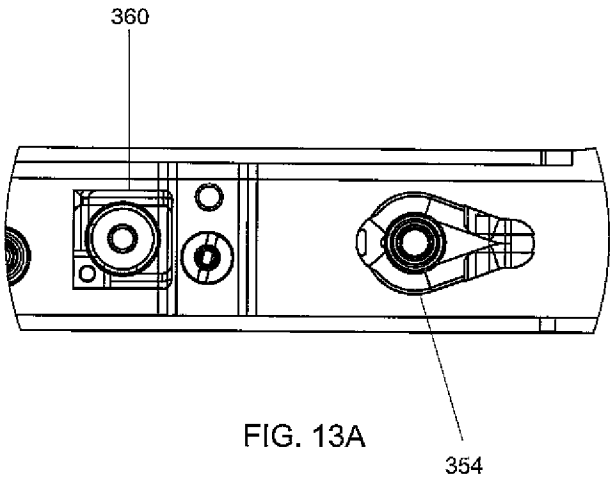
FIG. 13A is a section view of the counterbalance assembly of the folding chair in accordance with one or more arrangements; the view showing the positioning of the cam and pulley assembly of the counterbalance assembly while the folding chair is in a reclined position.
Figure 13B:
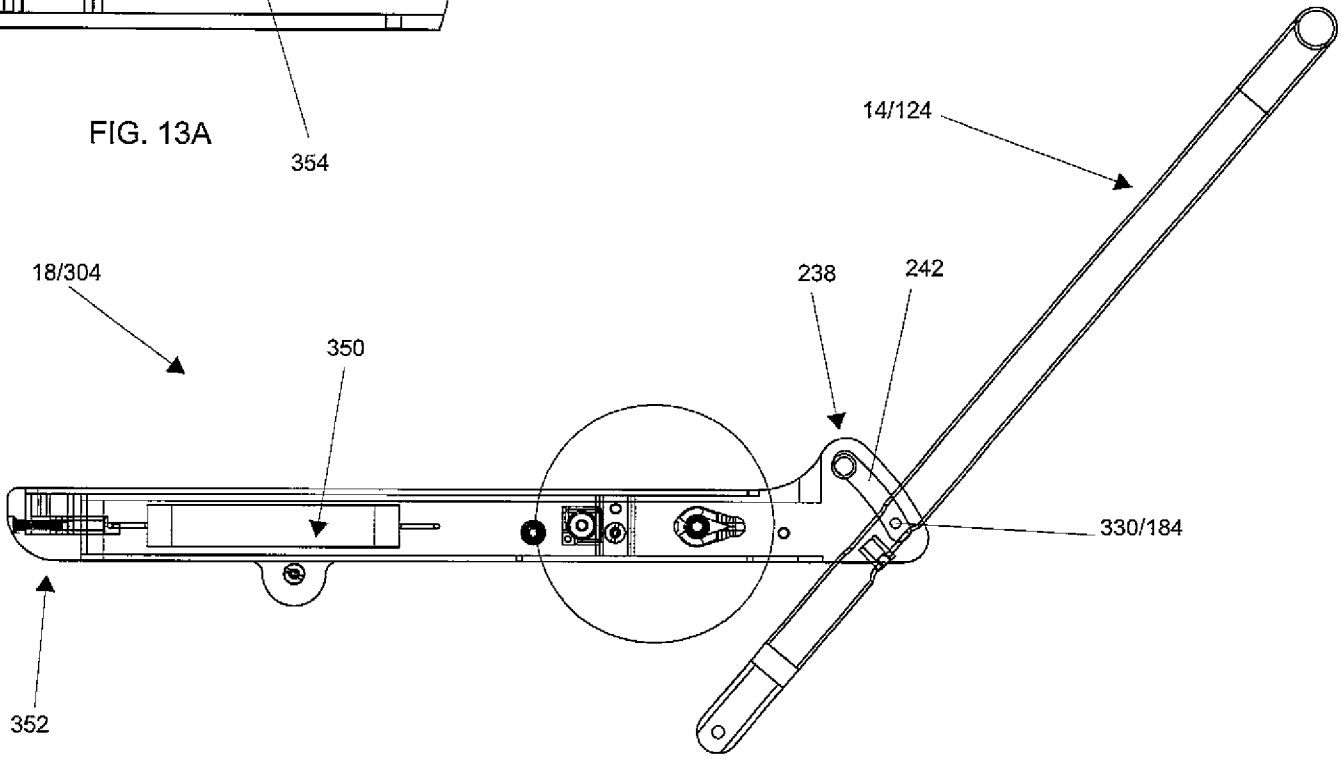
FIG. 13B is a section view of backrest, the armrest assembly in accordance with one or more arrangements, and the counterbalance assembly while the folding chair is in a reclined position.
Figure 14B:
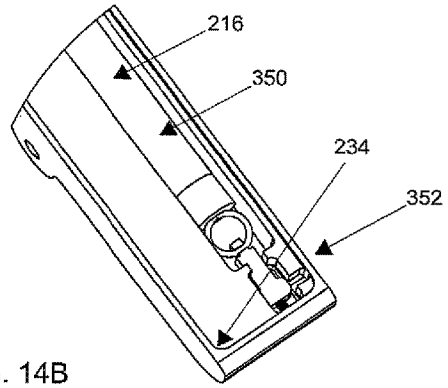
FIG. 14B is a top elevation section view of the counterbalance assembly in accordance with the embodiment shown in 14A, the view showing the biasing member and the tensioner assembly within the recess and hollow interior of the armrest assembly.
Figure 14A:
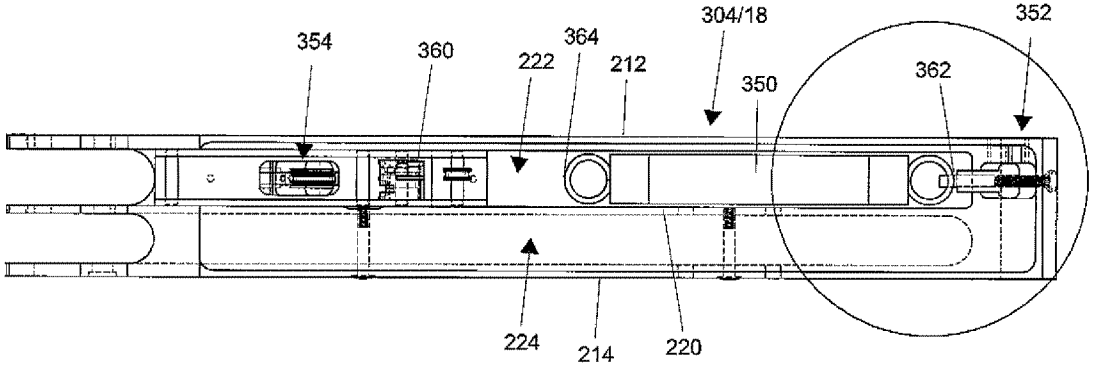
FIG. 14A is a top elevation section view of the armrest assembly in accordance with one or more arrangements, the view showing various components of the counterbalance assembly positioned within the armrest assembly.
Figure 14C:
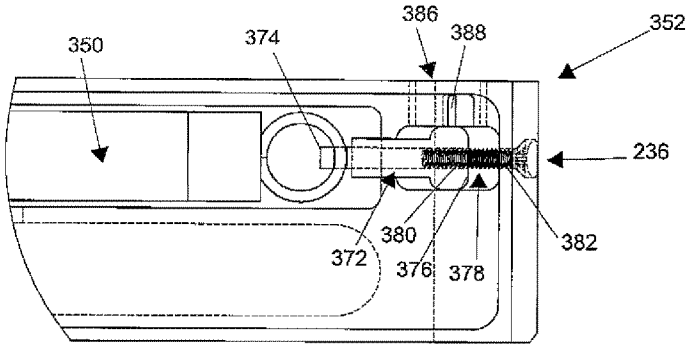
FIG. 14C is a side elevation section view of the counterbalance assembly in accordance with the embodiment shown in 14A, the view showing the biasing member and the tensioner assembly within the recess and hollow interior of the armrest assembly.
Figure 14D:
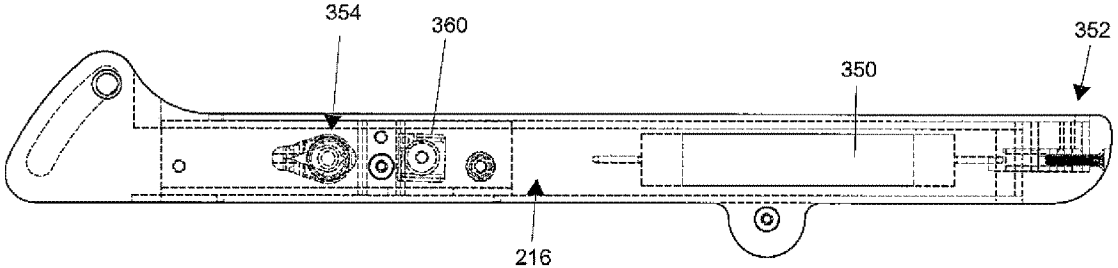
FIG. 14D is a side elevation section view of the armrest assembly in accordance with one or more arrangements, the view showing various components of the counterbalance assembly positioned within the armrest assembly.
Figure 15:
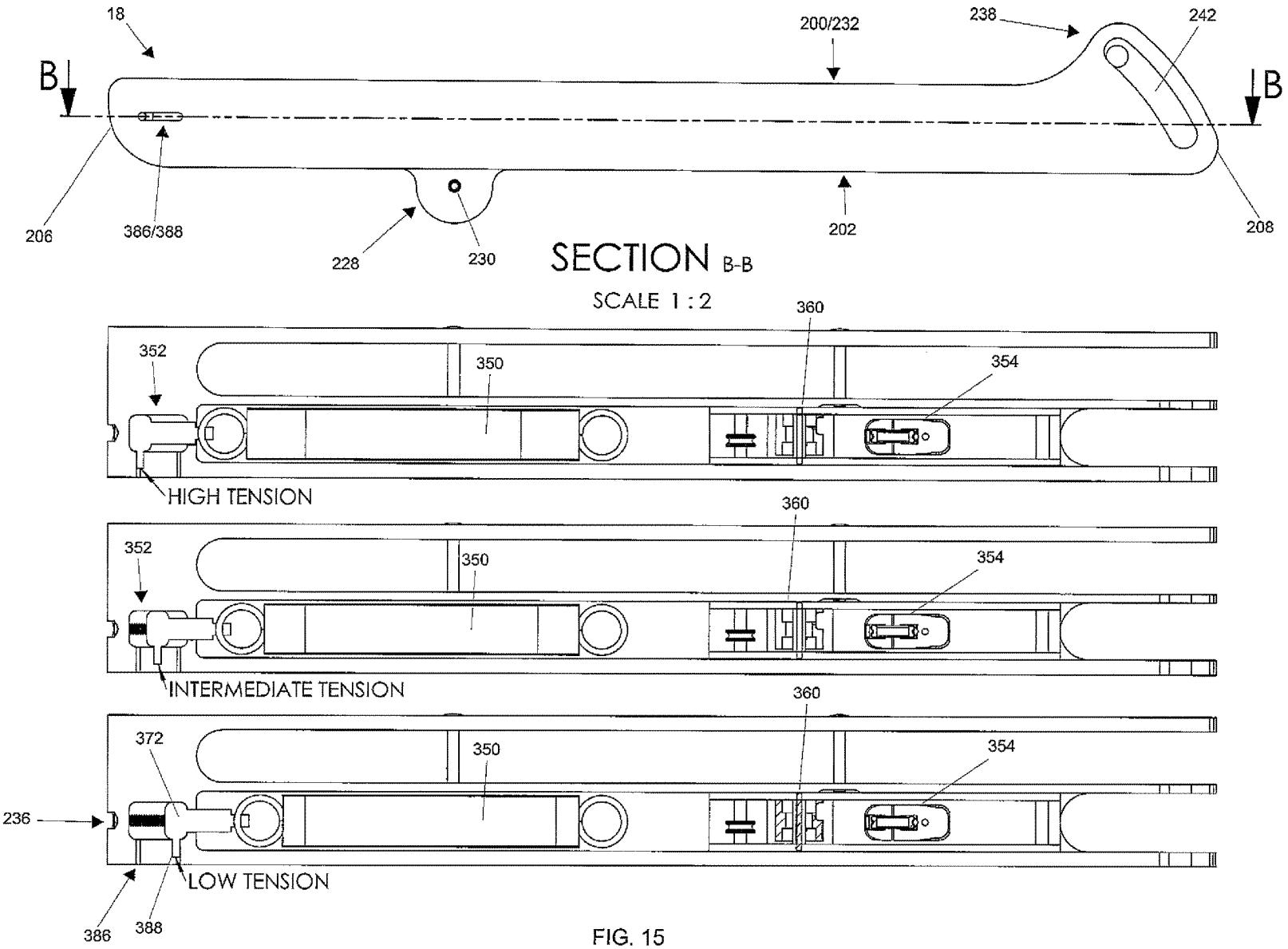
FIG. 15 is a section view of armrest assembly of the folding chair; the view showing components of the counterbalance assembly positioned within the armrest assembly.
Figure 16A:
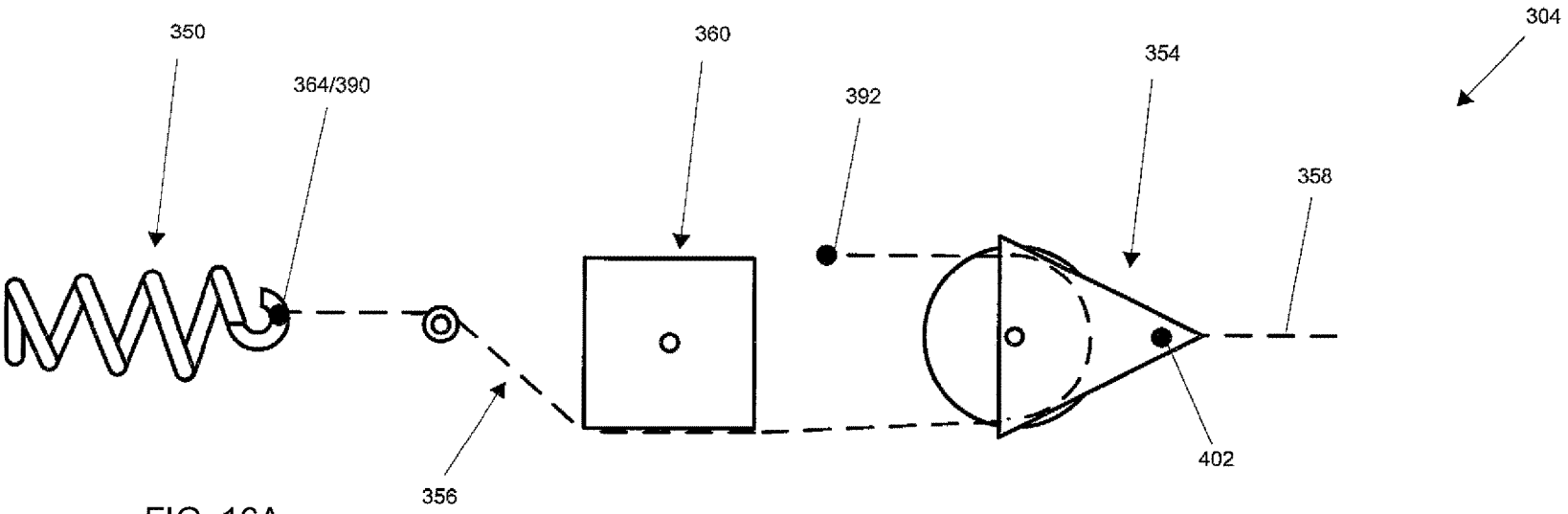
FIG. 16A is an elevation view of the counterbalance assembly in accordance with one or more arrangements, the view showing the biasing member, pulley assembly, the first cable, the cam, and the second cable; the view showing the counterbalance assembly in a first position.
Figure 16B:
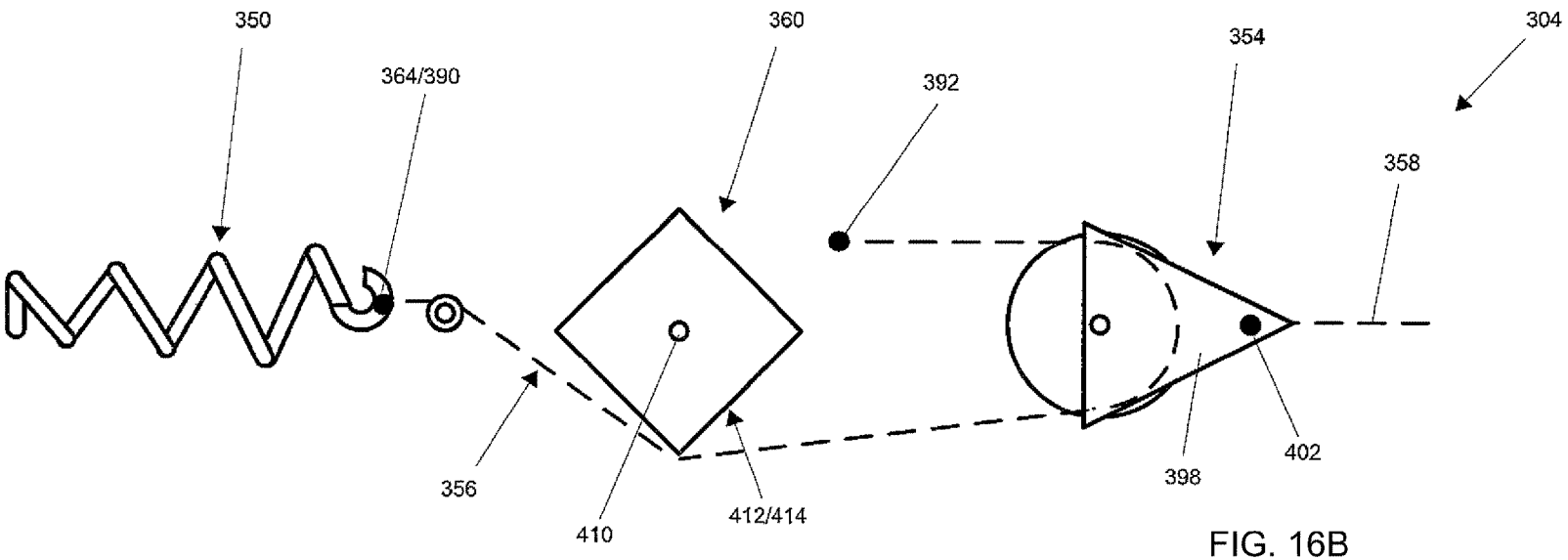
FIG. 16B is an elevation view of the counterbalance assembly in accordance with one or more arrangements, the view showing the biasing member, pulley assembly, the first cable, the cam, and the second cable; the view showing the counterbalance assembly in a second position.

In one or more arrangements, cam 360 is shaped so the distance of perimeter edge 412 to axis 410 is non-uniform. In the arrangement shown, in FIGS. 11-16, for example, cam 360 has a square shape. In this example arrangement, as a corner of the square shaped cam 360 is rotated downward, first cable 356 is pushed downward by cam 360 thereby increasing tension on first cable 356 and increasing the counterbalance force on backrest 14 that is experienced by a user. However, the embodiments are not so limited. Rather, it is contemplated that cam 360 of counterbalance assembly 304 may be any shape suitable to provide a desired counterbalance force as backrest 14 is moved between upright and reclined positions.

The embodiments are not limited to use of non-uniform cams to provide dynamic counterbalance force. Rather, it is contemplated that reclining mechanism 22 of system 10 may utilize various methods and means for holding backrest 14 at one or more intermediate positions including but not limited to, for example, recesses, protrusions, indents, detents, holes, compressive fittings, frictional stops, magnetic components, gears, latches, non-linear springs, non-uniform cams and pulleys and/or any other suitable means and/or methods known in the art.

Reclining Operation:

In operation, in absence of an opposing force, biasing member 350 of counterbalance assembly 304 pulls first end 390 of first cable 356, which causes movable pulley assembly 354 and second cable 358 to pull backrest 14 forward to an upright position. As backrest 14 is pulled forward, upper guide assembly 302 moves an upper end of backrest 14 upward and forward. At the same time, lower guide assembly 300 moves a lower end of backrest 14 upward and rearward.

Conversely, when backrest 14 is reclined by a user, upper guide assembly 302 moves an upper end of backrest 14 downward and rearward and lower guide assembly 300 moves a lower end of backrest 14 downward and forward. At the same time, counterbalance assembly 304, applies an opposing forward force to backrest 14 to provide comfortable support for an occupant. As backrest 14 is moved between upright and reclined positions, cam 360 may dynamically increase tension on first cable 356 and thereby increase the opposing forward force counterbalance assembly 304 applies to backrest 14 at one or more intermediate positions. In this manner, counterbalance assembly 304 assists a user in reclining at multiple fixed positions.

Folding Operation:

In the arrangement shown, some various components of system 10 are connected by hinged connections, which facilitate folding and unfolding of system 10. To fold system 10, a user first unlocks lock assembly 20 by moving stop members 262 rearward to permit folding of system 10. A user may then hold back section 124 of frame assembly 16 while raising front edge 34 of support assembly 26 of seat assembly 12. As front edge 34 of support assembly 26 of seat assembly 12 is raised, hinged connections cause front 206 of armrest assemblies 18 to move upwards and toward back section 124 of frame assembly 16. At the same time, lower ends 138 of front legs 130 move rearward toward rear legs 150. Folding repositions components of system 10 in this manner until seat assembly 12, backrest 14, and front legs section 120, rear leg section 122 and back section 124 of frame are close to parallel alignment. Conversely, to unfold system 10, a user may move front edge 34 of support assembly 26 of seat assembly 12 away from back section 124 of frame assembly 16 until system 10 is unfolded. The user may lock system 10 in the unfolded position by moving stop members 262 of lock assembly 20 forward until they contact rear legs 150 if rear legs section 122 of frame assembly 16.

In this example arrangement, hinged connections between various components of system 10 are primarily described as being formed by fasteners (e.g., bolts, screws, rivets, axle, shaft, and/or any other fasteners) extending through holes of two or more components such that components may pivot with respect one another about the fastener. However, the embodiments are not so limited. Rather, it is contemplated that hinged connections may be implemented using any various methods and/or means for providing a hinged connecting known in the art.

Alternative Arrangement(s)

Figure 2:
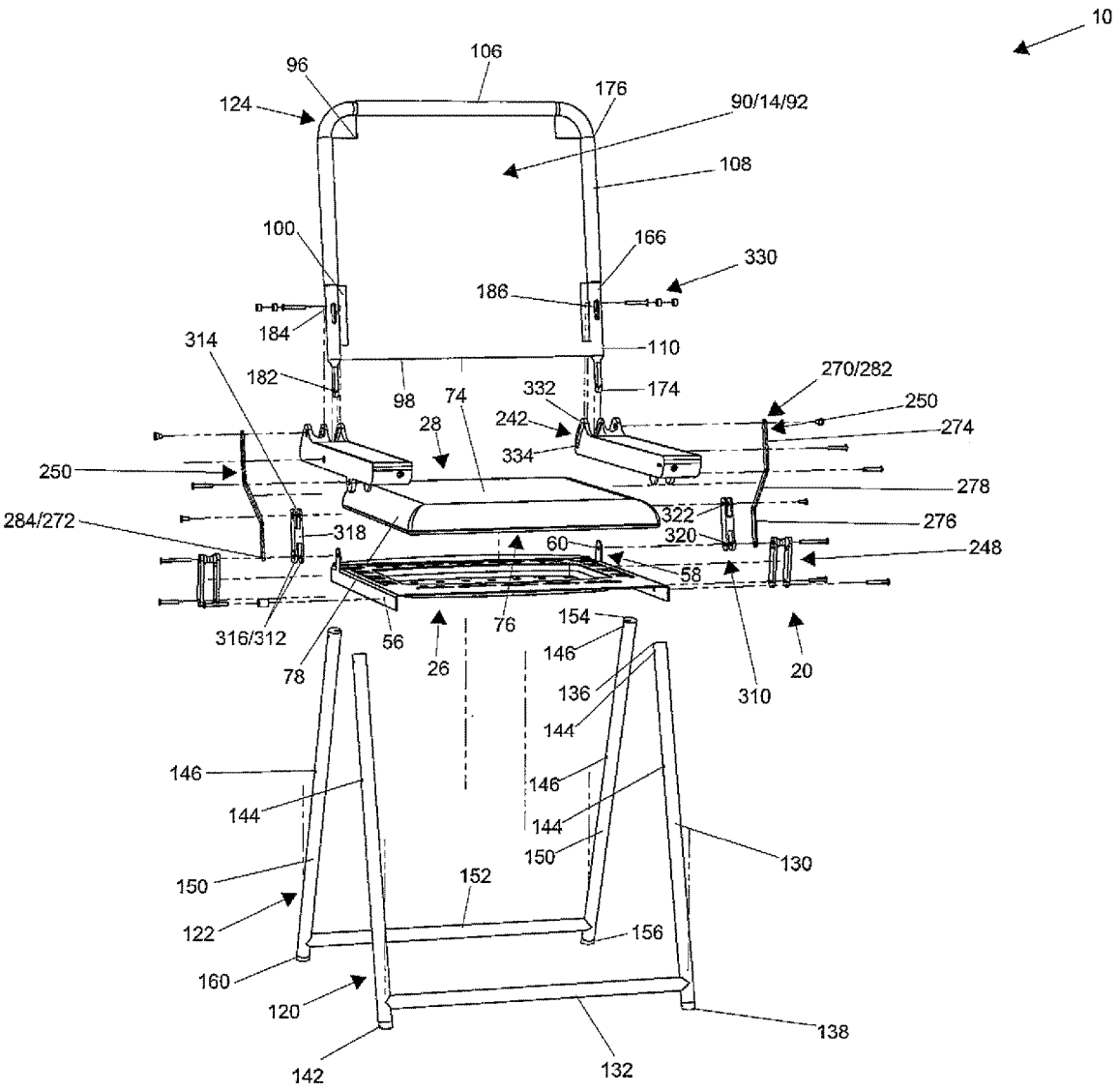
FIG. 2 is a perspective exploded view of the folding chair, the view showing various components of the folding chair in accordance with one or more arrangements.
Figure 3:
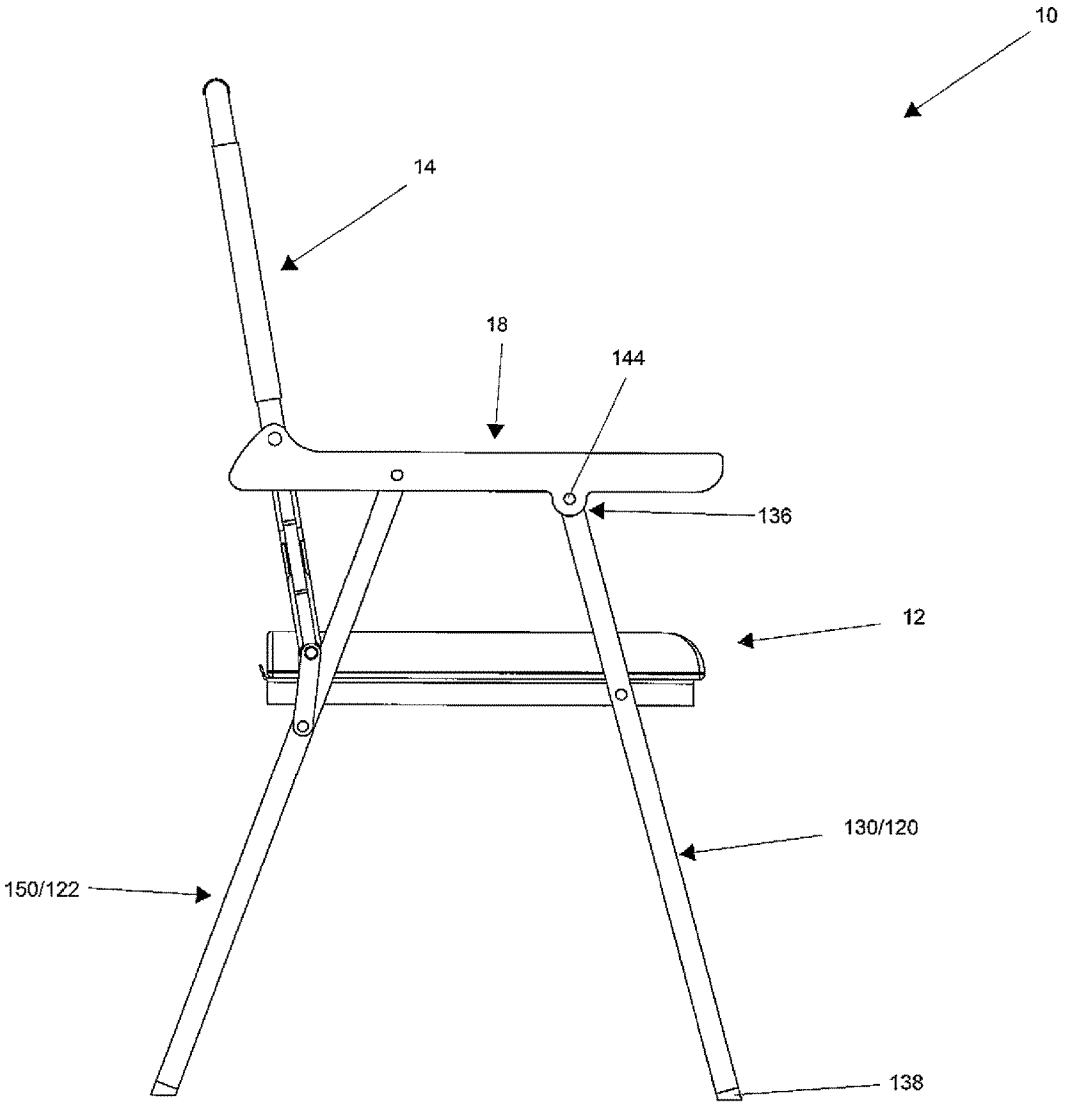
FIG. 3 is a right elevation view of the folding chair in accordance with one or more arrangements, the view showing the folding chair having a seat assembly, a backrest, an armrest assembly, and the front leg section and the back leg section of the frame assembly; the view showing the folding chair backrest in an upright position.
Figure 4:
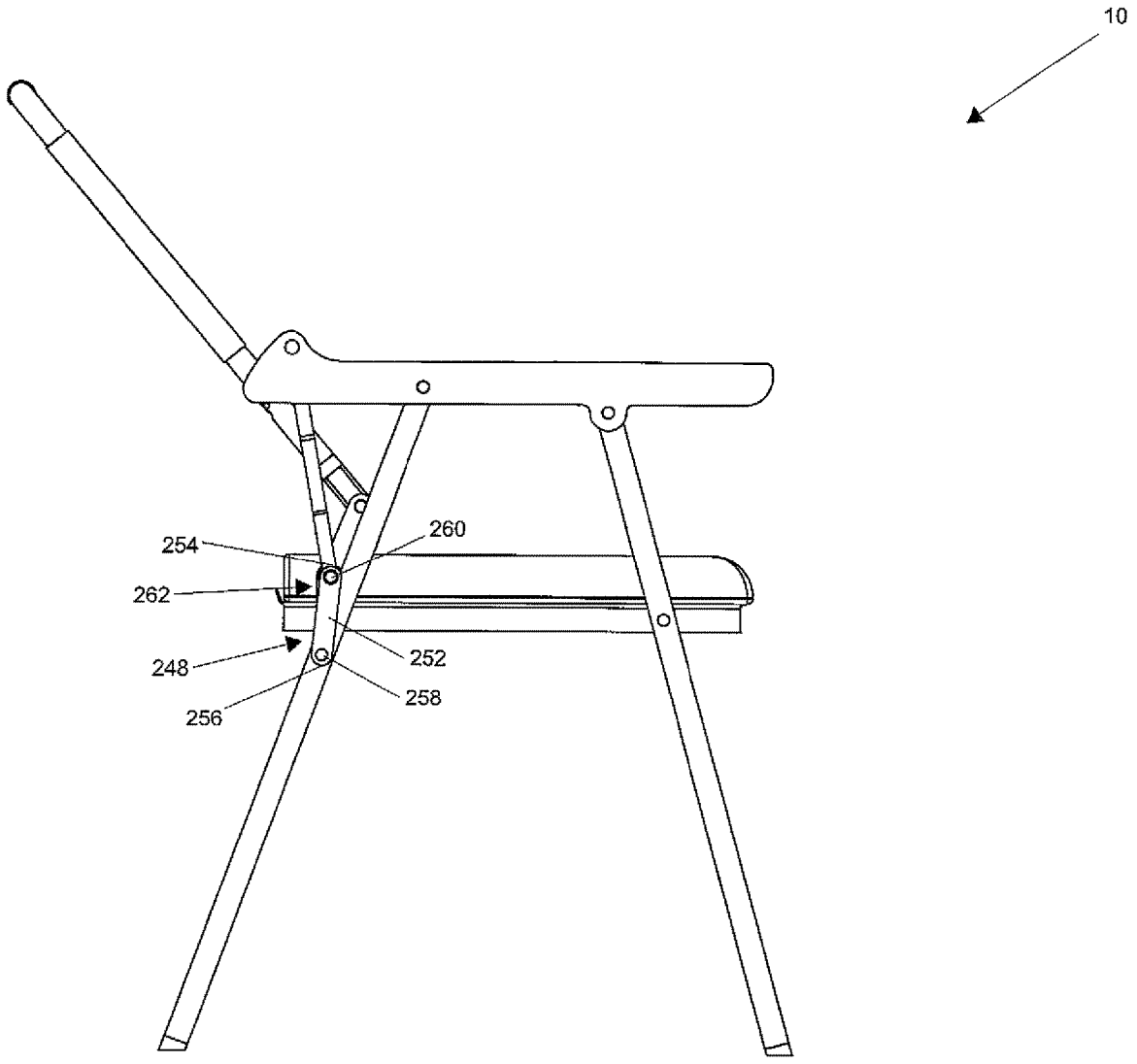
FIG. 4 is another right elevation view of the folding chair in accordance with one or more arrangements, the view showing the folding chair having a lock assembly having a lower link and an arm with an upper end and a lower end and holes at each of the upper end and lower end, and a stop member; the view also showing the folding chair in a reclined position.
Figure 5:
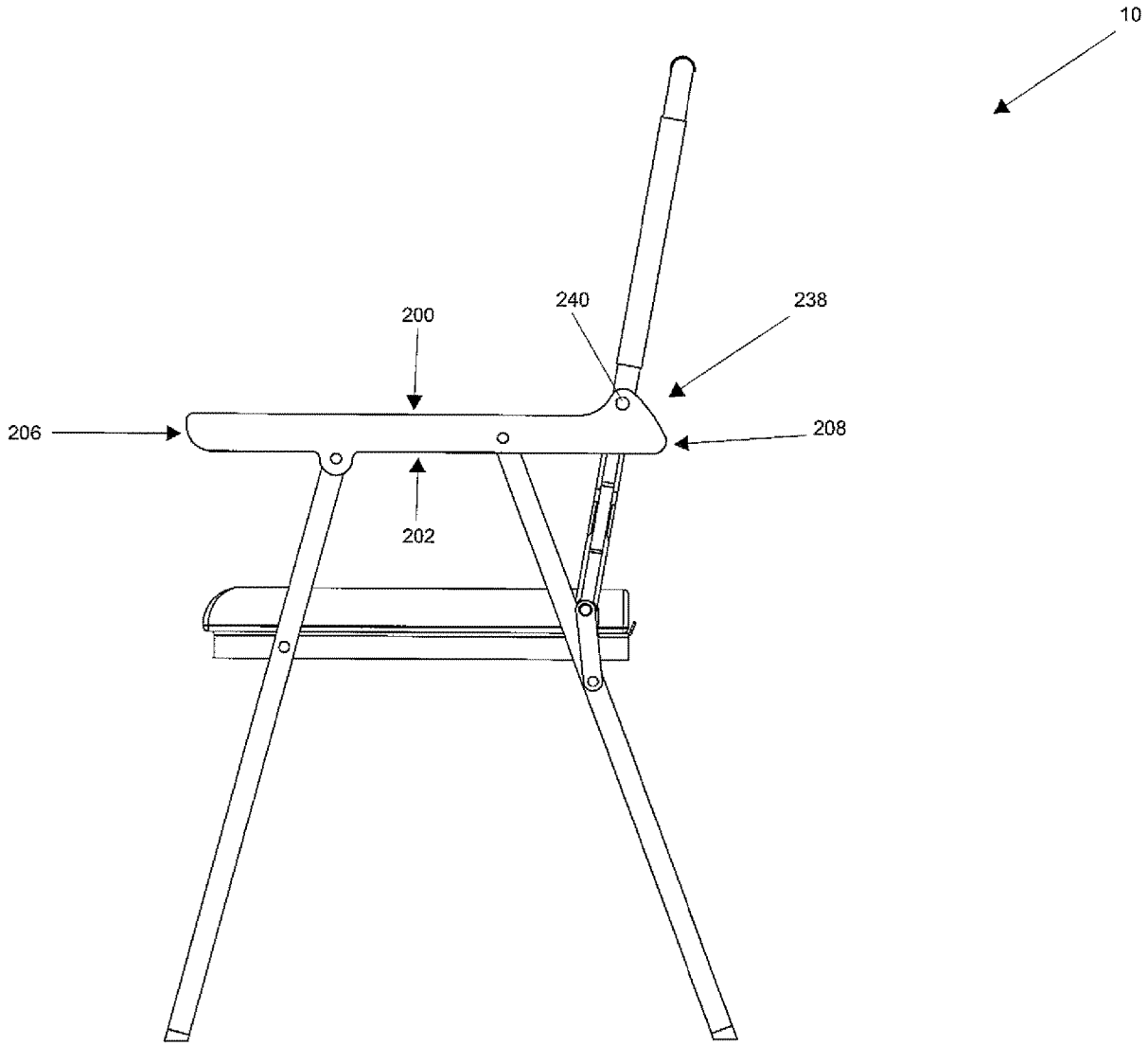
FIG. 5 is a left elevation view of the folding chair in accordance with one or more arrangements, the view showing the folding chair having an armrest assembly having a top, a bottom, a front end, a back end, a connection assembly, and a hold; the view also showing the folding chair in an upright position.
Figure 6:
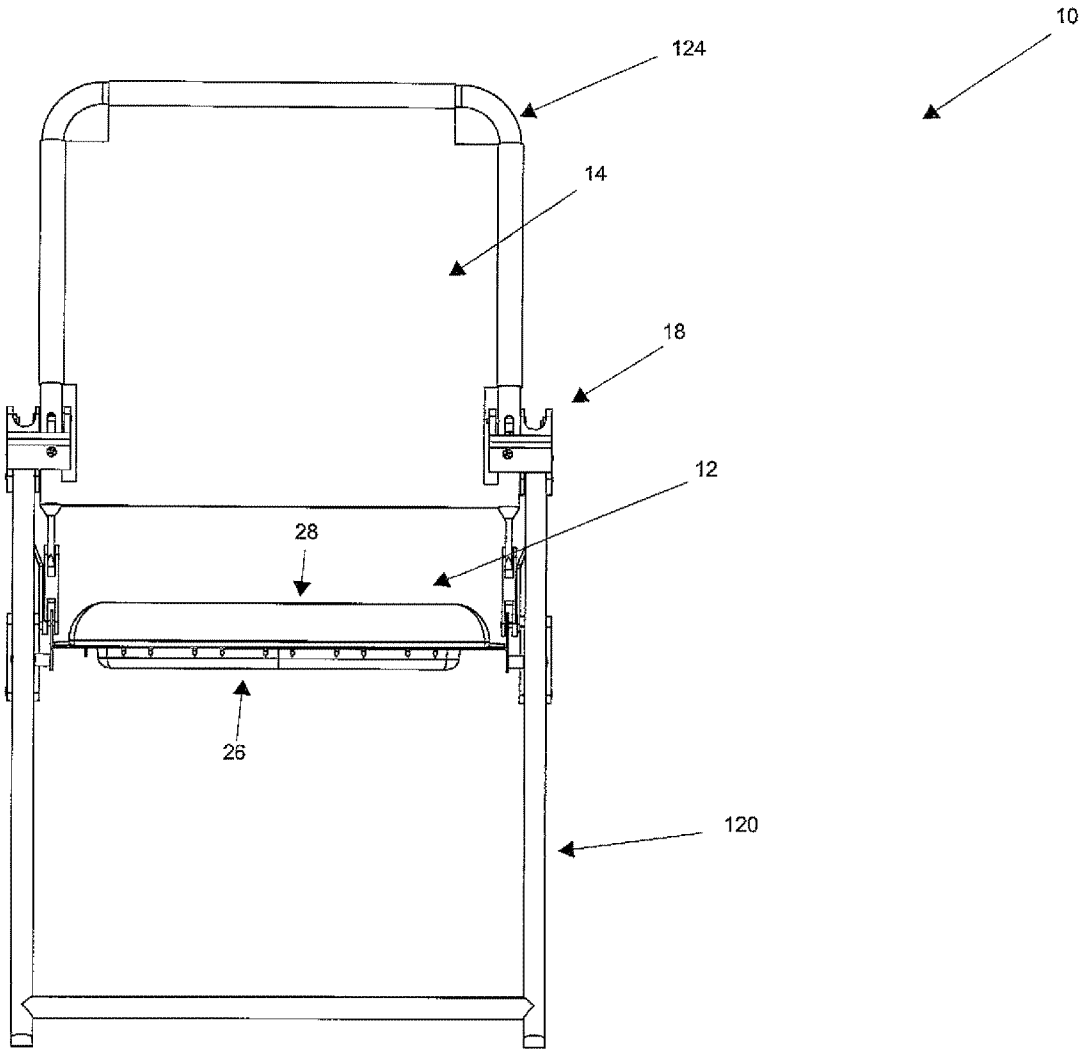
FIG. 6 is a front elevation view of the folding chair in accordance with one or more arrangements, the view showing the folding chair having a seat assembly with a support assembly and a cushion, a backrest, an armrest assembly, a front leg section, and a back section.
Figure 7:
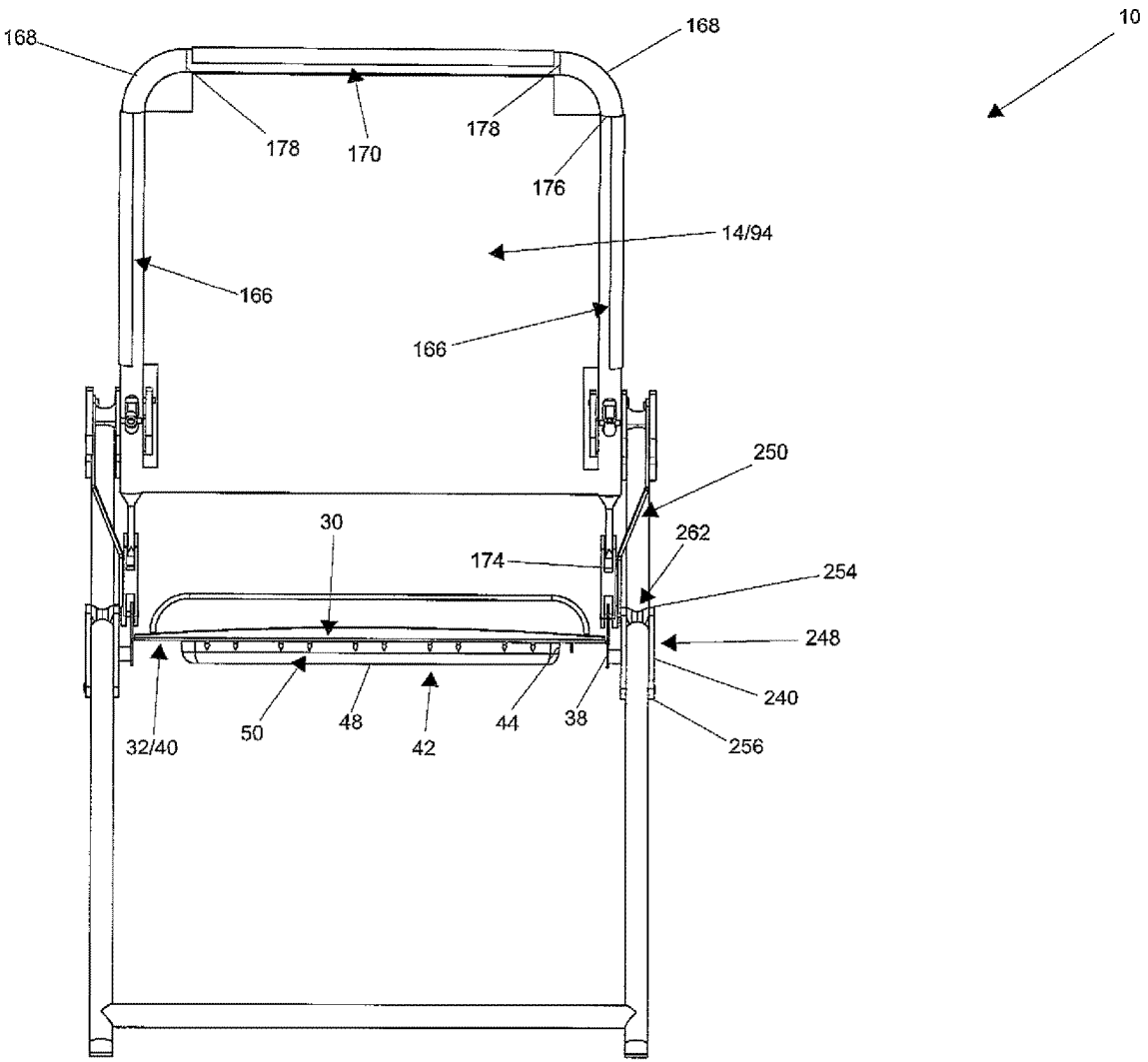
FIG. 7 is a back elevation view of the folding chair in accordance with one or more arrangements, the view showing the folding chair having a backrest, a lock assembly with a lower link, a seat assembly with a support assembly, a lock assembly with a lower link, an upper link and arms, and a frame assembly with a back section.
Figure 8:
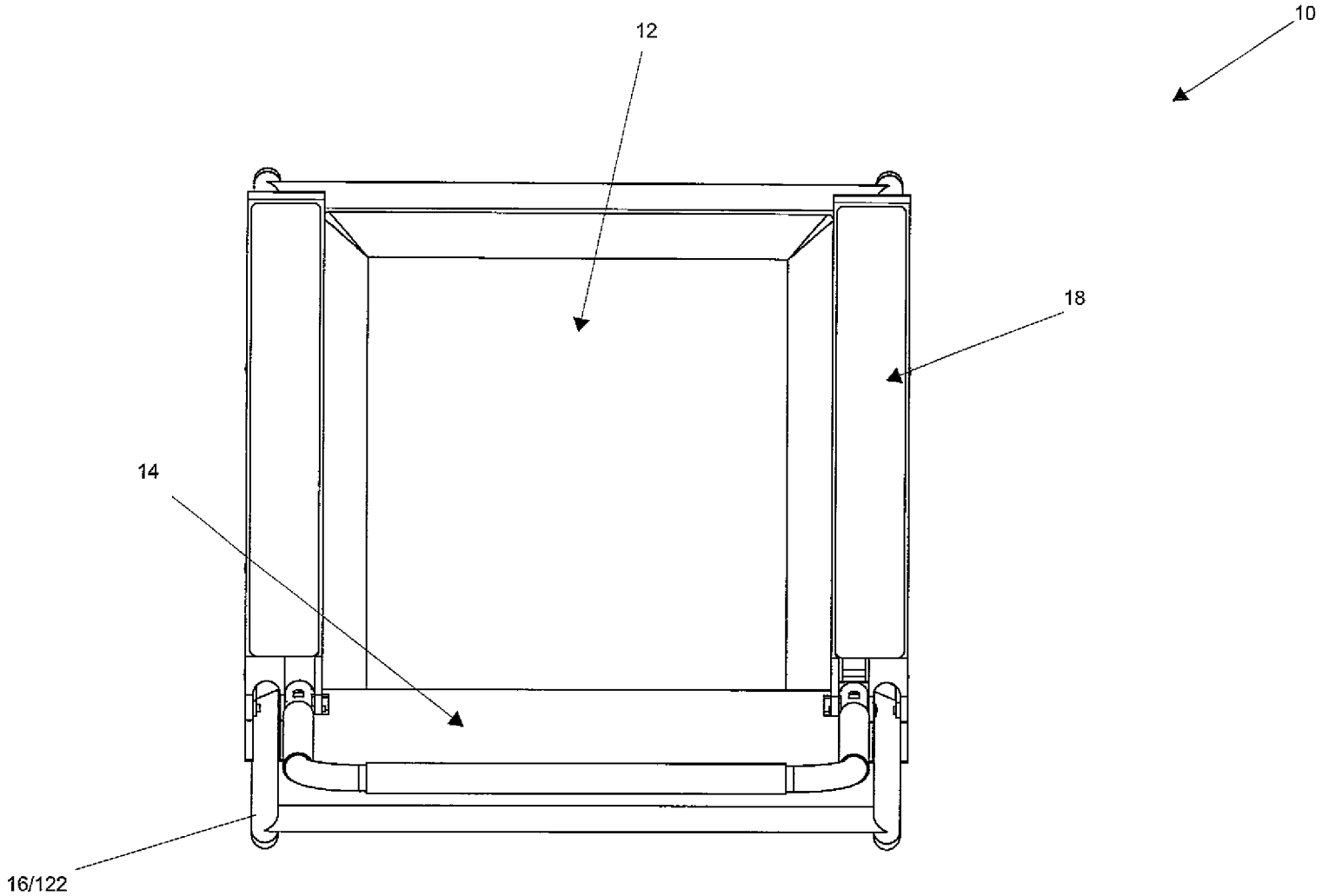
FIG. 8 is a top elevation view of the folding chair in accordance with one or more arrangements, the view showing the folding chair having a seat assembly, a backrest, a frame assembly with a rear leg section, and an armrest assembly.
Figure 9:
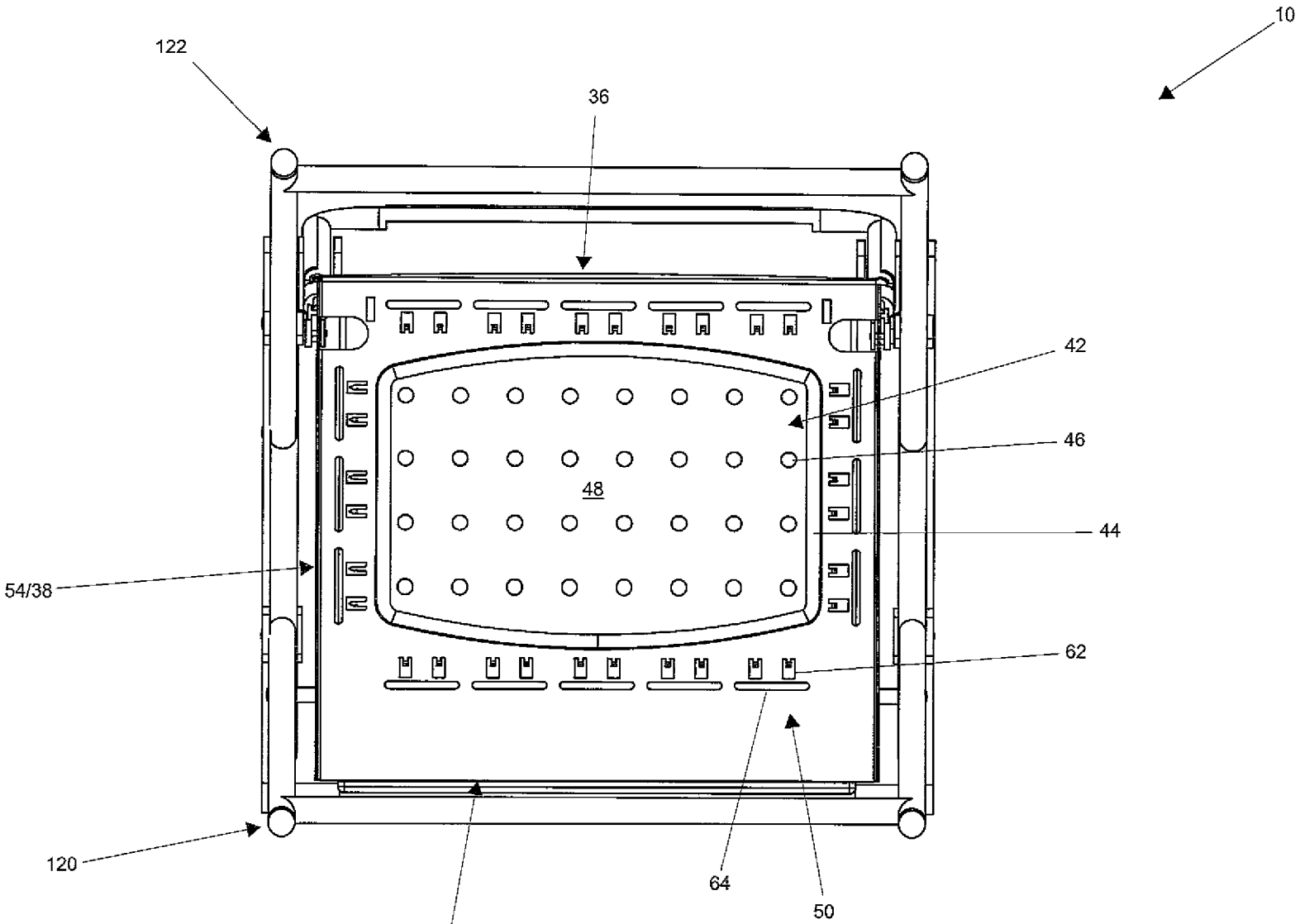
FIG. 9 is a bottom elevation view of the folding chair in accordance with one or more arrangements, the view showing a seat assembly with a support assembly, the support assembly having a center indent, connection members, and connection members; the view also showing a front leg section and a rear leg section of the frame assembly.
Figure 10:
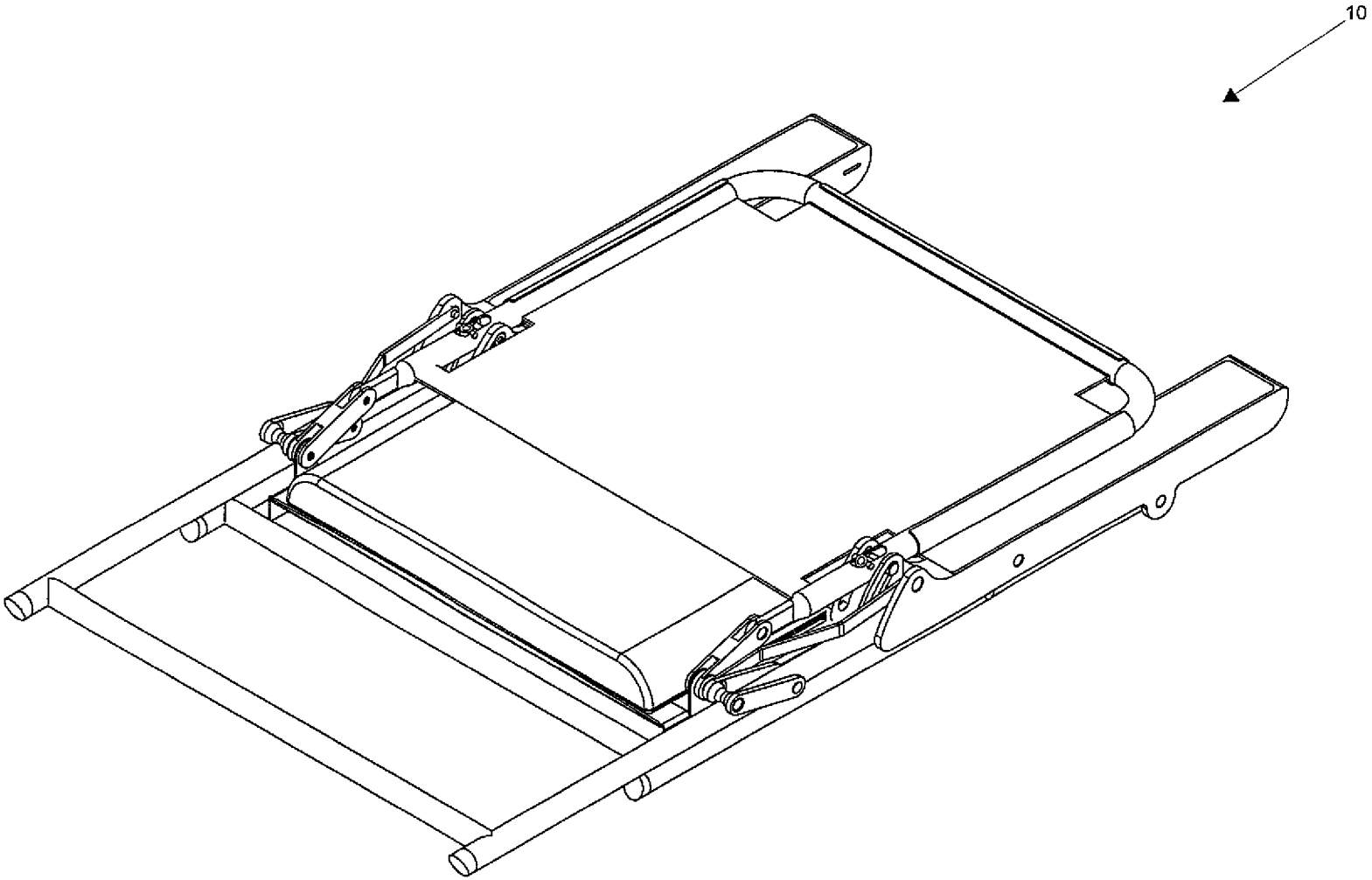
FIG. 10 is a perspective view of the folding chair in accordance with one or more arrangements, the view showing the folding chair in a folded position.
Figure 18:
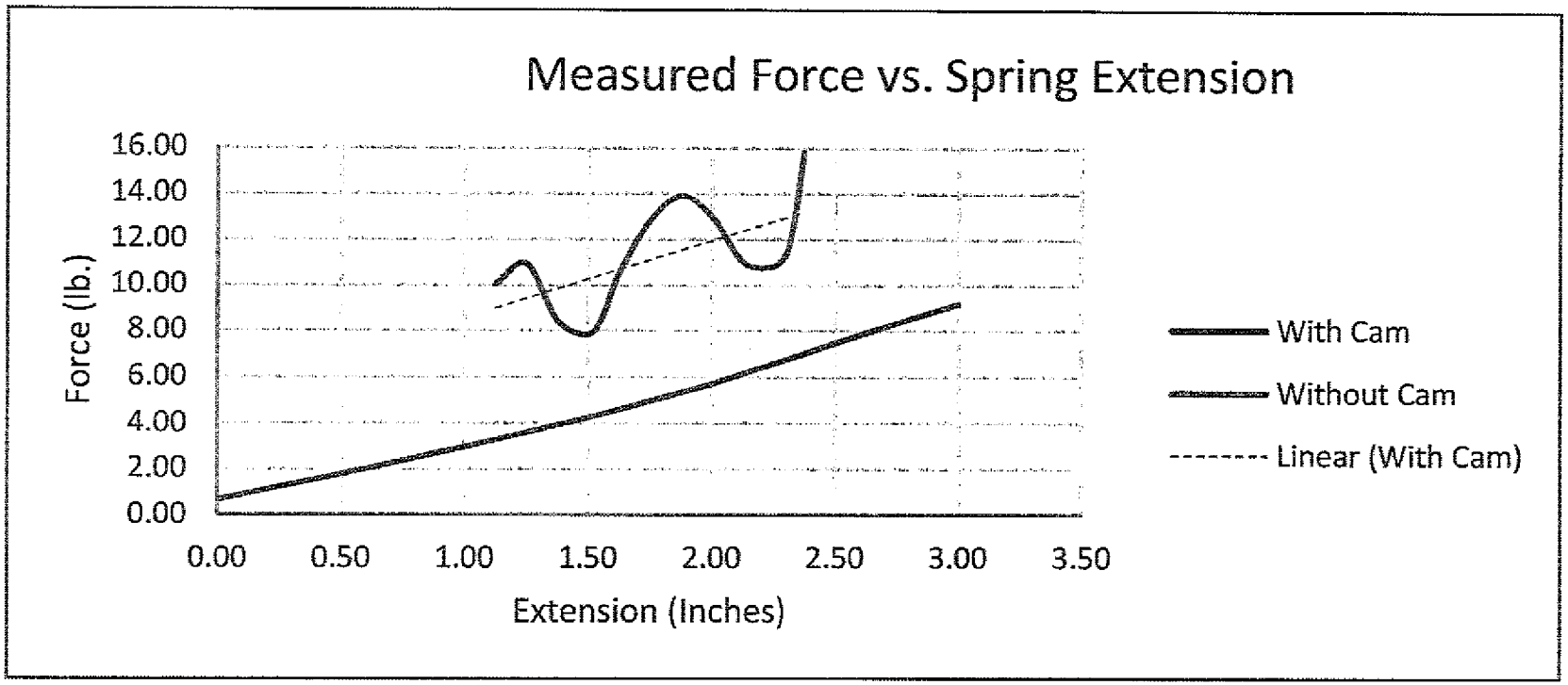
FIG. 18 is a graph showing the measured force verses spring extension of the counterbalance assembly with a cam and without a cam.
Figure 19:
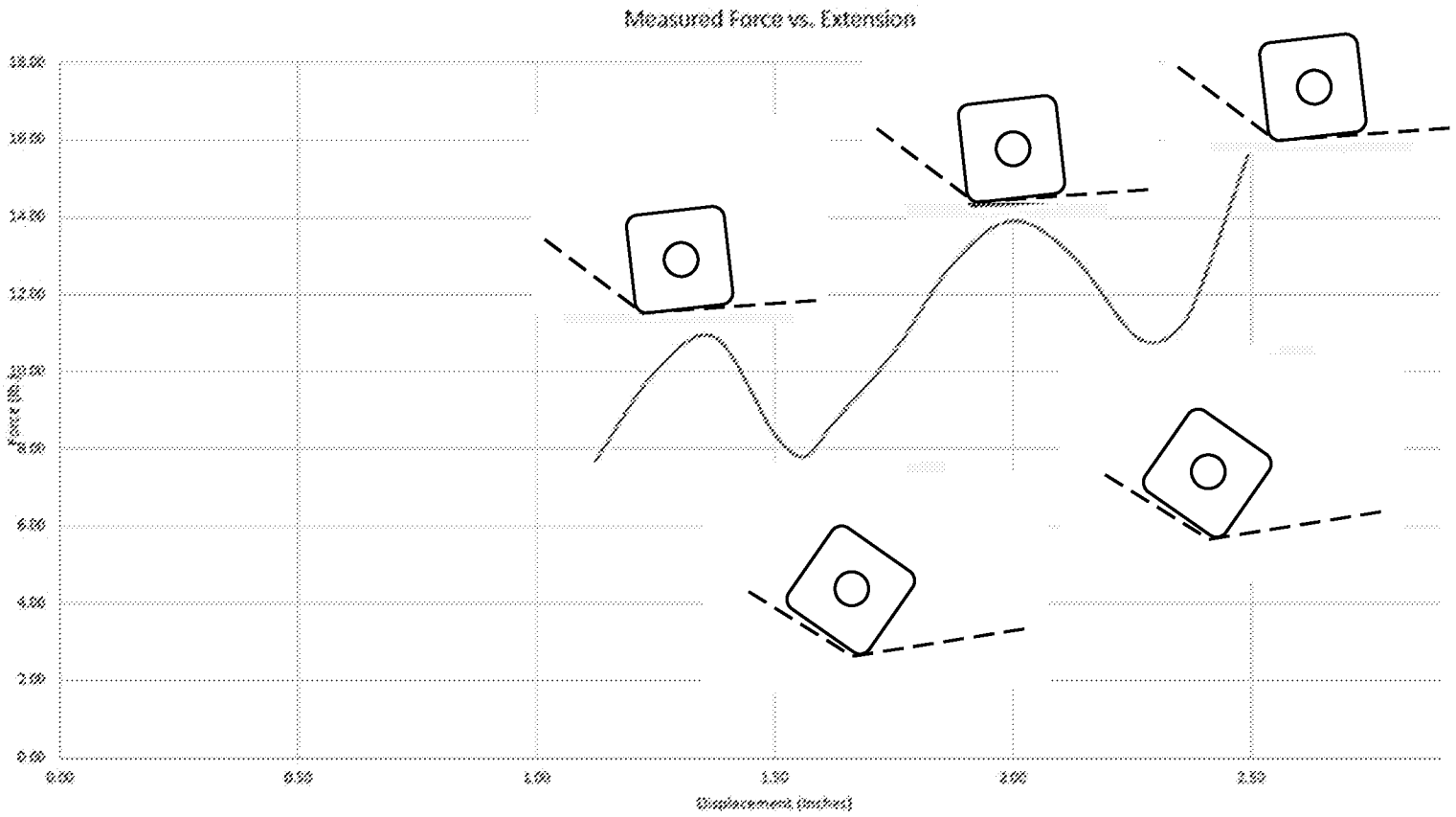
FIG. 19 is a graph showing the measured force verses spring extension of the counterbalance assembly with a cam in accordance with the graph shown in FIG. 20, this graph overlayed with images of the positioning of the cam at different points of extension.
Figure 20C:
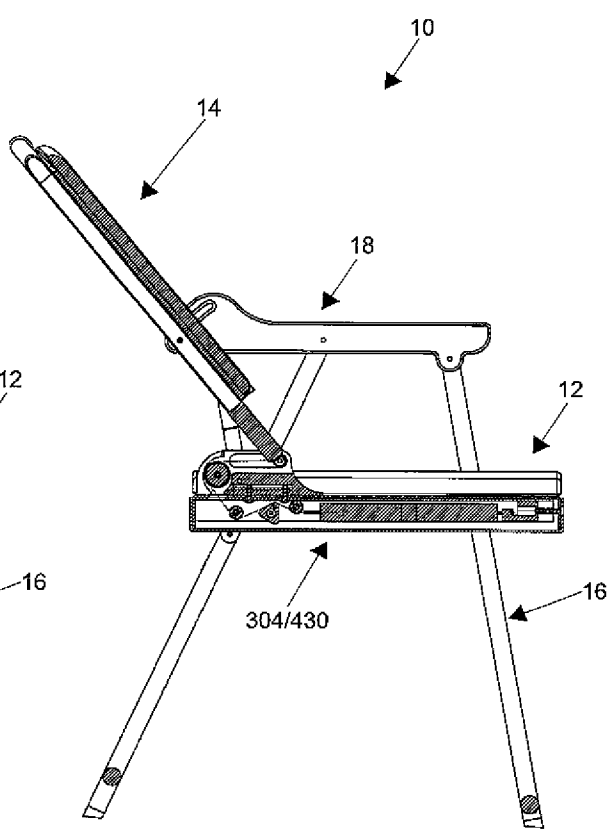
FIG. 20C is a side elevation view of the folding chair in accordance with one or more arrangements, the view showing the folding chair having a seat assembly, a backrest, a frame assembly, and an armrest assembly; the view showing a section view of portion of the seat assembly so as to view the reclining mechanism including a counterbalance assembly and counterbalance housings; the view also showing the folding chair in a reclined position.
Figure 20B:
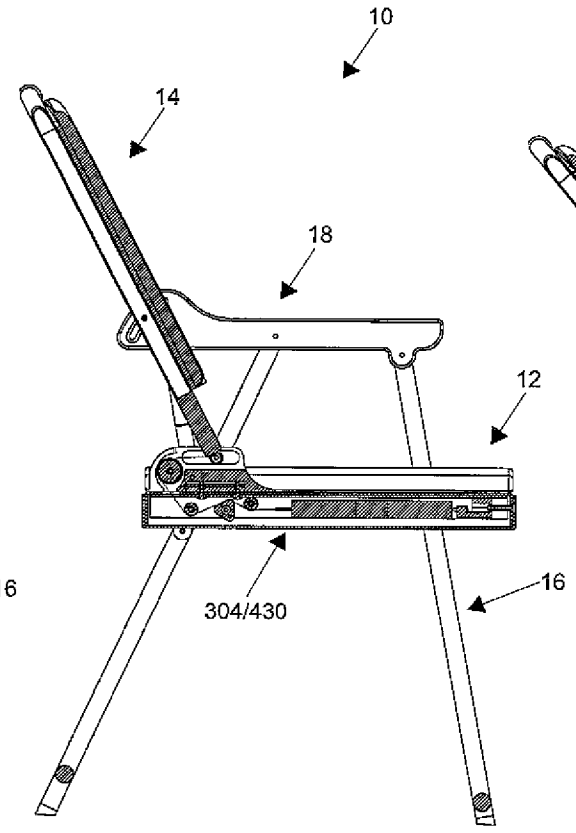
FIG. 20B is a side elevation view of the folding chair in accordance with one or more arrangements, the view showing the folding chair having a seat assembly, a backrest, a frame assembly, and an armrest assembly; the view showing a section view of portion of the seat assembly so as to view the reclining mechanism including a counterbalance assembly and counterbalance housings; the view also showing the folding chair in a partially reclined position.
Figure 20A:
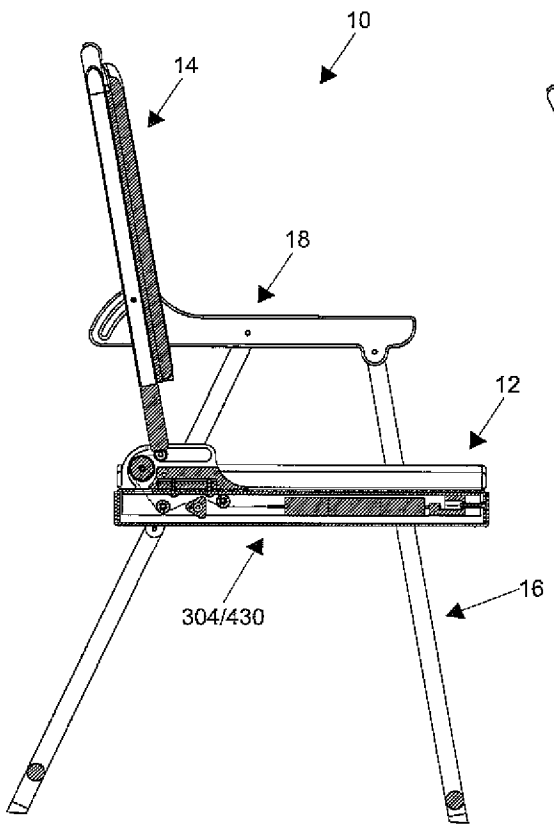
FIG. 20A is a side elevation view of the folding chair in accordance with one or more arrangements, the view showing the folding chair having a seat assembly, a backrest, a frame assembly, and an armrest assembly; the view showing a section view of portion of the seat assembly so as to view the reclining mechanism including a counterbalance assembly and counterbalance housings; the view also showing the folding chair in an upright position.
Figure 21:
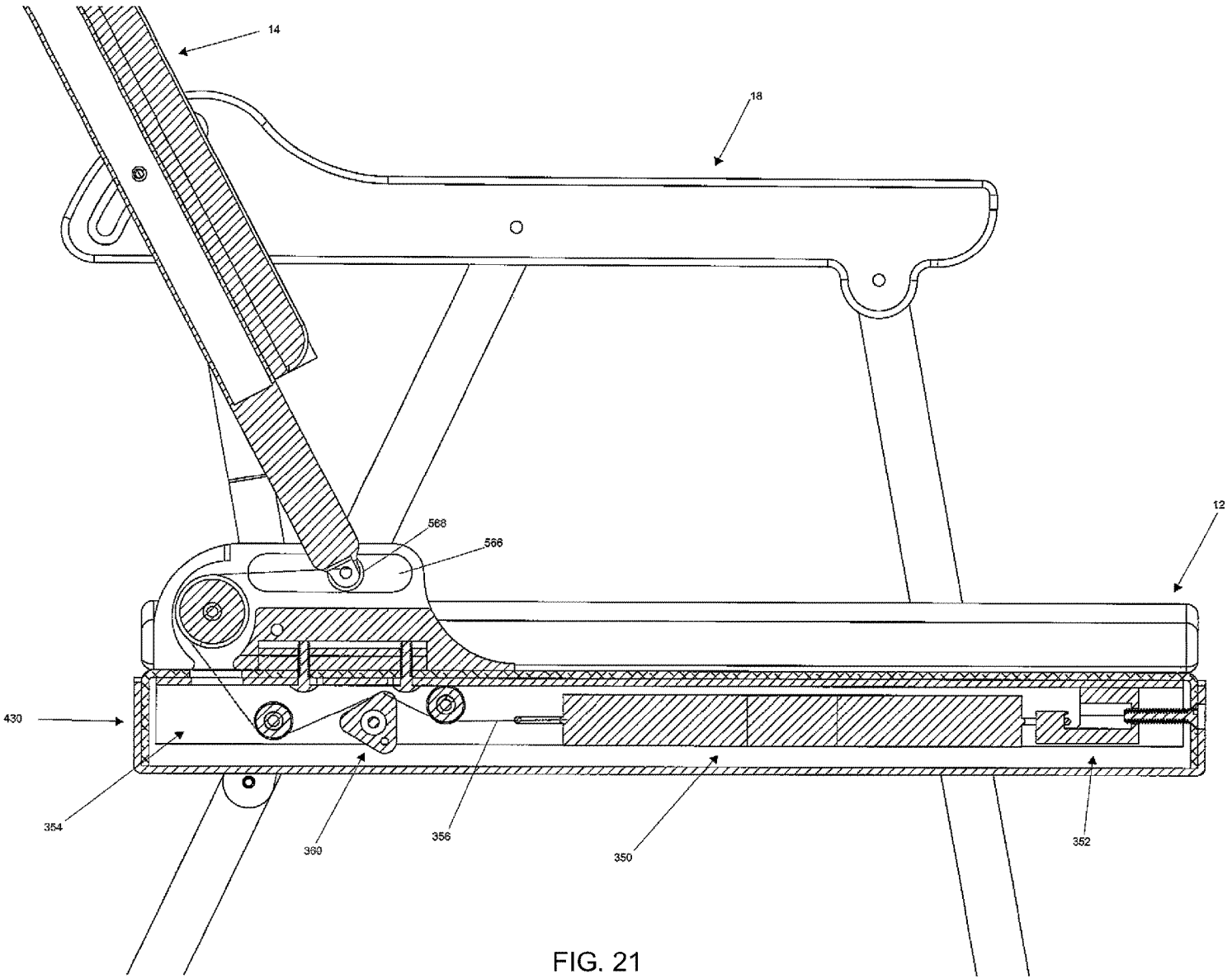
FIG. 21 is a side elevation section view of the folding chair in accordance with one or more arrangements, the view showing the folding chair having a seat assembly, a backrest, and an armrest assembly; the view also showing a counterbalance assembly and counterbalance housings, a pulley assembly, a cam, a first cable, a biasing member, a tensioner assembly; the view also showing a lower guide assembly with a guide member and a slotted track; the view showing the folding chair in a partially reclined position.
Figure 22:
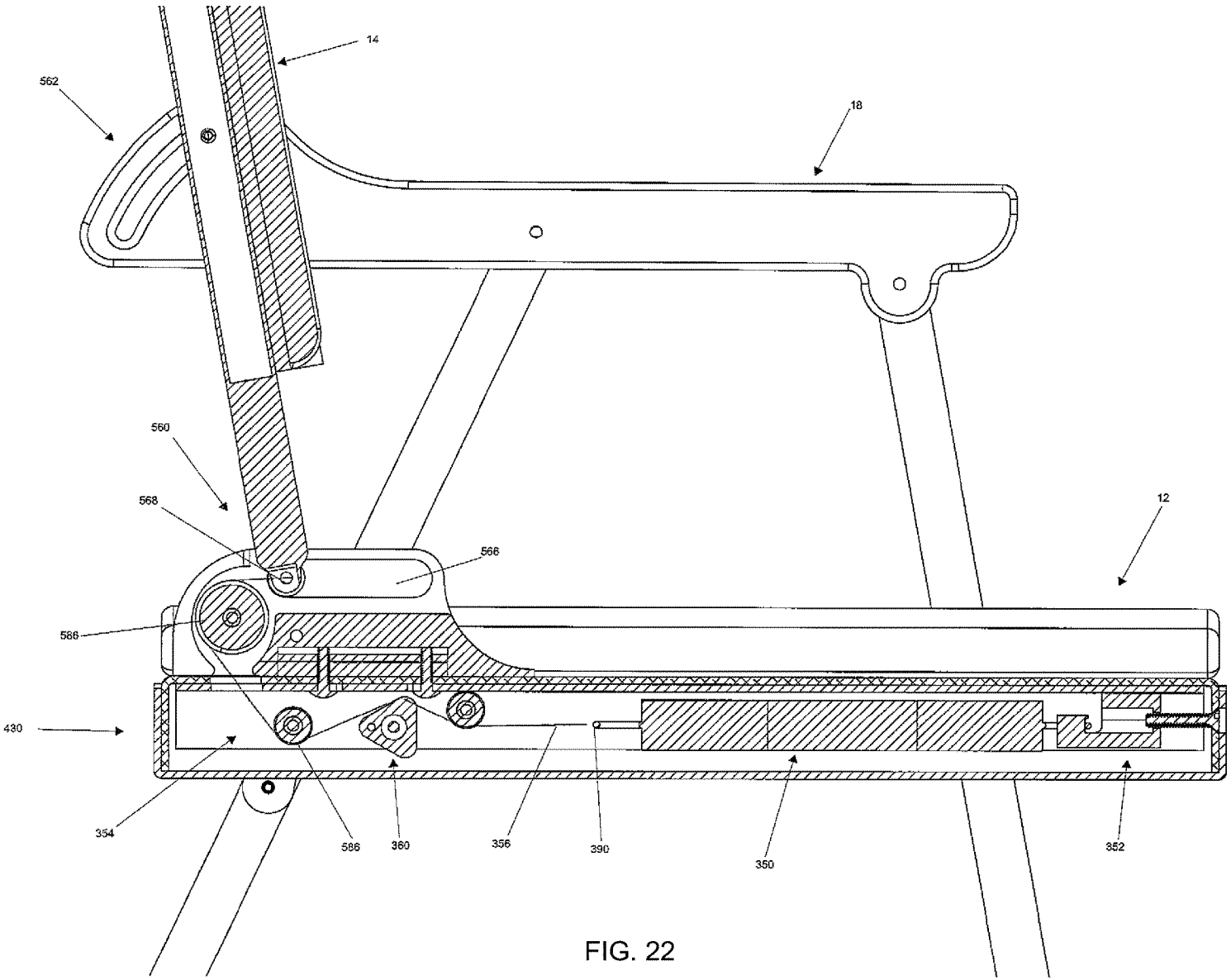
FIG. 22 is a side elevation section view of the folding chair in accordance with one or more arrangements, the view showing the folding chair having a seat assembly, a backrest, and an armrest assembly; the view also showing a counterbalance assembly and counterbalance housings, a pulley assembly with pulleys, a cam, a first cable, a biasing member, a tensioner assembly, the view also showing an upper guide assembly as well as a lower guide assembly with a guide member and a slotted track; the view showing the folding chair in an upright position.
Figure 23:
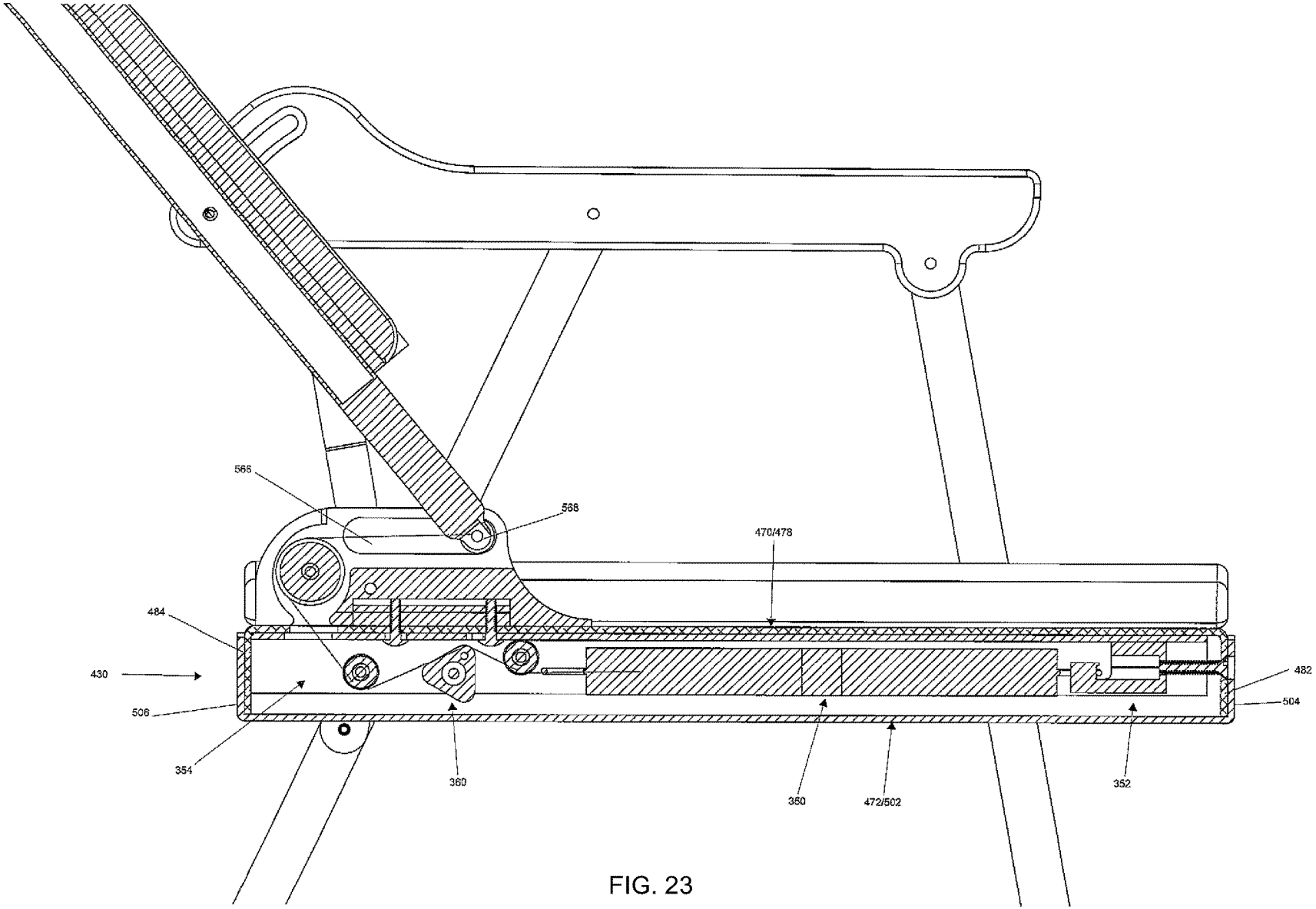
FIG. 23 is a side elevation section view of the folding chair in accordance with one or more arrangements, the view showing the folding chair having a seat assembly, a backrest, and an armrest assembly; the view also showing a counterbalance assembly and counterbalance housings with an upper bracket and a lower cover, a pulley assembly, a cam, a first cable, a biasing member, a tensioner assembly; the view also showing a lower guide assembly with a guide member and a slotted track; the view showing the folding chair in a reclined position.
Figure 24:
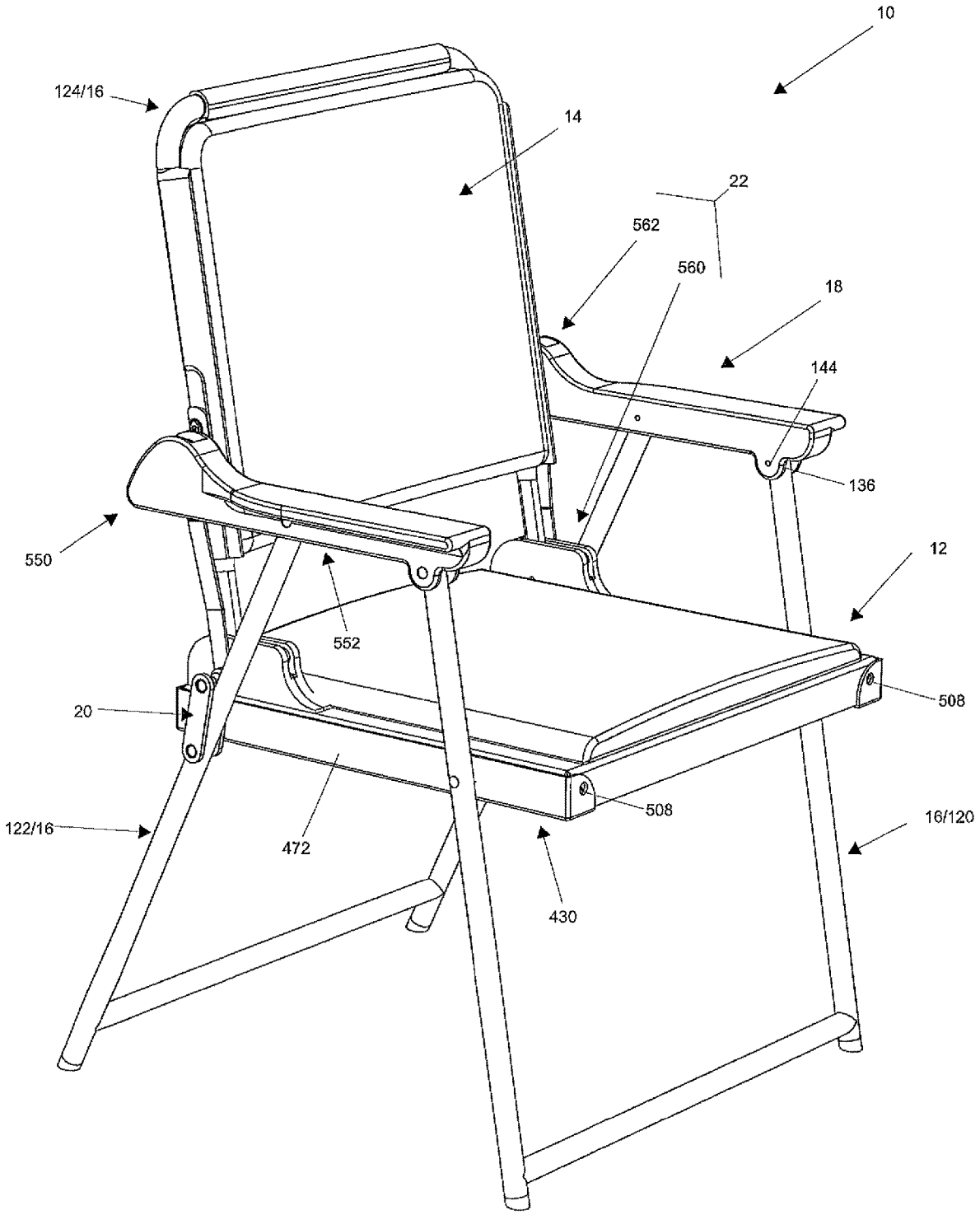
FIG. 24 is a perspective view of the folding chair in accordance with one or more arrangements, the view showing the folding chair having a seat assembly, a backrest, a frame assembly, an armrest assembly, a lock assembly, and a reclining mechanism.
Figure 25:
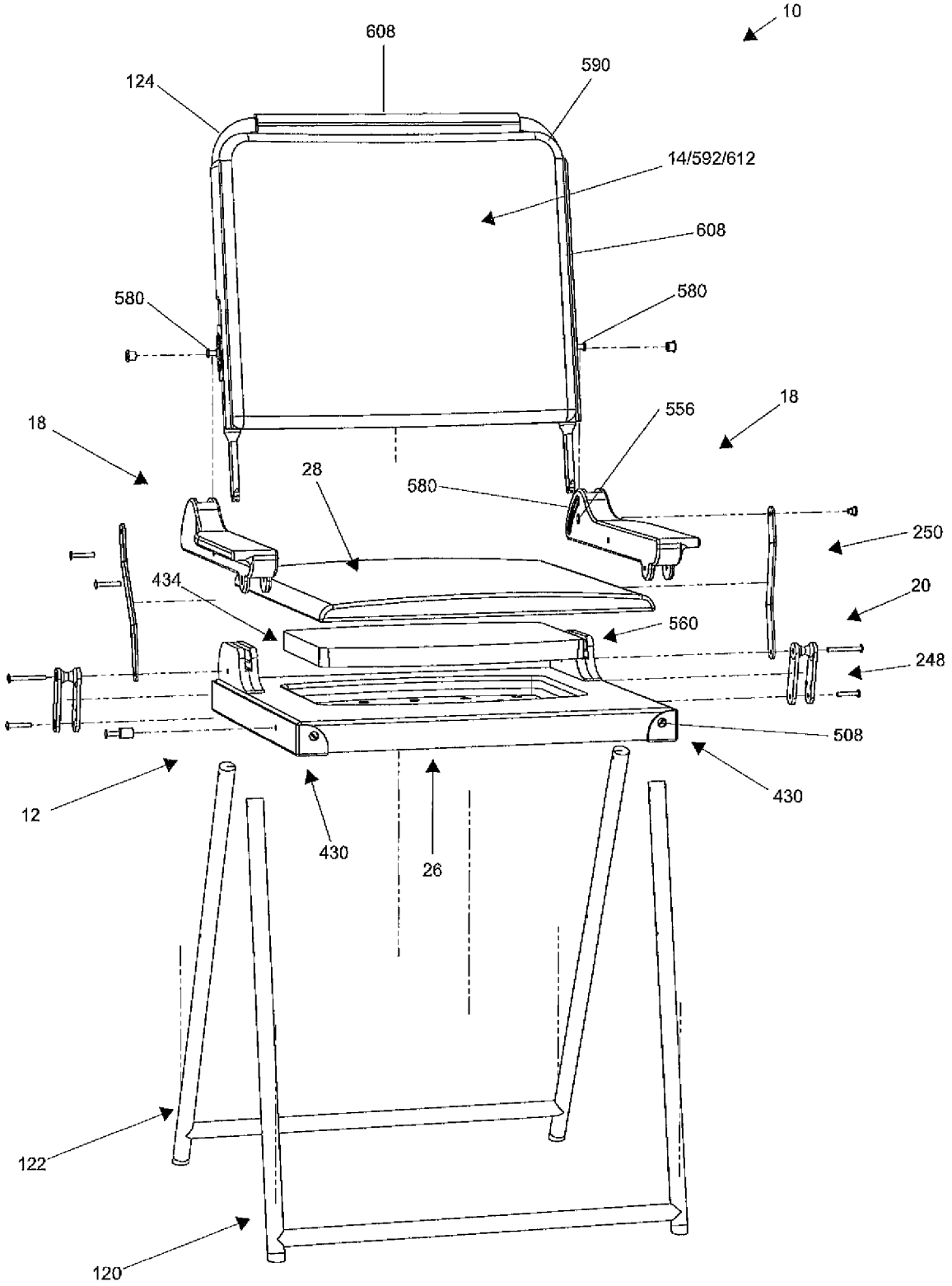
FIG. 25 is a perspective exploded view of the folding chair, the view showing various components of the folding chair in accordance with one or more arrangements.
Figure 26:
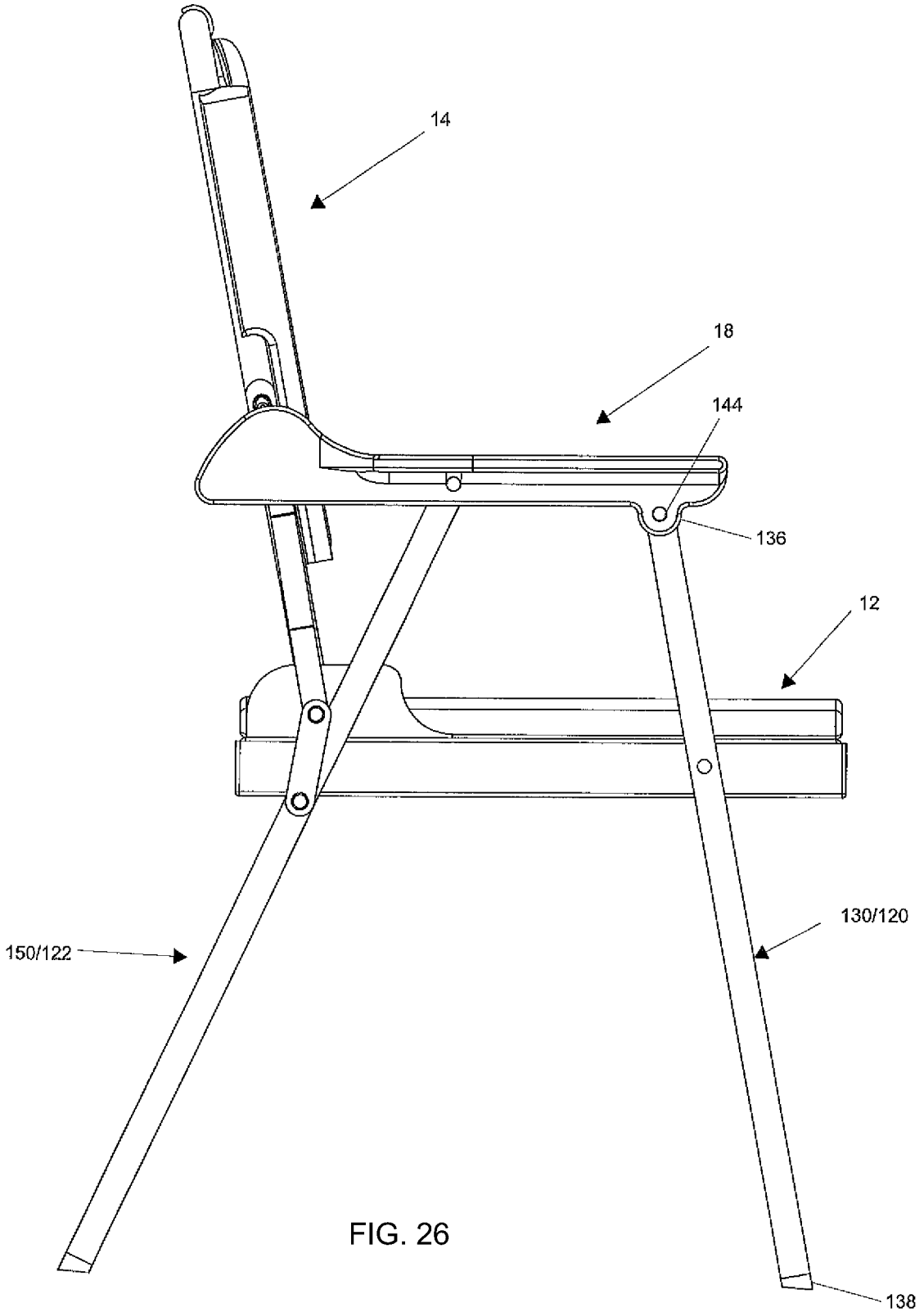
FIG. 26 is a side elevation view of the folding chair in accordance with one or more arrangements, the view showing the folding chair having a seat assembly, a backrest, a front leg section and a rear leg section, and an armrest assembly.
Figure 27:
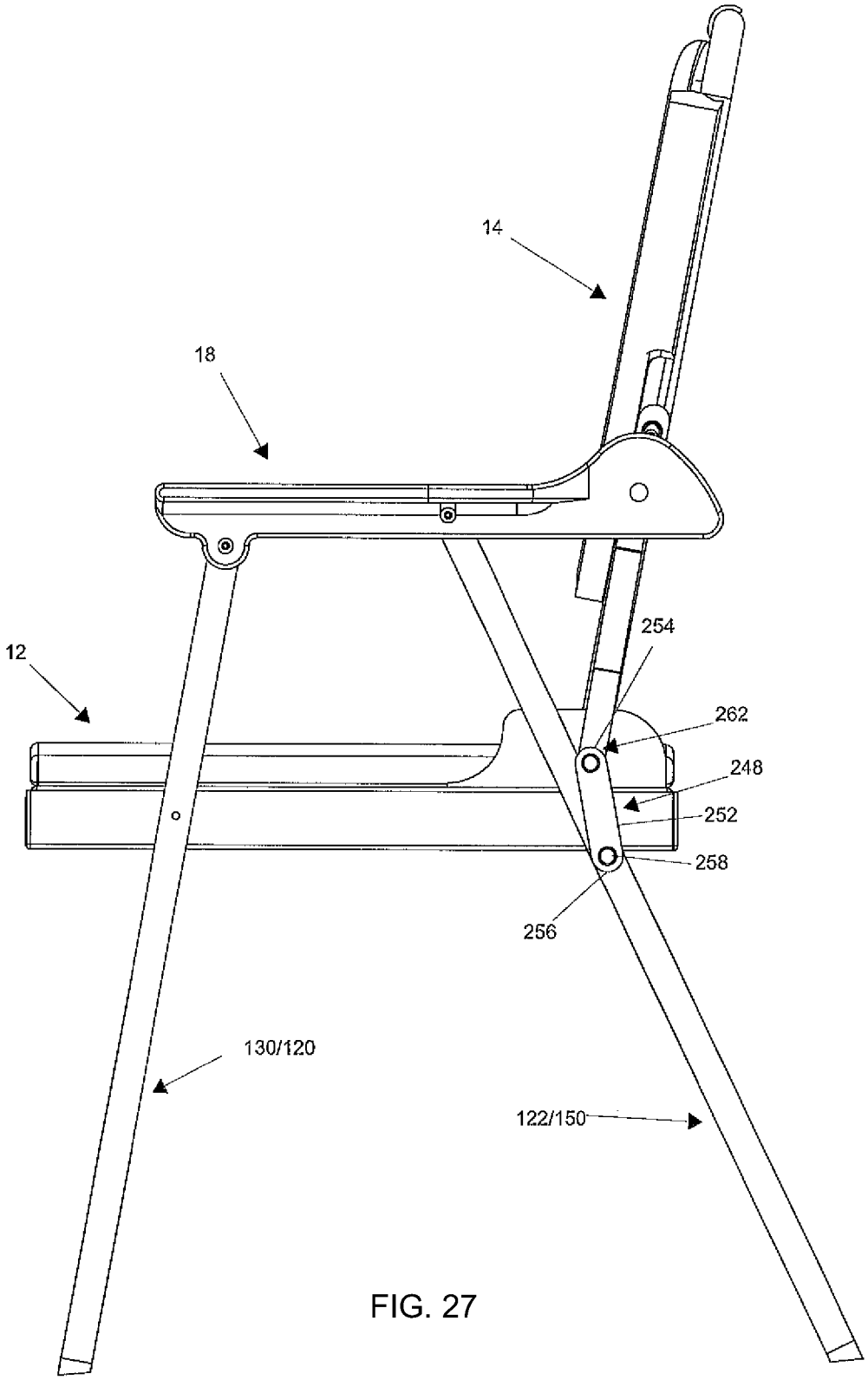
FIG. 27 is another side elevation view of the folding chair in accordance with one or more arrangements, the view showing the folding chair having a seat assembly, a backrest, a front leg section and a rear leg section, and an armrest assembly; the view also showing the folding chair having a lock assembly having a lower link, arms, and a stop member.
Figure 28:
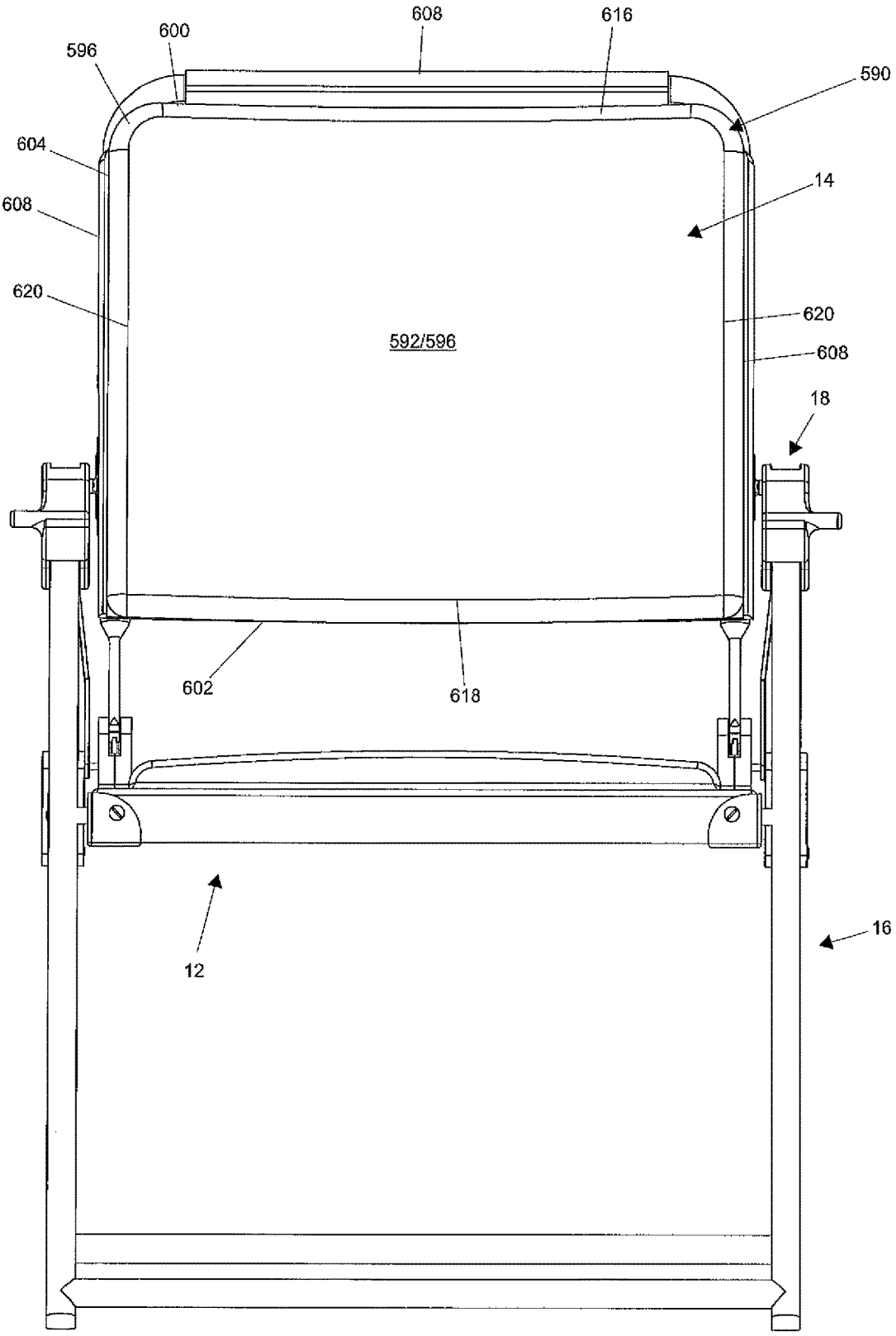
FIG. 28 is a front elevation view of the folding chair in accordance with one or more arrangements, the view showing the folding chair having a seat assembly, a frame assembly, and an armrest assembly; the view also showing the folding chair having a backrest having a cushion, a bracket support having connection members, and a backrest support.
Figure 29:
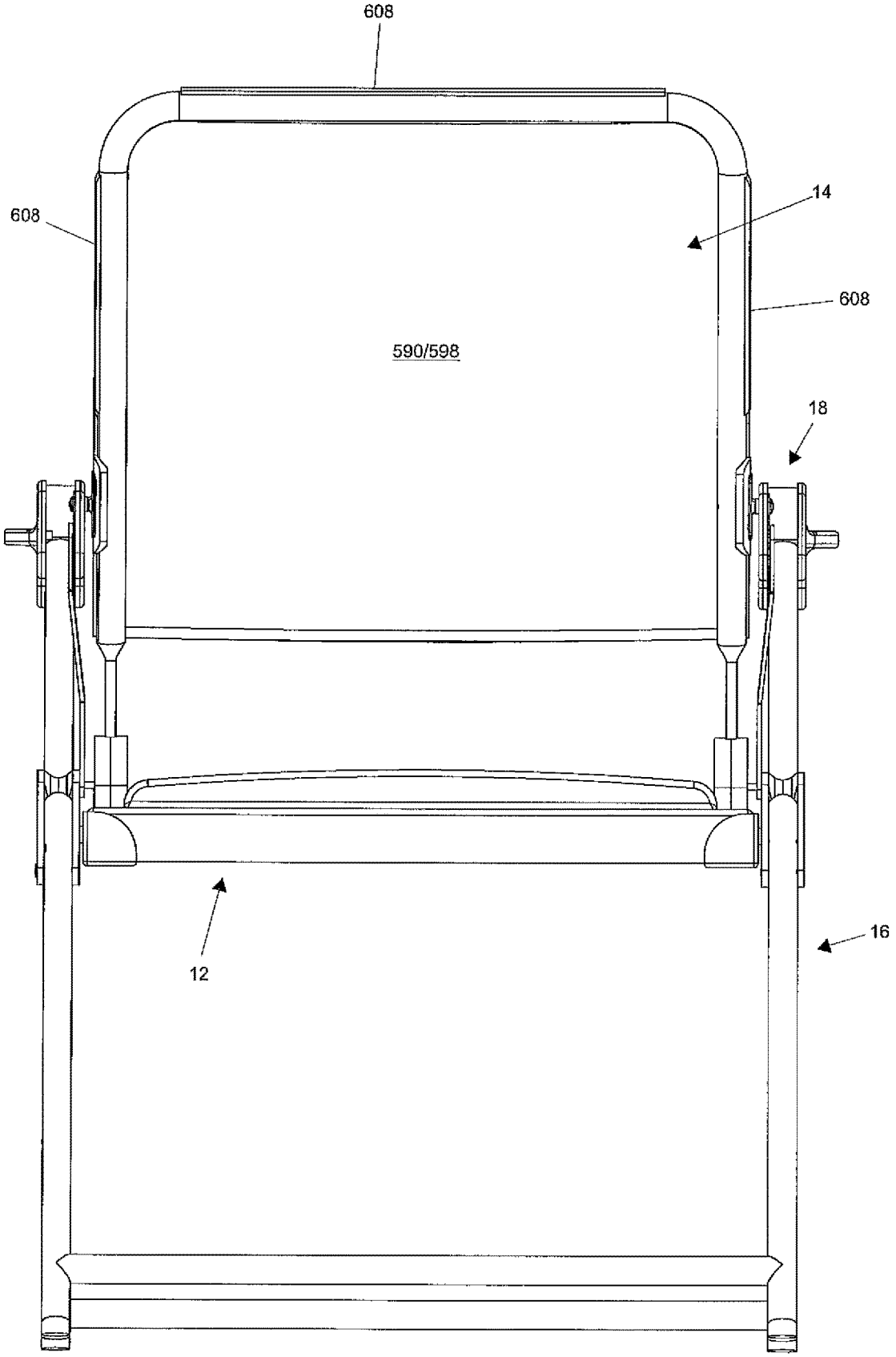
FIG. 29 is a back elevation view of the folding chair in accordance with one or more arrangements, the view showing the folding chair having a seat assembly, a frame assembly, and an armrest assembly; the view also showing the folding chair having a backrest with a backrest support having connection members and a cushion.
Figure 30:
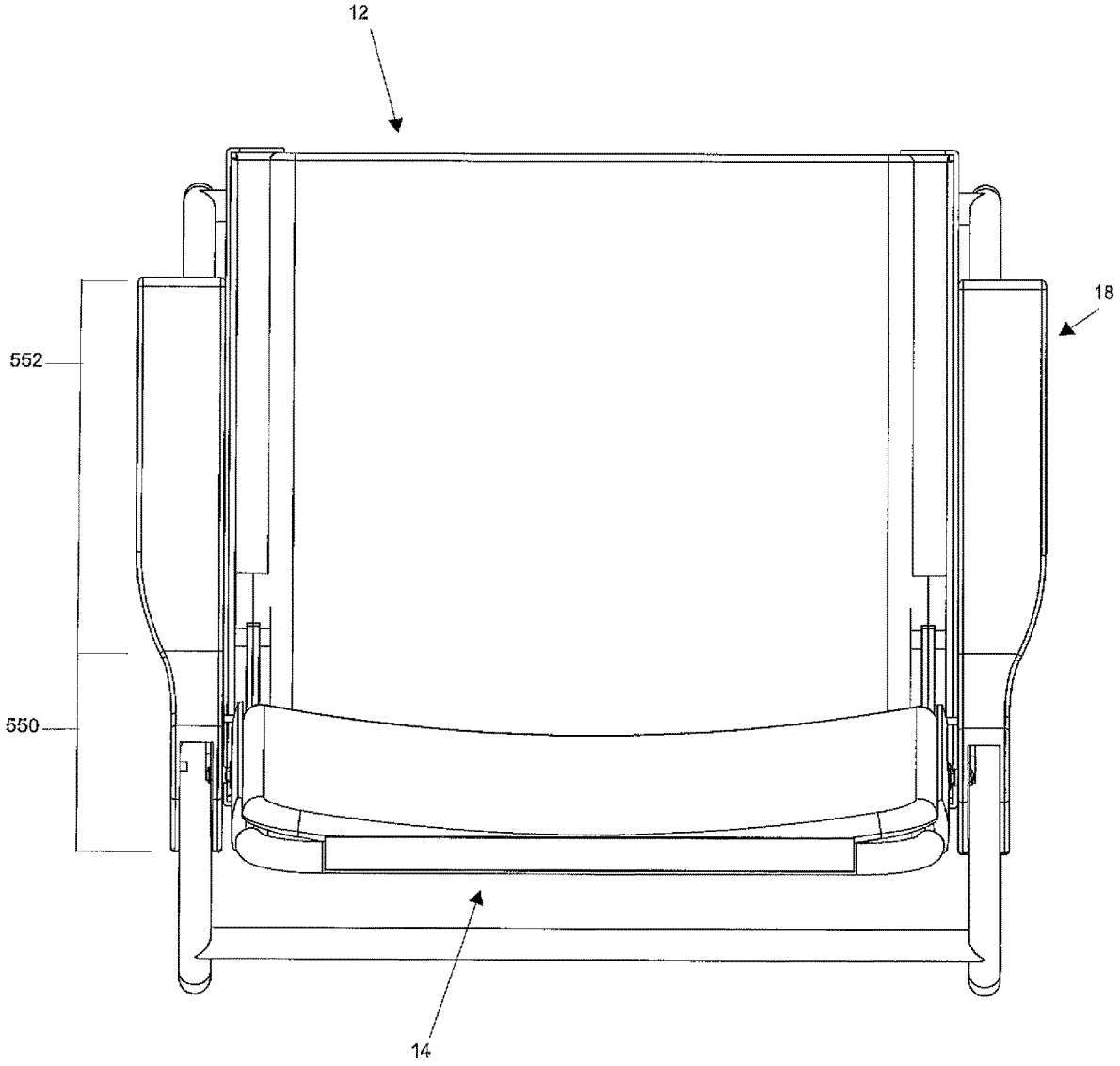
FIG. 30 is a top elevation view of the folding chair in accordance with one or more arrangements, the view showing the folding chair having a seat assembly, a backrest, an armrest assembly with a rear portion and a front portion.
Figure 31:
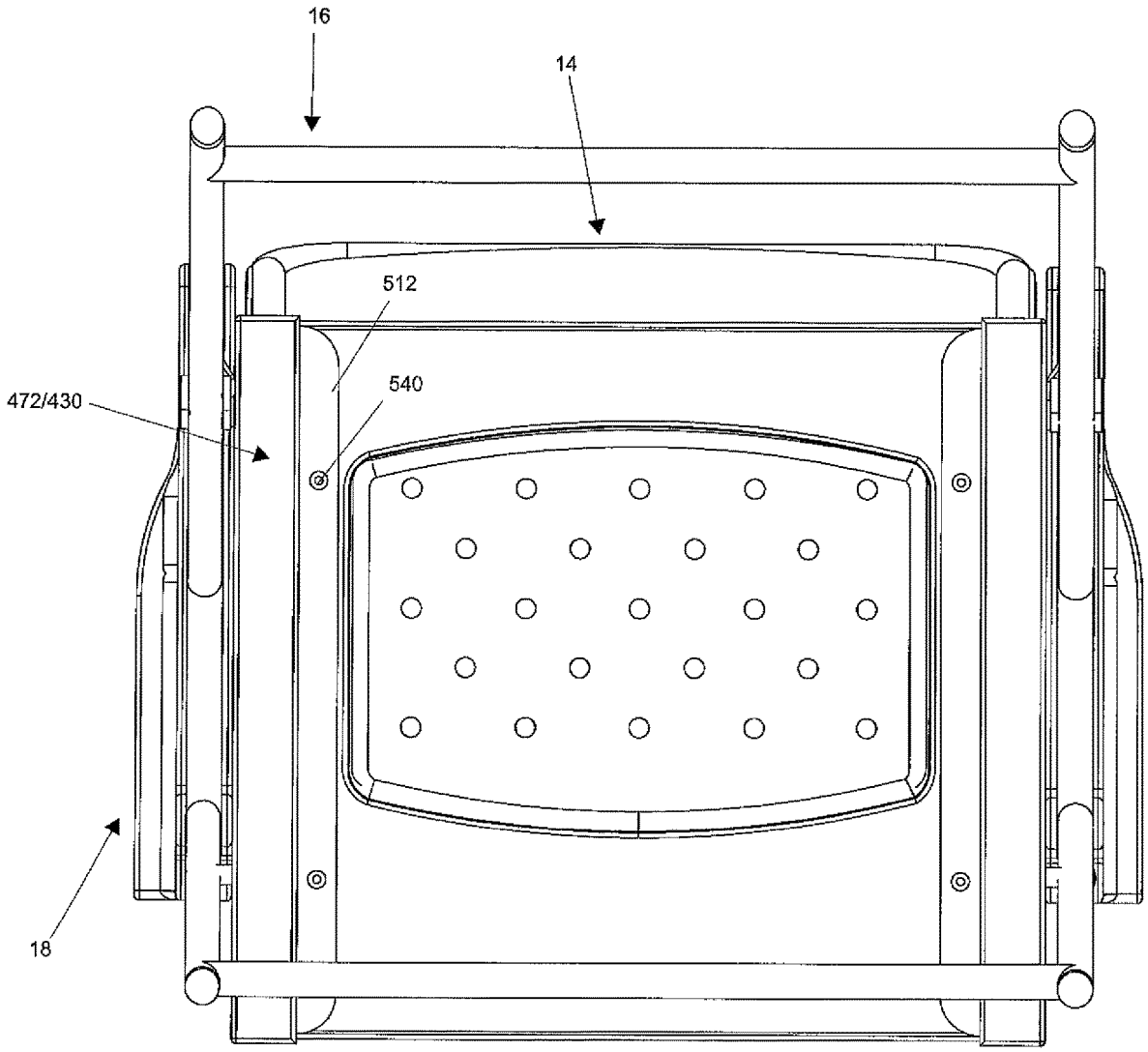
FIG. 31 is a bottom elevation view of the folding chair in accordance with one or more arrangements, the view showing the folding chair having a backrest, a frame assembly, and an armrest assembly.
Figure 32:
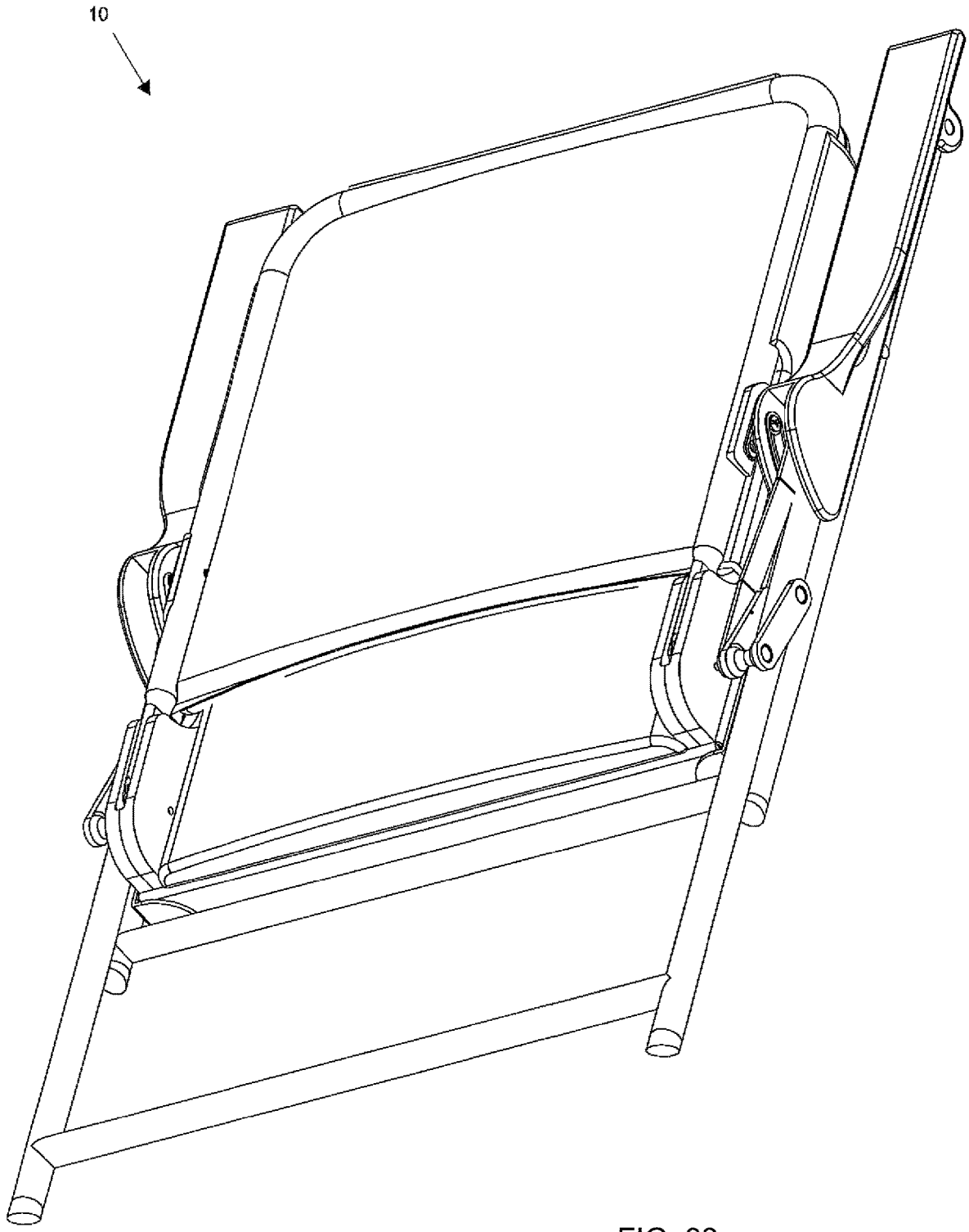
FIG. 32 is a perspective view of the folding chair in accordance with one or more arrangements, the view showing the folding chair in a folded position.
Figure 33:
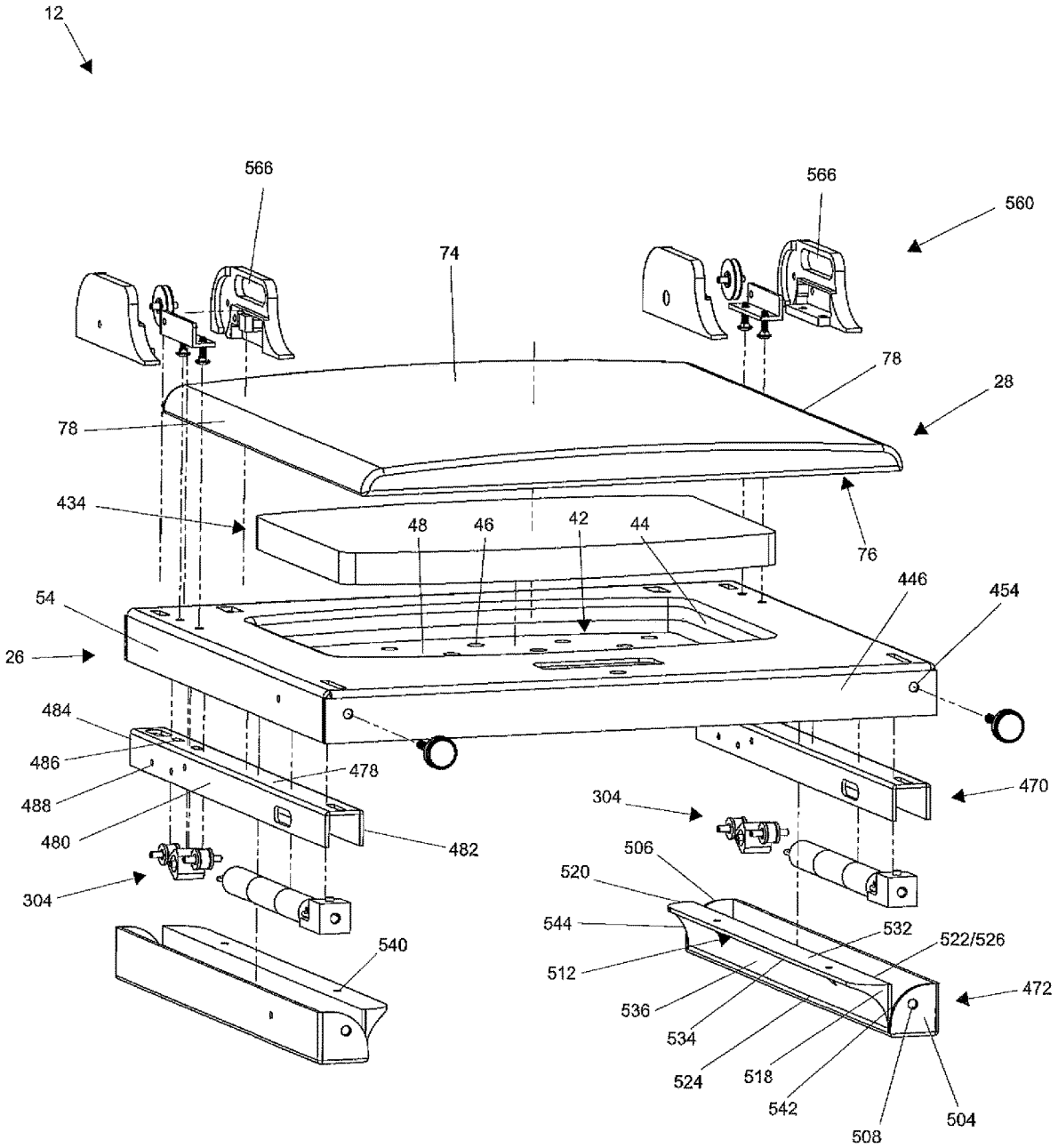
FIG. 33 is a perspective exploded view of the seat assembly, the view showing components of the seat assembly in accordance with one or more arrangements.
Figure 34:
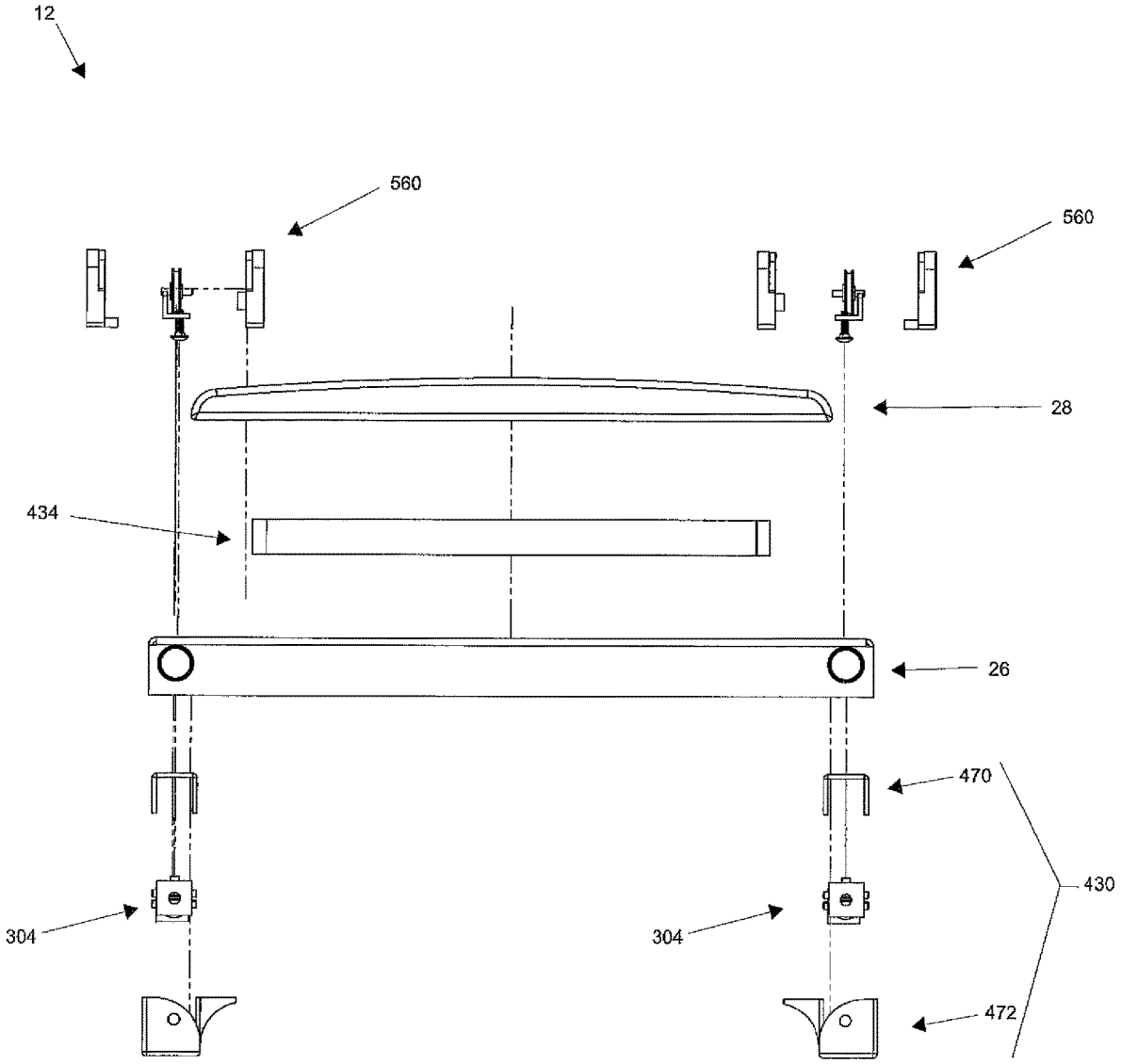
FIG. 34 is a front exploded view of the seat assembly, the view showing components of the seat assembly in accordance with one or more arrangements.
Figure 35:
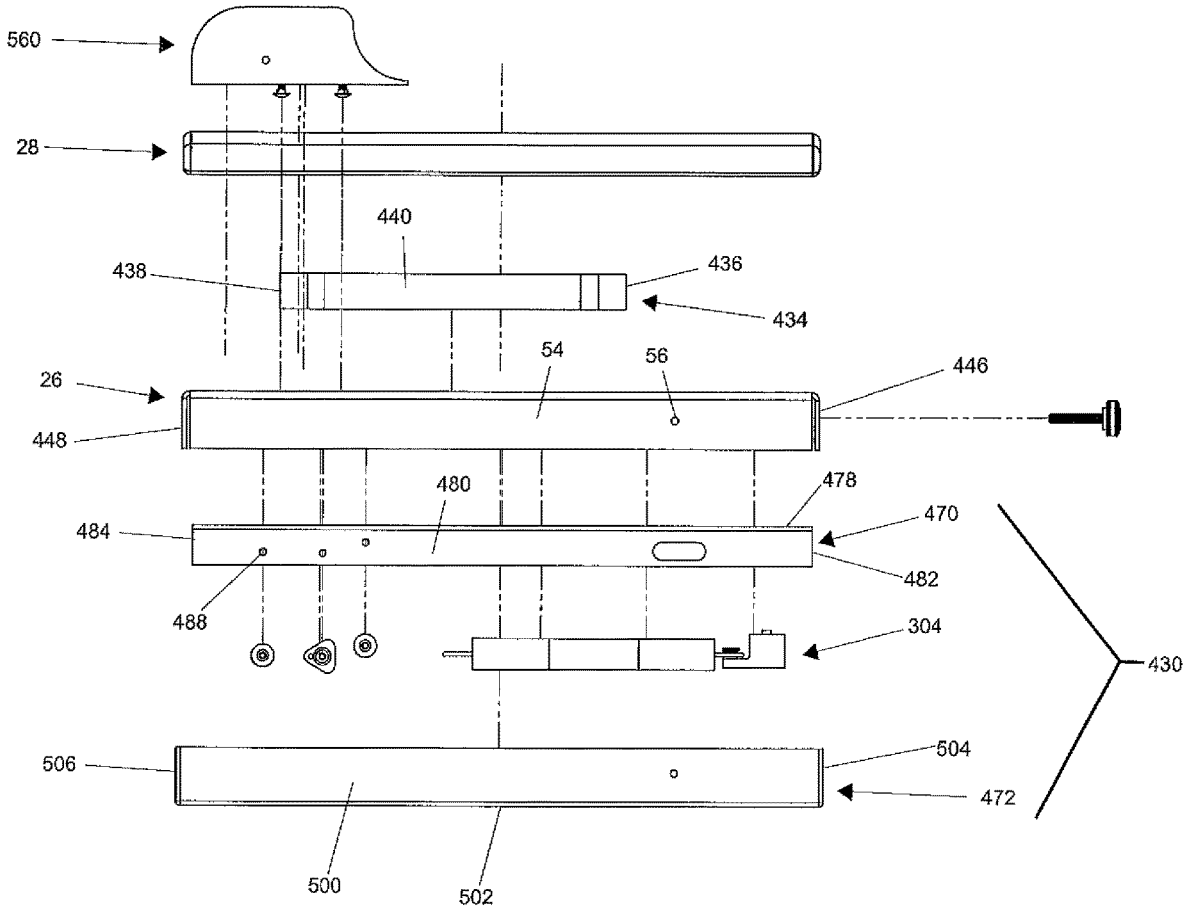
FIG. 35 is a side exploded view of the seat assembly, the view showing components of the seat assembly in accordance with one or more arrangements.

With reference to FIGS. 20-30 an alternative arrangement of seating system 10 is presented. The arrangement shown in FIGS. 20-35 is similar to the system 10 shown in FIGS. 1-19 and as such, the disclosure related to the embodiment shown in FIGS. 1-21 applies to the embodiment shown in FIGS. 20-35 unless stated specifically herein. The primary difference presented in the arrangements shown in FIGS. 20-35, relates to seat assembly 12, armrest assemblies 18, reclining mechanism 22, and backrest 14 of system 10. More specifically, in the arrangements shown in FIGS. 20-35, counterbalance assembly 304 of reclining mechanism 22 is positioned within seat assembly 12 instead of armrest 18.

Seat Assembly 12:

Seat assembly 12 is formed of any suitable size, shape, and/or design and is configured to provide a surface for seating of an occupant thereupon. In the arrangement shown, as one example, seat assembly 12 includes a support assembly 26, a cushion 28, and counterbalance housings 430, among other components. In this example arrangement, support assembly 26 is configured to operably connect with frame assembly 16 and reclining mechanism 22, support cushion 28 on a top 30 of support assembly 26. Counterbalance housings 430 are configured to connect with support assembly 26 and house counterbalance assembly 304.

Support Assembly 26:

Support assembly 26 is formed of any suitable size, shape, and/or design and is configured to provide a surface for seating of an occupant thereupon. In the arrangement shown, as one example, support assembly 26 has a generally rectangular planar shaped top 30 and a bottom 32 extending between a front edge 34, a back edge 36, and opposing side edges 38. In this example arrangement, support assembly 26 has an outer portion 40 positioned in an upper plane and a center indent 42, in which support assembly 26 extends downward to a bottom wall 48 positioned in a lower plane. In this example arrangement, center indent 42 has sidewalls 44 that extend downward to bottom wall 48. In this example arrangement, center indent 42 includes holes 46 in bottom wall 48 to facilitate draining of liquids (e.g., rainwater) from center indent 42.

Center indent 42 forms a recess in an upper surface of support assembly 26 to provide additional give to accommodate an occupant. Center indent 42 also provides structural rigidity to support assembly 26. In this example arrangement, connection features 50 for connection of webbing (not shown) to outer portion 40 are omitted. Rather, in this example arrangement, support assembly 26 is configured to hold a foam insert 434 within center indent 42. Foam insert 434 is formed of any suitable size, shape, and/or design, and is configured to provide a strong seating base while providing some give to provide a more comfortable seating surface for an occupant. In the arrangement shown, as one example, foam insert 434 has a generally planar rectangular shape extending between a front edge 436, a rear edge 438, and opposing side edges 440. However, embodiments are not so limited. Rather, it is contemplated that, in some various embodiments, foam insert 434 and center indent 42 may be adapted to have various other shapes. It is also contemplated that arrangements may be adapted to use webbing, foam inserts, and/or any other means and/or method for providing support for a seat.

In the arrangement shown, support assembly 26 includes a front flange 446 extending downward from front edge 34 of support assembly 26 and includes a rear flange 448 extending downward from back edge 36 of support assembly 26. Front flange 446 and rear flange 448 provide additional rigidity to support assembly 26 and also help conceal counterbalance housings 430 and counterbalance assembly 304. However, the embodiments are not so limited. Rather, it is contemplated that in one or more arrangements front flange 446 and/or rear flange 448 may be omitted.

In this example arrangement, support assembly 26 includes flanges extending downward from opposing side edges 38 to form connection members 54. In one or more arrangements, connection members 54 are configured to engage frame assembly 16 in a manner to hold seat assembly 12 in place on the frame. In this example arrangement, connection members 54 include holes 56 to facilitate a hinged connection of connection members 54 of seat assembly 12 to front legs 130 of frame assembly 16 (e.g., by a fastener extending through the holes 56 and holes 144 of front legs 130).

In this example arrangement, support assembly 26 also includes holes (not shown) in top 30, positioned proximate to side edges 38 toward the back edge 36, to facilitate connection of support assembly 26 with lower guide assembly 560 of reclining mechanism 22.

In this example arrangement, support assembly 26 also has holes 454 in front flange 446 to provide access for adjustment of counterbalance assembly 304 of reclining mechanism 22, which is positioned within counterbalance housings 430 positioned under support assembly 26 behind front flange 446.

In the arrangement shown, support assembly 26 is formed as a single unitary member. For example, in one or more arrangements, support assembly 26 may be stamped from a single sheet of metal (e.g., 0.075 inch steel) to facilitate easy, fast, and lower cost manufacture of support assembly 26. However, the embodiments are not so limited. Rather, it is contemplated that in various arrangements, support assembly 26 may be formed of various natural and/or synthetic materials including but not limited to metals, woods, plastics, rubbers composites, laminins, of any other material. Moreover, it is further contemplated that in various arrangements, support assembly 26 may be formed of multiple component pieces that are connected together.

Counterbalance Housings 430:

Counterbalance housings 430 are formed of any suitable size, shape, and/or design and are configured to house counterbalance assembly 304 of reclining mechanism 22 and facilitate connection between support assembly 26 and counterbalance assembly 304. In the arrangement shown, as one example, each counterbalance housings 430 includes an upper bracket 470 and a lower cover 472.

Upper bracket 470 is formed of any suitable size, shape, and/or design and is configured to connect a counterbalance assembly 304 with support assembly 26. In the arrangement shown, as one example, upper bracket 470 is an elongated c-shaped bracket having a top wall 478 and opposing side walls 480 extending from a forward end 482 to a rearward end 484. In this example arrangement, top wall 478 has holes 486 to facilitate connection of upper bracket 470 to bottom 32 of support assembly 26 proximate to side edges 38 (e.g., using fasteners). In this example arrangement, side walls 480 have holes 488 to facilitate connection with various components of counterbalance assembly 304 that are positioned between side walls 480 of upper bracket 470 (e.g., using fasteners).

Although the arrangements shown are primarily described as having upper bracket 470 connected to support assembly 26 and components of counterbalance assembly 304 using fasteners, the embodiments are not so limited. Rather, it is contemplated that in one or more arrangements, upper bracket 470 may be connected to support assembly 26 and/or components of counterbalance assembly 304 using various methods and/or means including but not limited to, for example, screws, bolts, clamps, pins, rivets, welding, snap connectors, interconnects (e.g., slide connectors, rotational connectors, and/or any other type of interconnect), friction fit connectors, adhesives, chemical bonding, and/or any other process and/or means that results in a permanent or semi-permanent connection.

Lower cover 472 is formed of any suitable size, shape, and/or design and is configured to connect with upper bracket 470 to form an enclosure with upper bracket 470 that houses counterbalance assembly 304.

In the arrangement shown, as one example, lower cover 472 includes an elongated L-shape bar having an outer side wall 500 and a bottom wall 502 extending between a forward end wall 504 and a rearward end wall 506. In this example arrangement, forward end wall 504 and rearward end wall 506 have the shape of 90-degree circular sectors extending across and between bottom wall 502 and outer side wall 500. In this example arrangement, forward end wall 504 has a hole 508 that is aligned with one of the holes 454 in front flange 446 of support assembly 26 to provide access for adjustment of counterbalance assembly 304 of reclining mechanism 22, which is located within counterbalance housings 430.

In this example arrangement, lower cover 472 also includes connection member 512 connected to an inner edge of bottom wall 502 of lower cover 472. Connection member 512 is formed of any suitable size, shape, and/or design, and is configured to facilitate operably connection of lower cover 472 to support assembly 26 and/or upper bracket 470 and operate as an inner side wall of lower cover 472. In the arrangement shown, as one example, connection member 512 has an elongated shape extending from a forward end 518 to a rearward end 520. In this example arrangement, connection member 512 has a generally rectangular shaped planar outward facing side surface 522 extending between forward end 518, rearward end 520, a lower edge 524, and an upper edge 526. In this example arrangement, connection member 512 has a generally rectangular planar top surface 532 extending between forward end 518, rearward end 520, upper edge 526, and an inward edge 534. In this example arrangement, connection member 512 has a concave curved inward facing side surface 536 extending from inward edge 534 of top surface 532 to lower edge 524 of outward facing side surface 522.

In this example arrangement, connection member 512, has holes 540 extending upward through connection member 512 to facilitate connection with support assembly 26. In this example arrangement, forward end 518 of connection member 512 is positioned slightly back from forward end wall 504 so as to provide a front gap 542 sufficient to permit front flange 446 of support assembly 26 to be positioned between forward end 518 of connection member 512 and forward end wall 504 of lower cover 472. Similarly, in this example arrangement, rearward end 520 of connection member 512 is positioned slightly forward of rearward end wall 506 so as to provide a rear gap (not shown) sufficient to permit rear flange 448 of support assembly 26 to be positioned between rearward end 520 of connection member 512 and rearward end wall 506 of lower cover 472.

Armrest Assemblies 18:

In the arrangement shown, system 10 includes armrest assemblies 18 connected to frame assembly 16. Armrest assemblies 18 are formed of any suitable size, shape, and/or design and is configured to provide comfortable arm rests for an occupant seated in seat assembly 12.

In the arrangement shown, as one example, armrest assemblies 18 each have a generally elongated rectangular shape having a top 200, a bottom 202, a front 206, a back 208, an inner side wall 212, and an outer side wall 214 forming a hollow interior 216.

In this example arrangement, each armrest assembly 18 has a pair of tabs 228 that extend downward from outer side wall 214 and inner side wall 212. In this example arrangement, tabs 228 include holes 230 to facilitate a hinged connection with holes 144 at upper ends 136 of front legs 130.

In the example arrangement, armrest assemblies 18 have an open bottom 202 between inner side wall 212, and outer side wall 214, thereby permitting a portion of front legs 130 to be received within hollow interior 216 when system 10 is folded.

In this example arrangement, each armrest assembly 18 had a narrower rear portion 550 and a wider front portion 552. In this example arrangement, top 200 in the rear portion 550 has a width extending between inner side wall 212 and outer side wall 214. In this example arrangement, front portion 552 of top 200 extends outward beyond outer side wall 214 to provide a wider surface to serve as an armrest.

In the arrangement shown, as one example, each armrest assembly 18 includes a connection assembly 238 positioned in rear potion 550. Connection assembly 238 is formed of any suitable size, shape, and/or design and is configured to connect with backrest 14, over lock assembly 20, and reclining mechanism 22, and facilitate reclining of backrest 14 as well as folding and unfolding of system 10. In the arrangement shown, as one example, top 200 and upper edges of inner side wall 212 and outer side wall 214 curve upward in rear portion 550.

In this example arrangement, connection assembly 238 includes a hole 556 in an upper portion of inner side wall 212 to facilitate a hinged connection with lock assembly 20. In this example arrangement, connection assembly 238 includes a slotted track 242 in inner side wall 212, which facilitates connection with guide members 580 attached to upper set of holes 184 of side bars 166 of back section 124 of frame assembly 16, and which forms part of reclining mechanism 22.

Reclining Mechanism 22:

Reclining mechanism 22 is formed of any suitable size, shape, and/or design and is configured to facilitate connection of backrest 14 with frame assembly 16 and facilitate movement of backrest 14 between up upright position and a reclined position. In the arrangement shown, as one example, reclining mechanism 22 is configured to recline backrest 14 by moving an upper end of backrest 14 (e.g., top edge 96) downward and rearward while also moving a lower end of backrest 14 (e.g., bottom edge 98) forward. In the arrangement shown, as one example, reclining mechanism 22 includes an upper guide assembly 562, a lower guide assembly 560, and a counterbalance assembly 304.

Lower Guide Assembly 560:

Lower guide assembly 560 is formed of any suitable size, shape, and/or design and is configured to connect with and guide a lower portion of backrest 14 forward along a defined path when backrest 14 is moved from an upright position to a reclined position. In the arrangement shown, as one example, lower guide assembly 560 includes slotted tracks 566 connected to top 30 of support assembly 26 of seat assembly 12 and a guide member 568 connected to the lower portion of backrest 14.

Upper Guide Assembly 562:

Upper guide assembly 562 is formed of any suitable size, shape, and/or design and is configured to connect with and guide an upper portion of backrest 14 along a designated path when backrest 14 is moved from an upright position to a reclined position. In the arrangement shown, as one example, upper guide assembly 562 includes a guide member 580 connected to upper set of holes 184 of back section 124 and positioned within slotted track 242. In this example arrangement, guide member 580 is configured to move within slotted track 242 from an upper end 332 of slotted track 242 to a lower end 334 of slotted track 242 of connection assembly 238 of armrest assemblies 18.

In operation, when backrest 14 is reclined, guide member 580 is moved rearward and downward along a curved path within slotted track 242 from upper end 332 to lower end 334, thereby moving an upper portion of backrest 14 rearward and downward. At the same time, guide member 568 of lower guide assembly 560 guide lower ends 174 of side bars 166 of frame assembly 16, which are connected to backrest 14, forward along slotted tracks 566 of lower guide assembly 560, thereby reclining backrest 14.

Counterbalance Assembly 304:

Counterbalance assembly 304 of the arrangements shown in FIGS. 20-35, is similar to the counterbalance assembly 304 described with reference to FIGS. 1-19 and includes biasing member 350, tensioner assembly 352, pulley assembly 354, first cable 356, and cam 360, with second cable 458 omitted.

In the arrangement shown, in FIGS. 20-35, counterbalance assembly 304 is positioned within counterbalance housings 430 of seat assembly 12. In this example arrangement, first cable 356 of counterbalance assembly 304 is operably connected to guide member 568 and a lower end of backrest 14 though a 1:1 pulley assembly 354 having two pulleys 586. In this example arrangement, first cable 356 is operably connected to guide member 568 of lower guide assembly 560 and applies a biasing force to pull guide members 568 rearward within slotted tracks 566 and thereby move backrest 14 to the upright position in absence of an opposing force.

In this example arrangement, tensioner assembly 352 is accessible through hole 508 in forward end wall 504 and hole 454 in front flange 446 of support assembly 26 to permit adjustment of counterbalance assembly 304 of reclining mechanism 22, as previously described.

Backrest 14:

The backrest 14 of the arrangements shown in FIGS. 20-35 is formed of any suitable size, shape, and/or design and is configured to provide a surface to provide backrest support for an occupant seated on seat assembly 12. In the arrangement shown, as one example, backrest 14 includes a backrest support 590 and a cushion 592 (not shown) among other components.

Backrest Support 590:

Backrest support 590 is formed of any suitable size, shape, and/or design and is configured to provide a backrest surface for an occupant seated on seat assembly 12. In the arrangement shown, as one example, backrest support 590 has a generally rectangular planar shape having a front surface 596 and a rear surface 598 extending between an upper edge 600, a lower edge 602, and opposing side edges 604.

In this example arrangement, backrest support 590 includes flanges extending outward from opposing side edges 604 and upper edge 600 to form connection members 608. In one or more arrangements, connection members 608 are configured to engage back section 124 of frame 16 in a manner to hold backrest 14 in place on the frame 16. In this example arrangement, connection members 608 curve rearward around side bars 166 and upper crossbar 170 of back section 124 of frame 16 to connect backrest support 590 with frame 16 by frictional fitting. Additionally or alternatively, in one or more arrangements, connection members 608 and back section 124 of frame 16 may include holes (not shown) to facilitate connection of connection members 608 of seat assembly 12 to frame 16, for example using bolts. However, embodiments are not so limited. Rather, it is contemplated that in various arrangements, connection members 608 may be attached to frame 16 using various methods and/or means including but not limited to, for example, screws, bolts, clamps, pins, rivets, welding, snap connectors, friction fit connectors, adhesives, chemical bonding, and/or any other process and/or means that results in a permanent or semi-permanent connection.

Cushion 592:

In the arrangement shown, backrest 14 includes a cushion 592 (not shown) connected to front surface 596 of backrest support 590. Cushion 592 is formed of any formed of any suitable size, shape, and/or design and is configured to provide a comfortable backrest support surface for an occupant of chair 10. In the arrangement shown, as one example, cushion 592 has a generally rectangular planar shape, when viewed from the front. In the arrangement shown, as one example, cushion 592 includes a front surface 612, a rear surface (not shown), a top edge 616, a bottom edge 618, and opposing side edges 620.

In this example arrangement, cushion 592 includes a foam core covered by upholstery material (not shown) on at least one side as discussed with reference to cushion 28. As described with reference to cushion 28, cushion 592 may be attached to backrest support 590 using various methods and/or means including but not limited to, for example, screws, bolts, clamps, pins, rivets, welding, snap connectors, friction fit connectors, stitching, hook and loop connectors, adhesives, chemical bonding, and/or any other process and/or means that results in a permanent of semi-permanent connection.

Reclining Operation:

In operation, in absence of an opposing force, biasing member 350 of counterbalance assembly 304 pulls first end 390 of first cable 356, which causes movable pulley assembly 354 and second cable 358 to pull guide member 568 and lower end of backrest 14 rearward to move backrest 14 to an upright position. As lower end of backrest 14 is pulled rearward, lower guide assembly 560 guides a lower end of backrest 14 rearward. At the same time, upper guide assembly 562 moves an upper end of backrest 14 upward and forward.

Conversely, when backrest 14 is reclined by a user, upper guide assembly 562 moves an upper end of backrest 14 downward and rearward and lower guide assembly 560 moves a lower end of backrest 14 forward. At the same time, counterbalance assembly 304, applies an opposing forward force to backrest 14 to provide comfortable support for an occupant. As backrest 14 is moved between upright and reclined positions, cam 360 may dynamically increase tension on first cable 356 and thereby increase the opposing forward force counterbalance assembly 304 applies to backrest 14 at one or more intermediate positions. In this manner, counterbalance assembly 304 assists a user in reclining at multiple fixed positions.

Alternative Arrangement(s)

Figure 36:
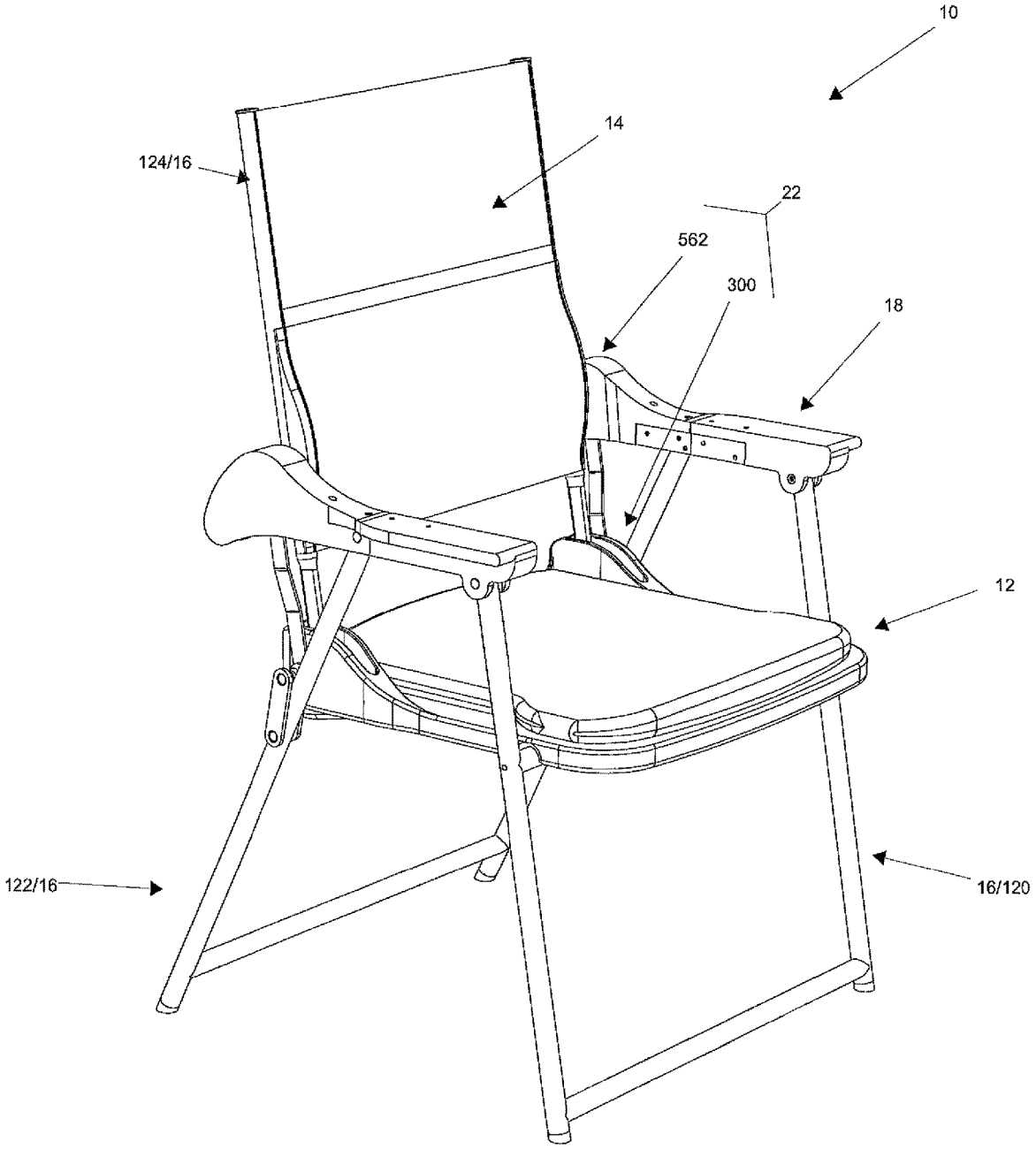
FIG. 36 is a perspective view of the folding chair in accordance with one or more arrangements, the view showing the folding chair having a seat assembly, a backrest, a frame assembly, an armrest assembly, and a reclining mechanism with a lower guide assembly and an upper guide assembly.
Figure 37:
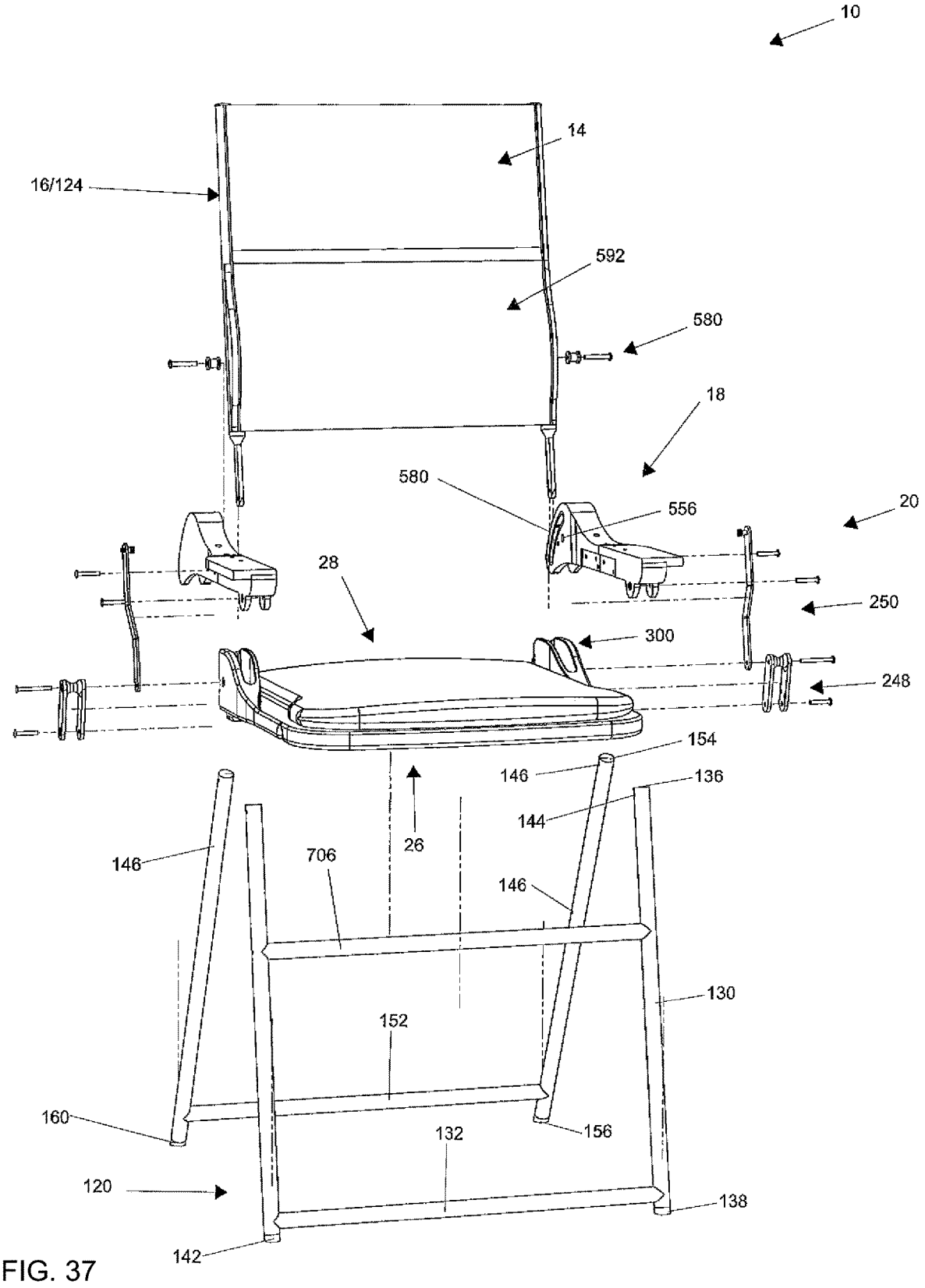
FIG. 37 is a perspective exploded view of the folding chair, the view showing various components of the folding chair in accordance with one or more arrangements.
Figure 38:
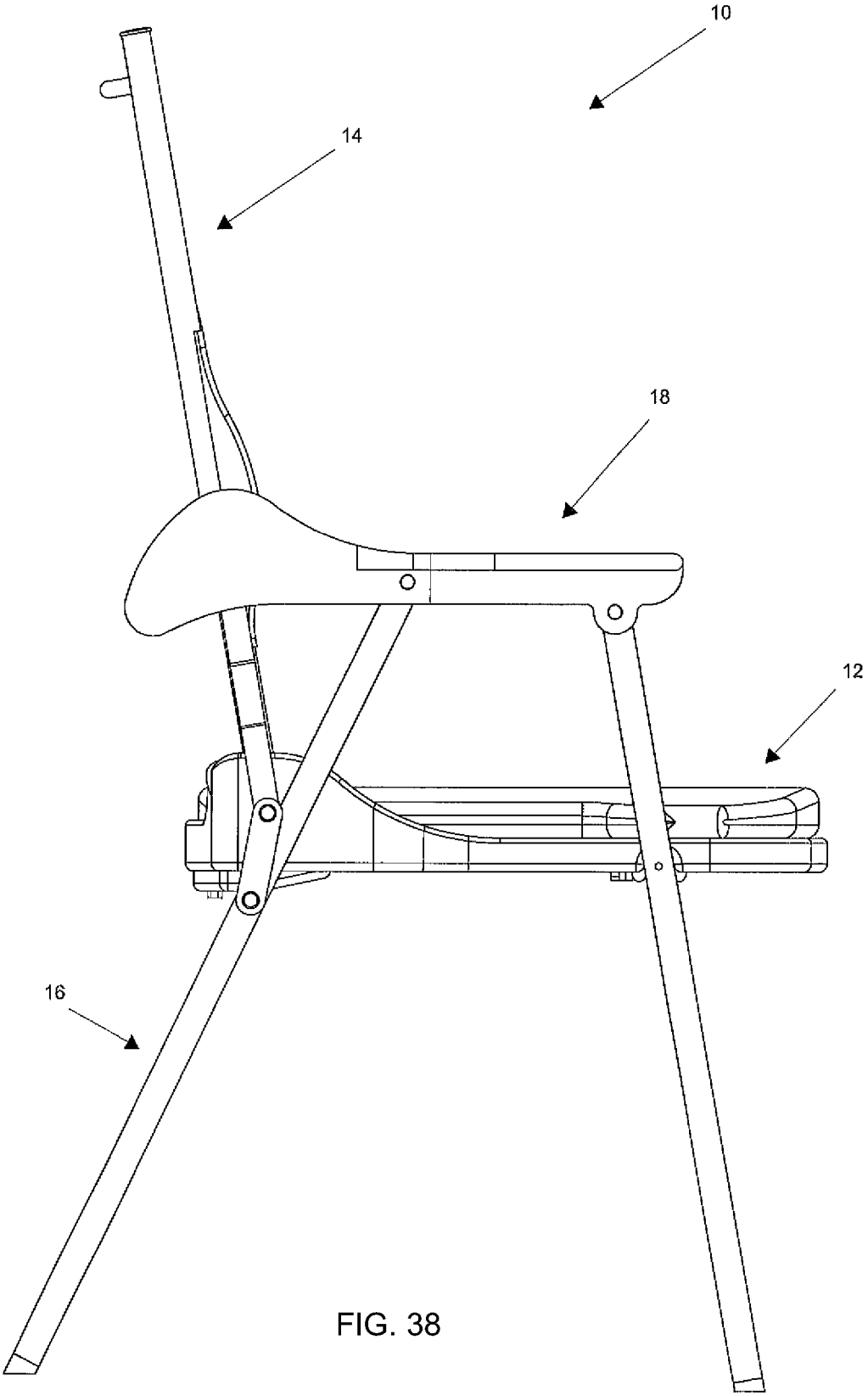
FIG. 38 is a side elevation view of the folding chair in accordance with one or more arrangements, the view showing the folding chair having a seat assembly, a backrest, a frame assembly, and an armrest assembly.
Figure 39:
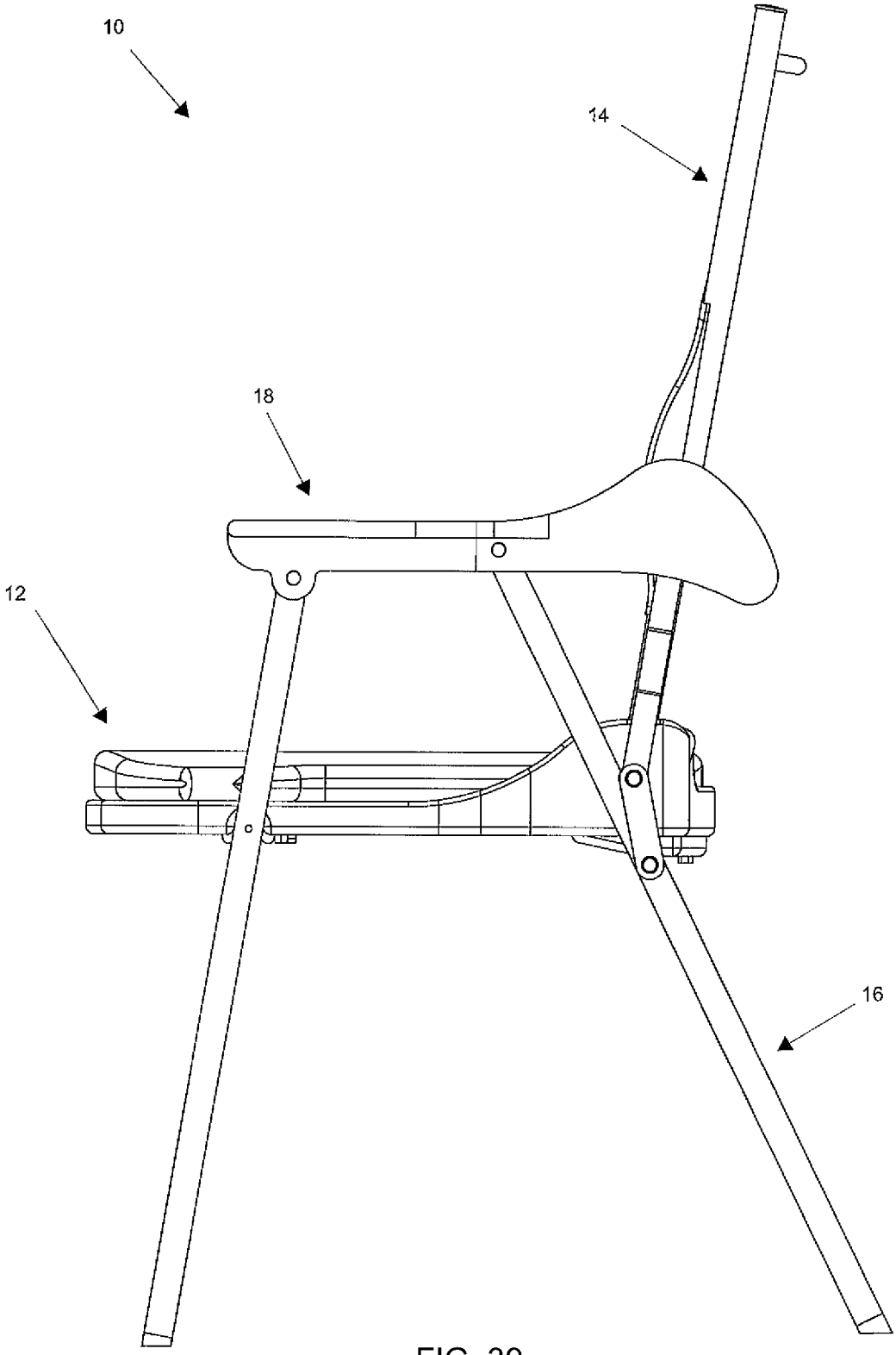
FIG. 39 is a side elevation view of the folding chair in accordance with one or more arrangements, the view showing the folding chair having a seat assembly, a backrest, a frame assembly, and an armrest assembly.
Figure 40:
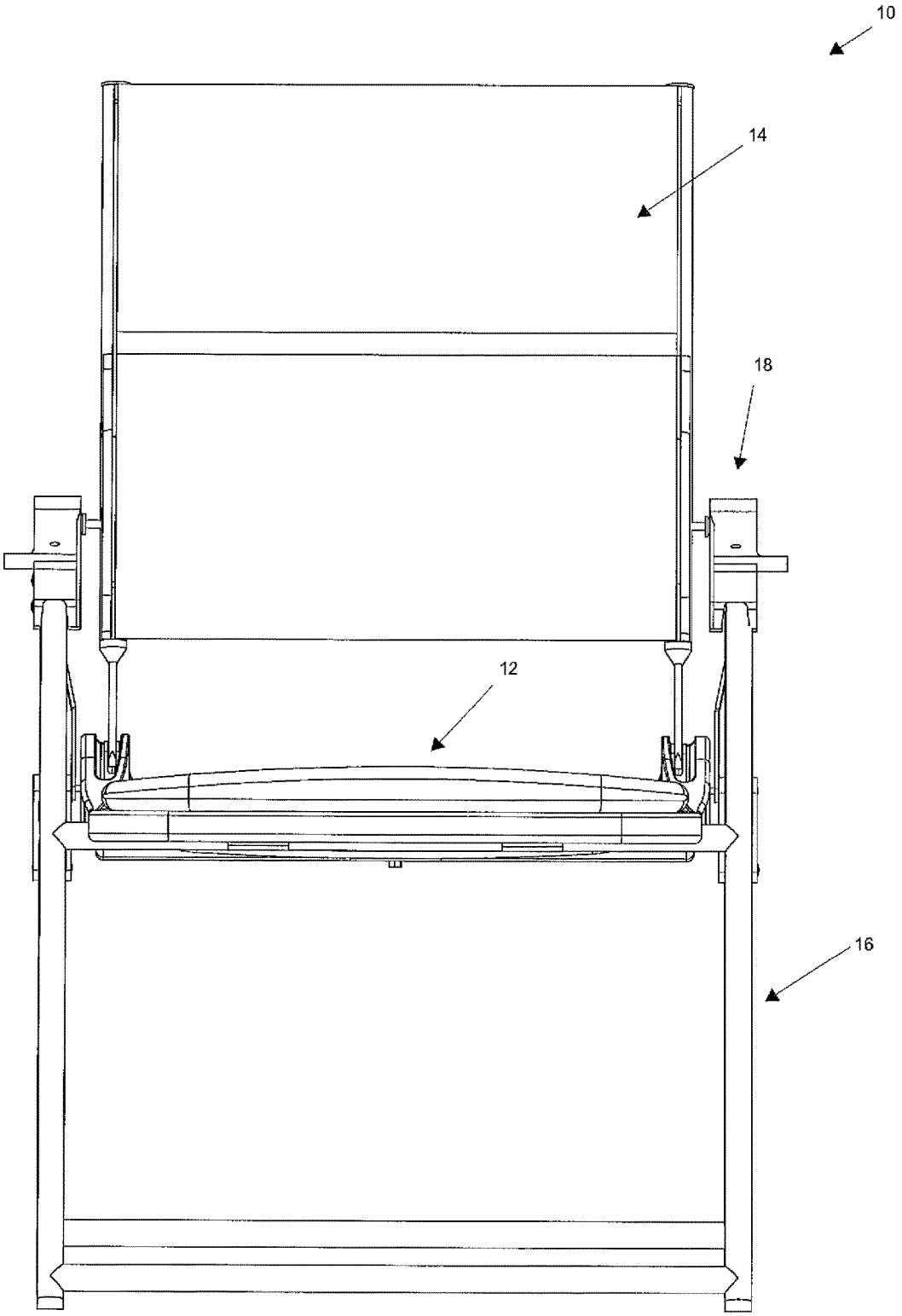
FIG. 40 is a front elevation view of the folding chair in accordance with one or more arrangements, the view showing the folding chair having a seat assembly, a backrest, a frame assembly, and an armrest assembly.
Figure 41:
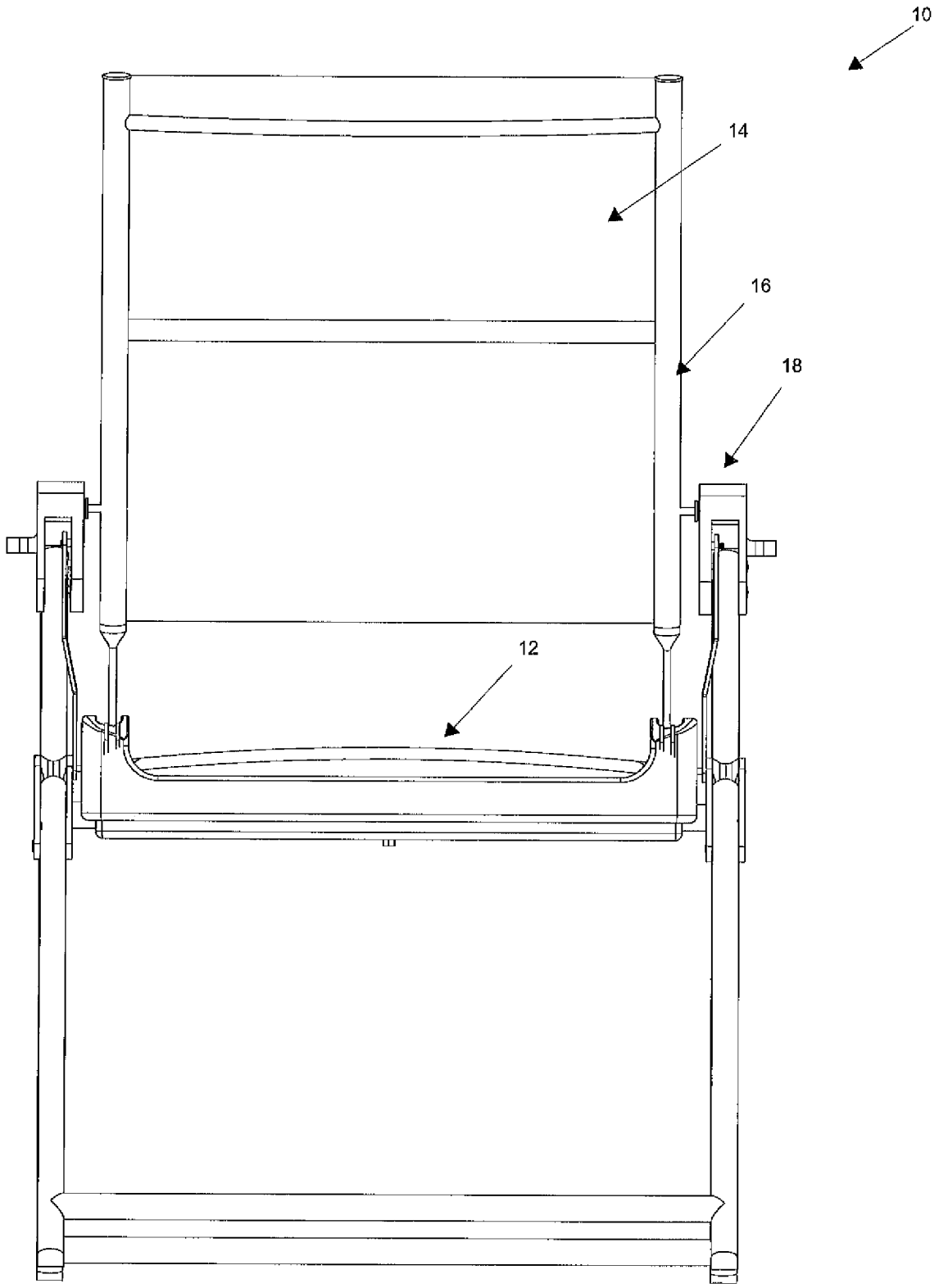
FIG. 41 is a back elevation view of the folding chair in accordance with one or more arrangements, the view showing the folding chair having a seat assembly, a backrest, a frame assembly, and an armrest assembly.
Figure 42:
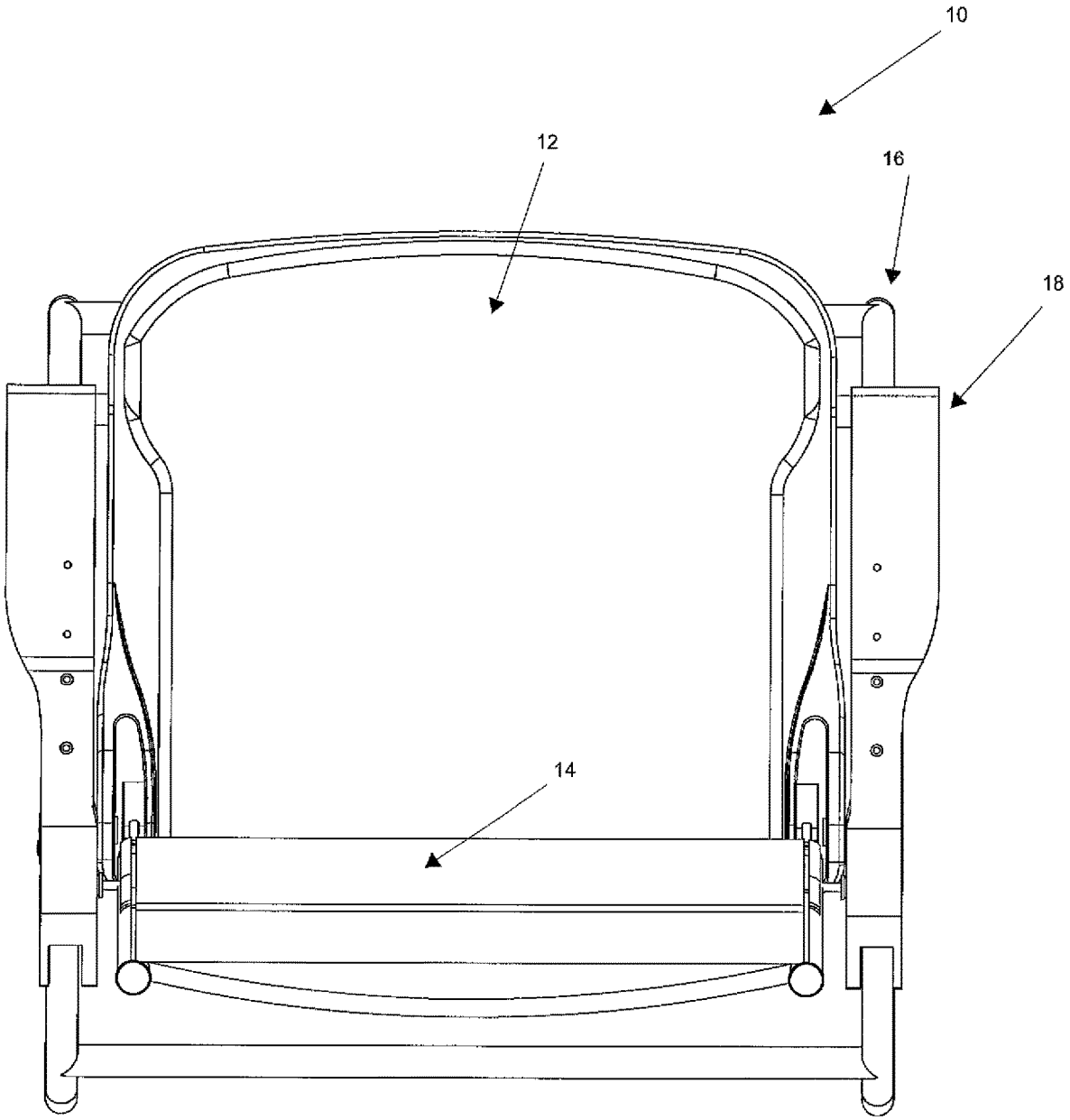
FIG. 42 is a top elevation view of the folding chair in accordance with one or more arrangements, the view showing the folding chair having a seat assembly, a backrest, a frame assembly, and an armrest assembly.
Figure 43:
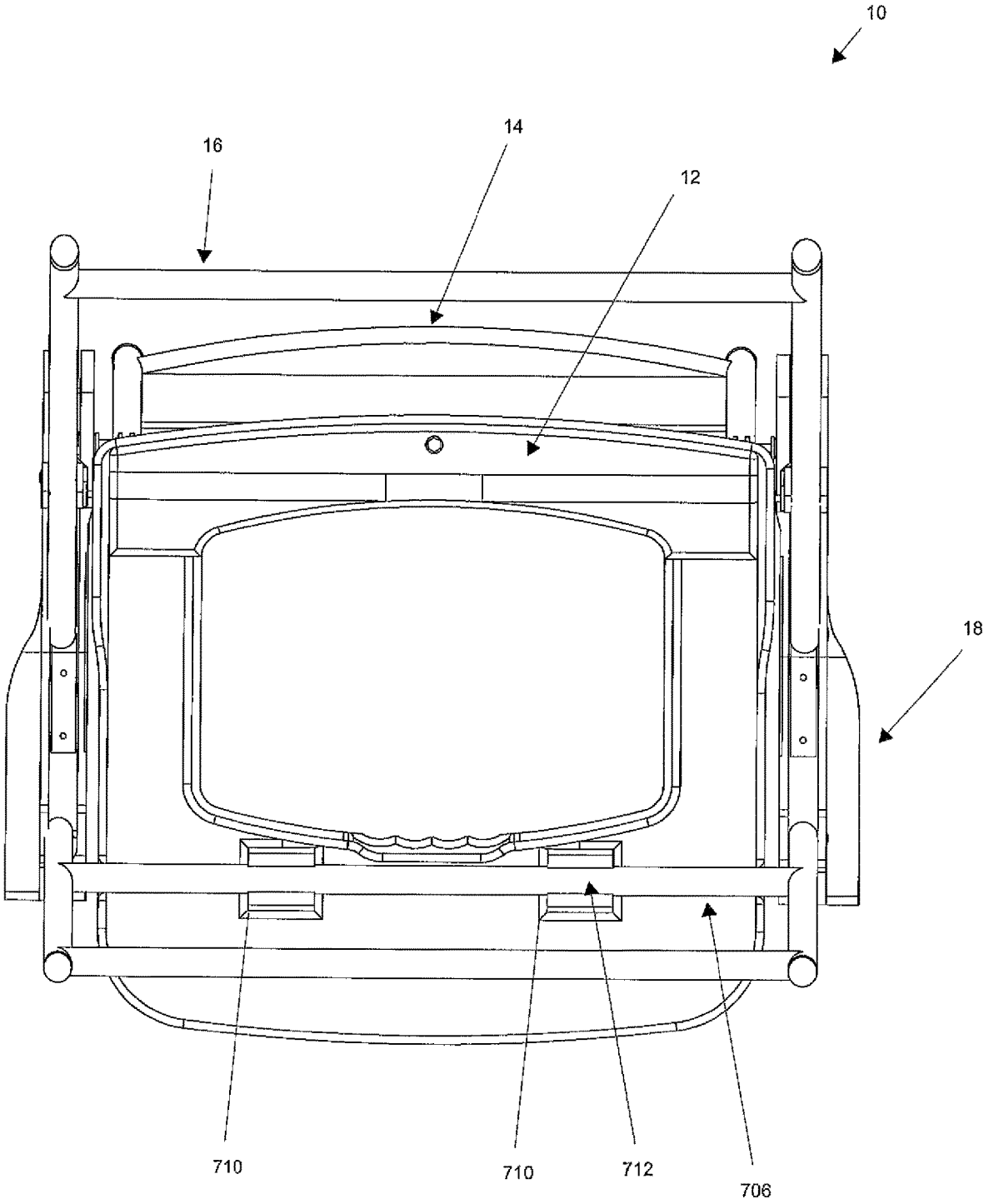
FIG. 43 is a bottom elevation view of the folding chair in accordance with one or more arrangements, the view showing the folding chair having a seat assembly, a backrest, a frame assembly, and an armrest assembly.
Figure 44:
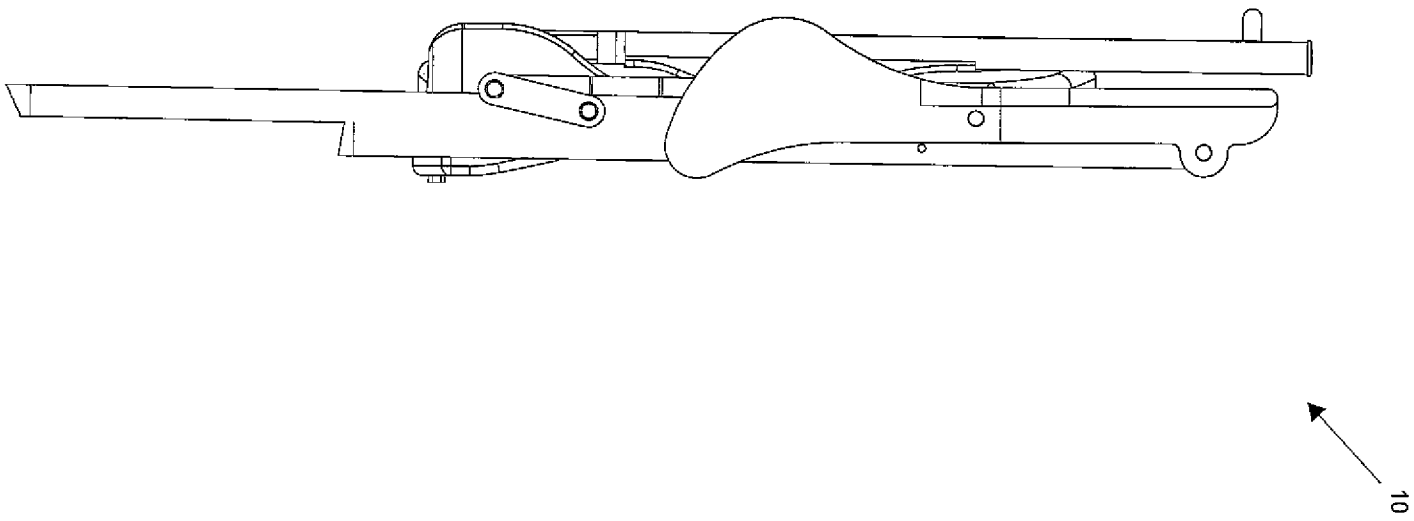
FIG. 44 is a side elevation view of the folding chair in accordance with one or more arrangements, the view showing the folding chair in a folded position.
Figure 45:
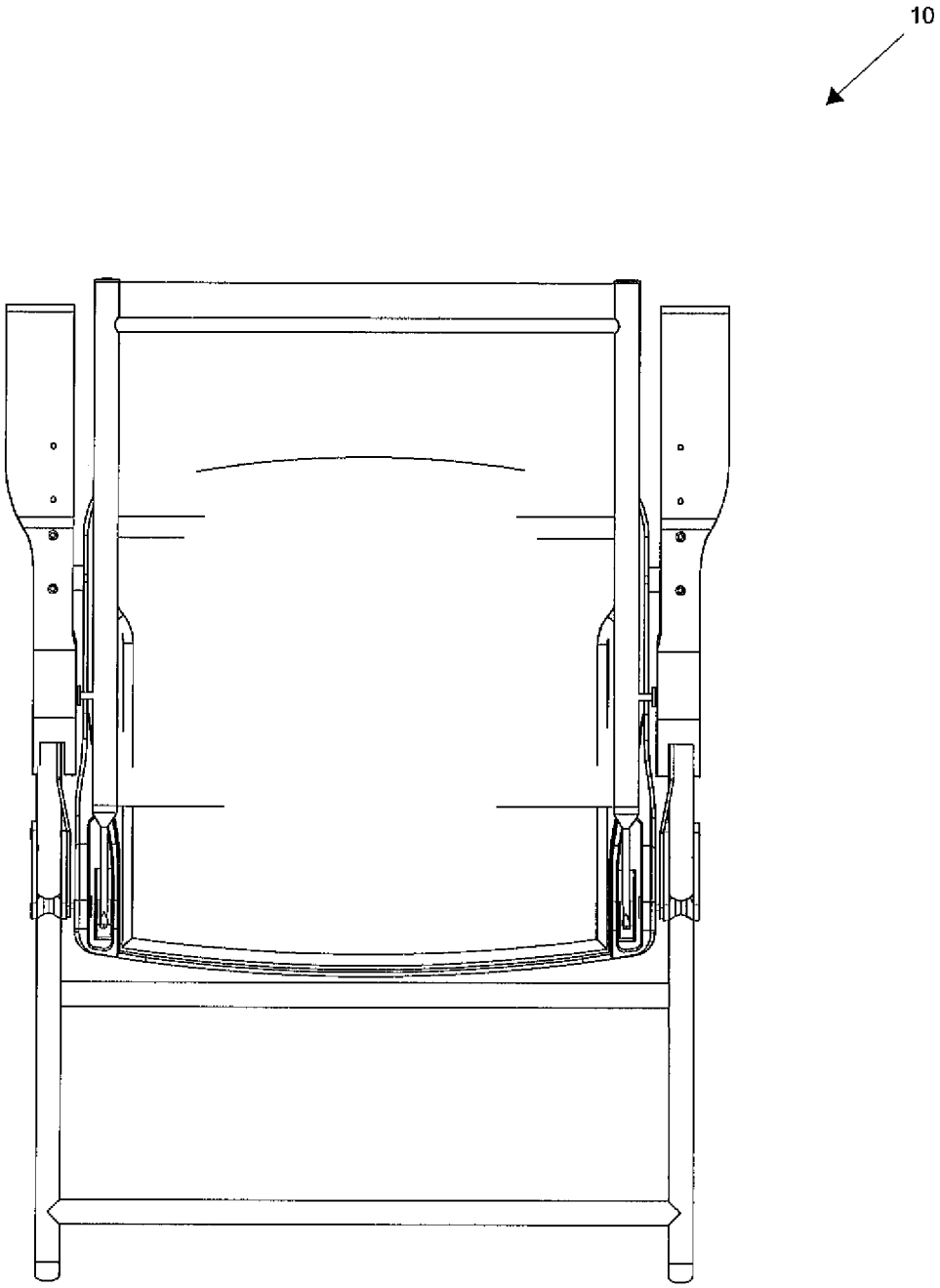
FIG. 45 is a top elevation view of the folding chair in accordance with one or more arrangements, the view showing the folding chair in a folded position.
Figure 46:
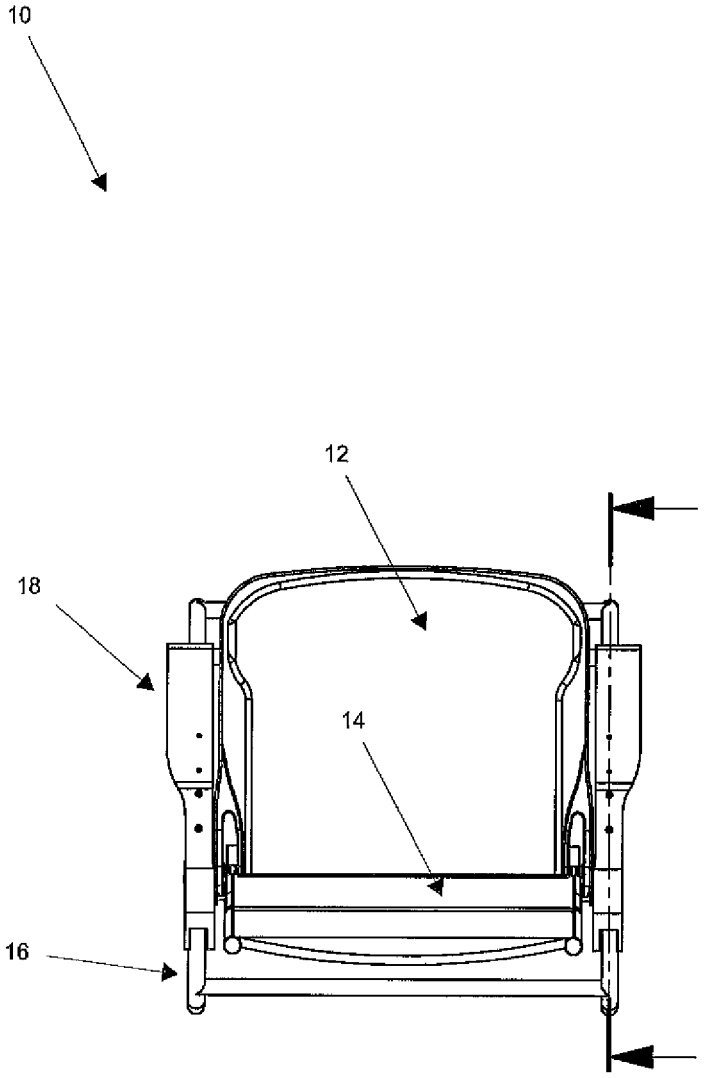
FIG. 46 is a top elevation view of the folding chair in accordance with one or more arrangements, the view showing the folding chair having seat assembly, a backrest, a frame assembly, and an armrest assembly.
Figure 47:
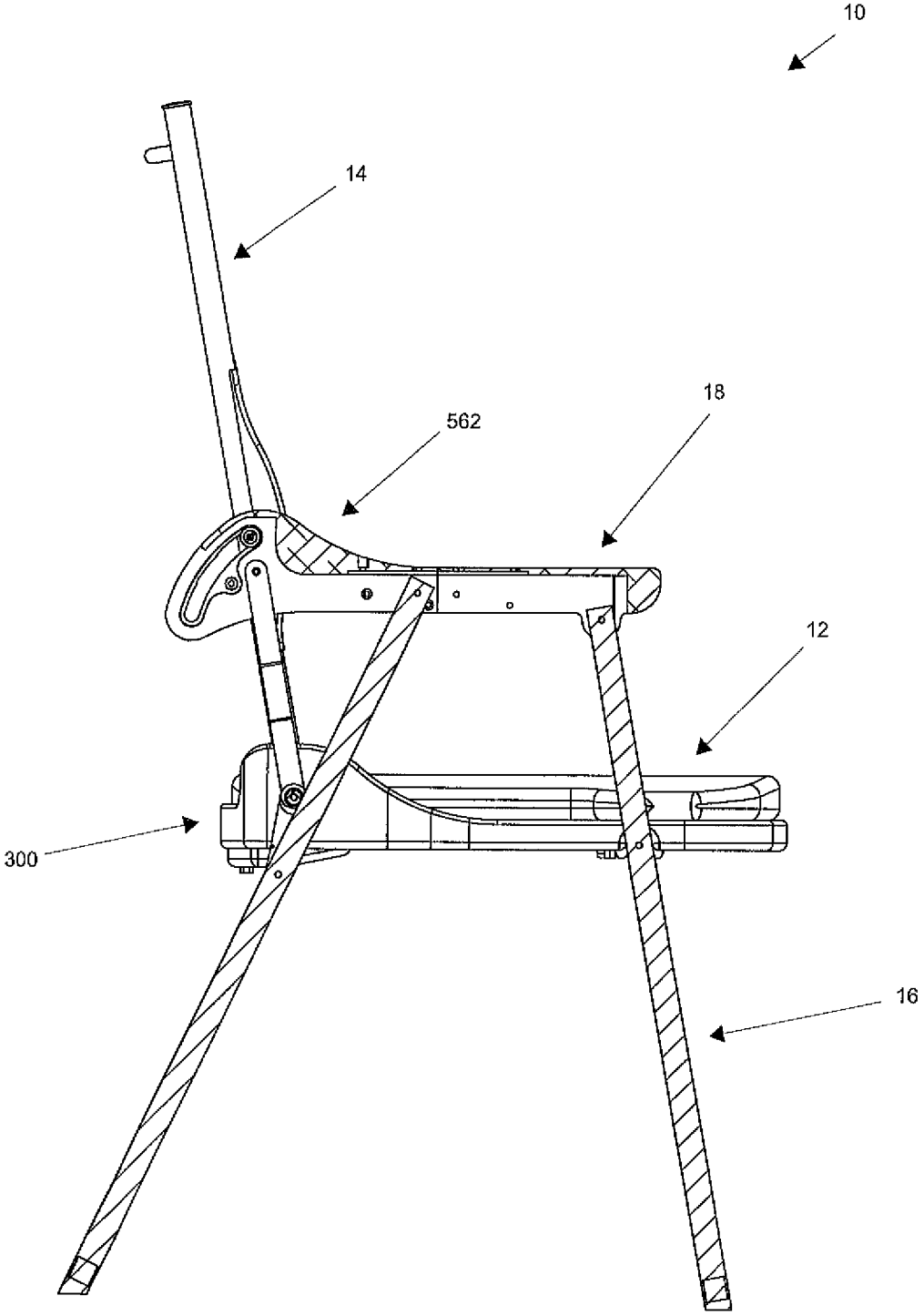
FIG. 47 is a side section view of the folding chair from FIG. 58, the view showing the armrest assembly cut away to show portions of the reclining mechanism, including the upper guide assembly and the lower guide assembly; the view showing the chair in an upright position.
Figure 48:
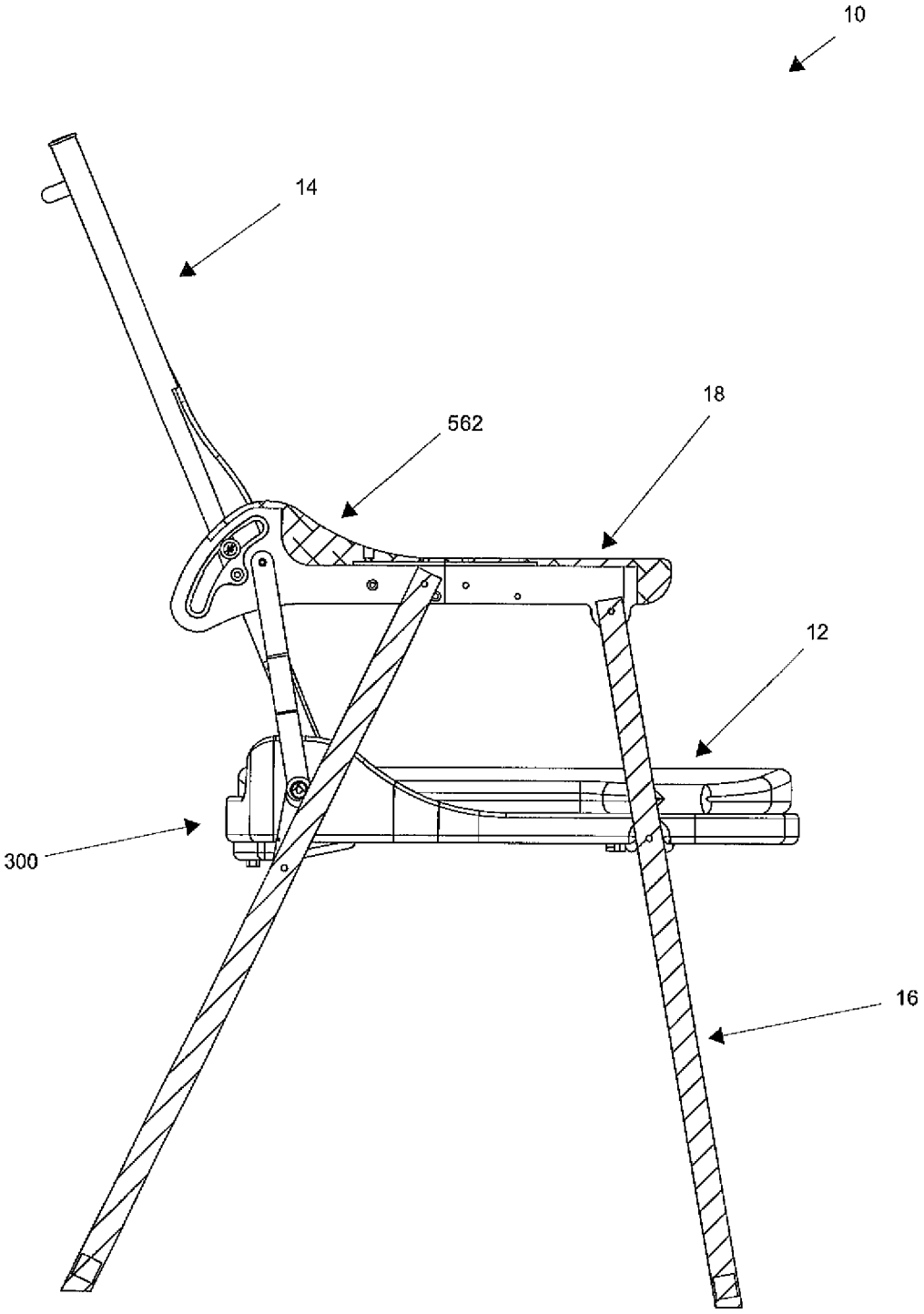
FIG. 48 is a side section view of the folding chair from FIG. 58, the view showing the armrest assembly cut away to show portions of the reclining mechanism, including the upper guide assembly and the lower guide assembly; the view showing the chair in a partially reclined position.
Figure 49:
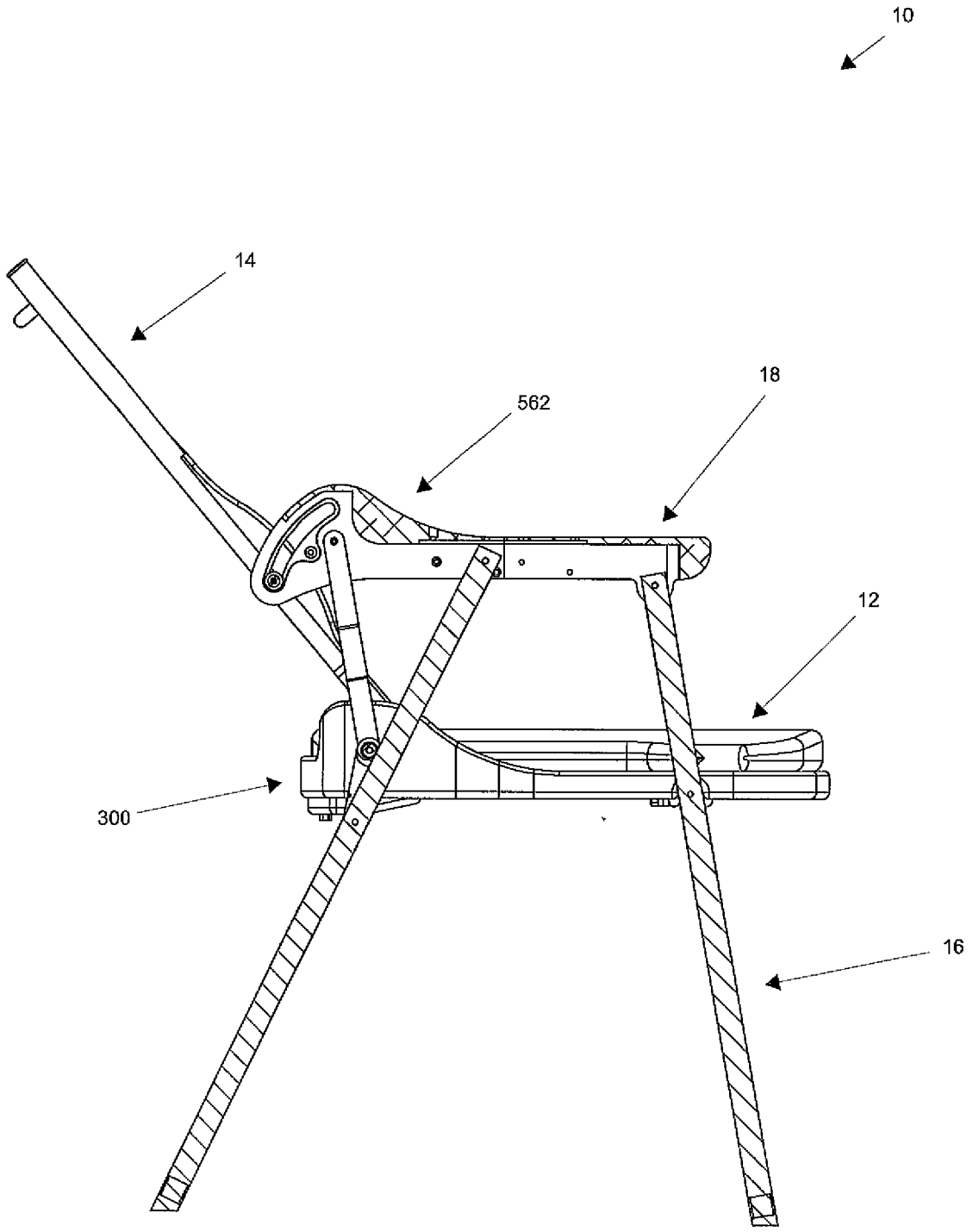
FIG. 49 is a side section view of the folding chair from FIG. 58, the view showing the armrest assembly cut away to show portions of the reclining mechanism, including the upper guide assembly and the lower guide assembly; the view showing the chair in a reclined position.
Figure 50:
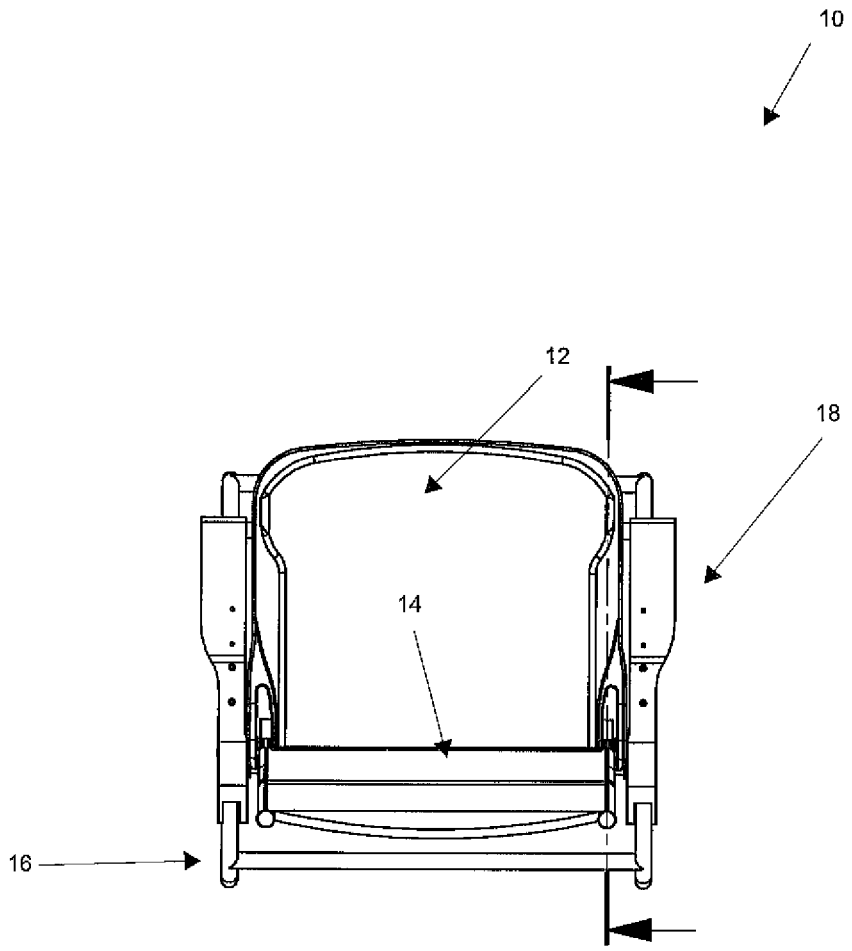
FIG. 50 is a top elevation view of the folding chair in accordance with one or more arrangements, the view showing the folding chair having seat assembly, a backrest, a frame assembly, and an armrest assembly.
Figure 51:
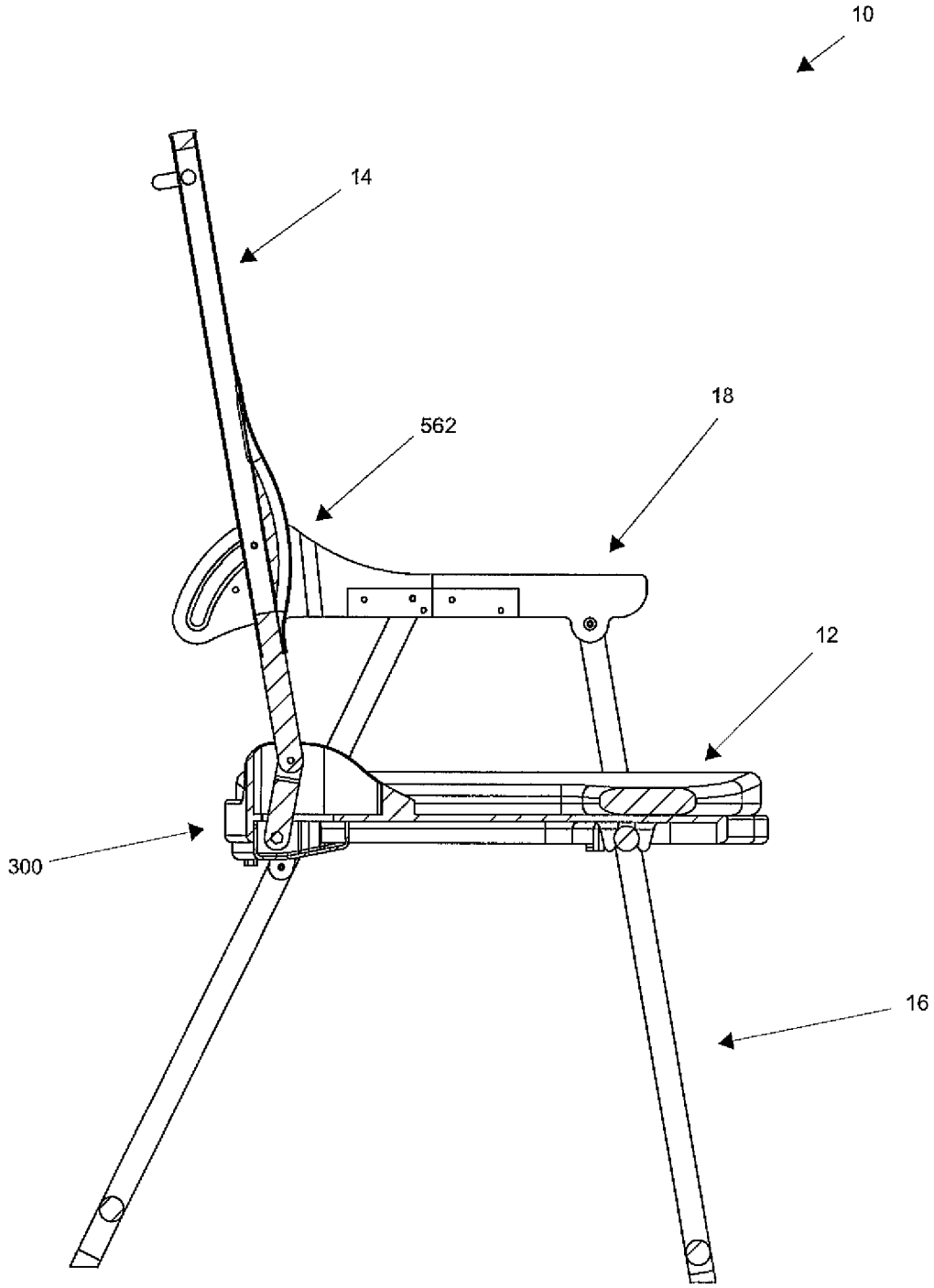
FIG. 51 is a side section view of the folding chair from FIG. 62, the view showing the armrest assembly cut away to show portions of the reclining mechanism, including the upper guide assembly and the lower guide assembly; the view showing the chair in an upright position.
Figure 52:
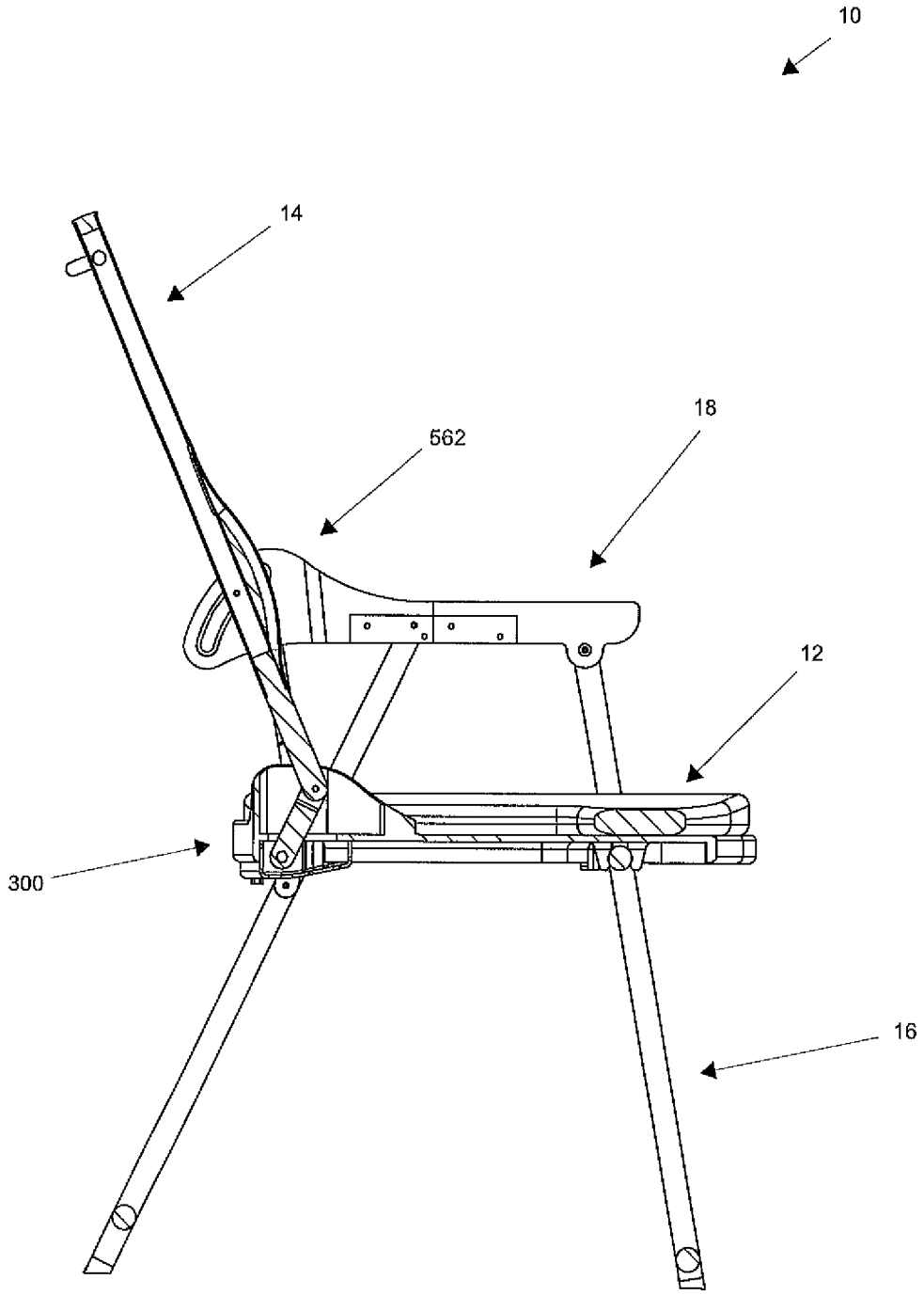
FIG. 52 is a side section view of the folding chair from FIG. 62, the view showing the armrest assembly cut away to show portions of the reclining mechanism, including the upper guide assembly and the lower guide assembly; the view showing the chair in a partially reclined position.
Figure 53:
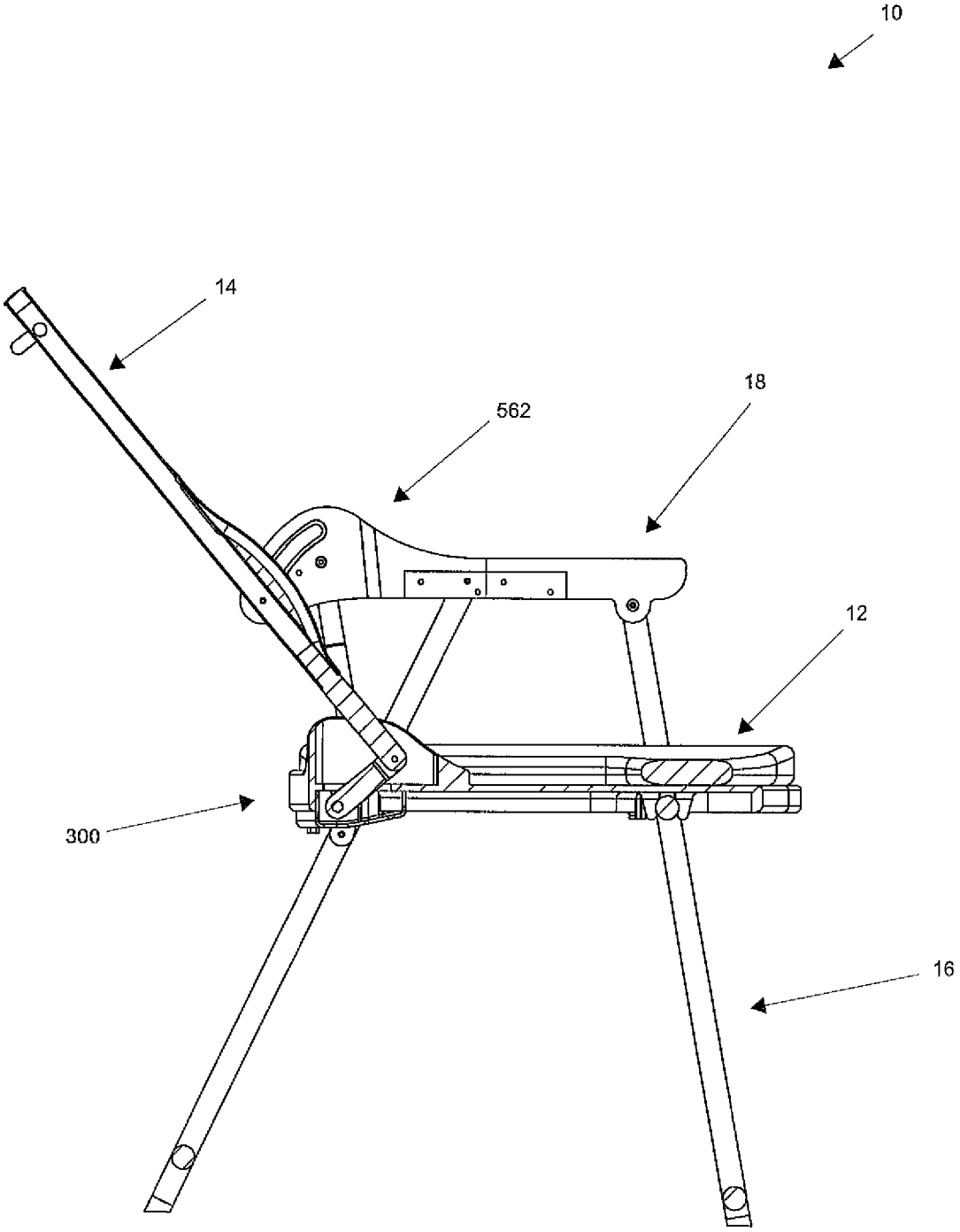
FIG. 53 is a side section view of the folding chair from FIG. 62, the view showing the armrest assembly cut away to show portions of the reclining mechanism, including the upper guide assembly and the lower guide assembly; the view showing the chair in a reclined position.
Figure 54:
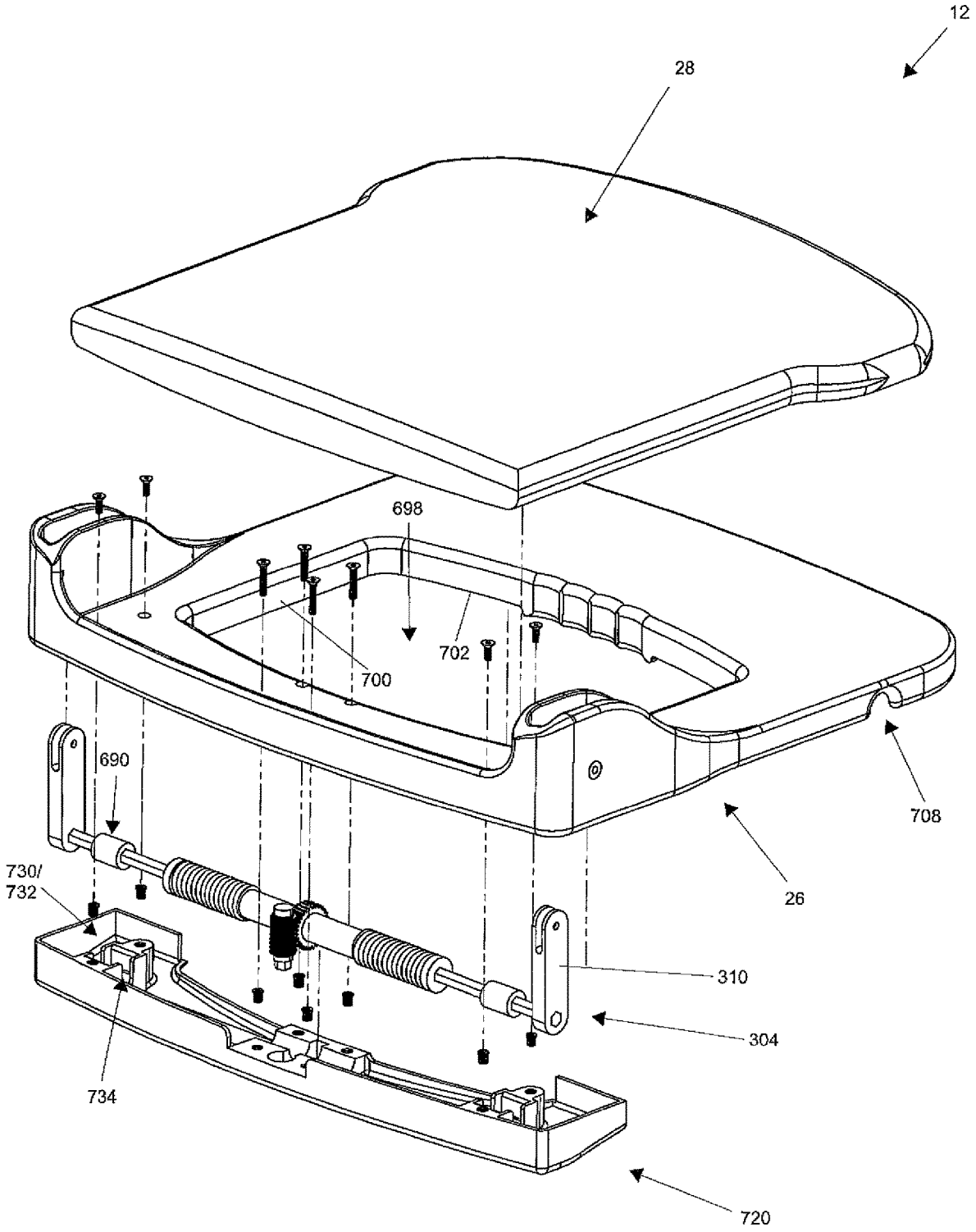
FIG. 54 is a perspective exploded view of the seat assembly, the view showing components of the seat assembly in accordance with one or more arrangements.
Figure 55:
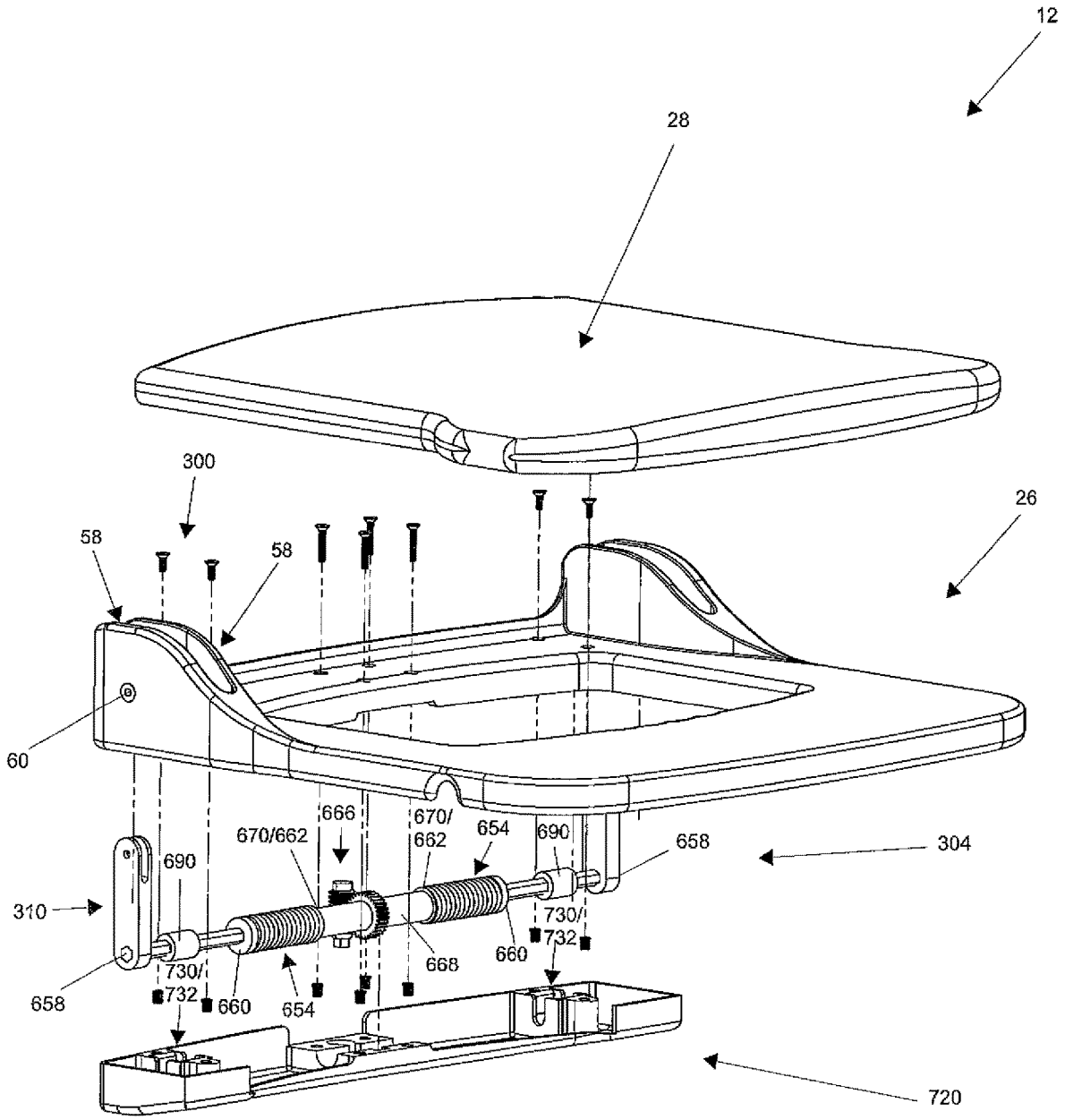
FIG. 55 is a perspective exploded view of the seat assembly, the view showing components of the seat assembly in accordance with one or more arrangements.
Figure 56:
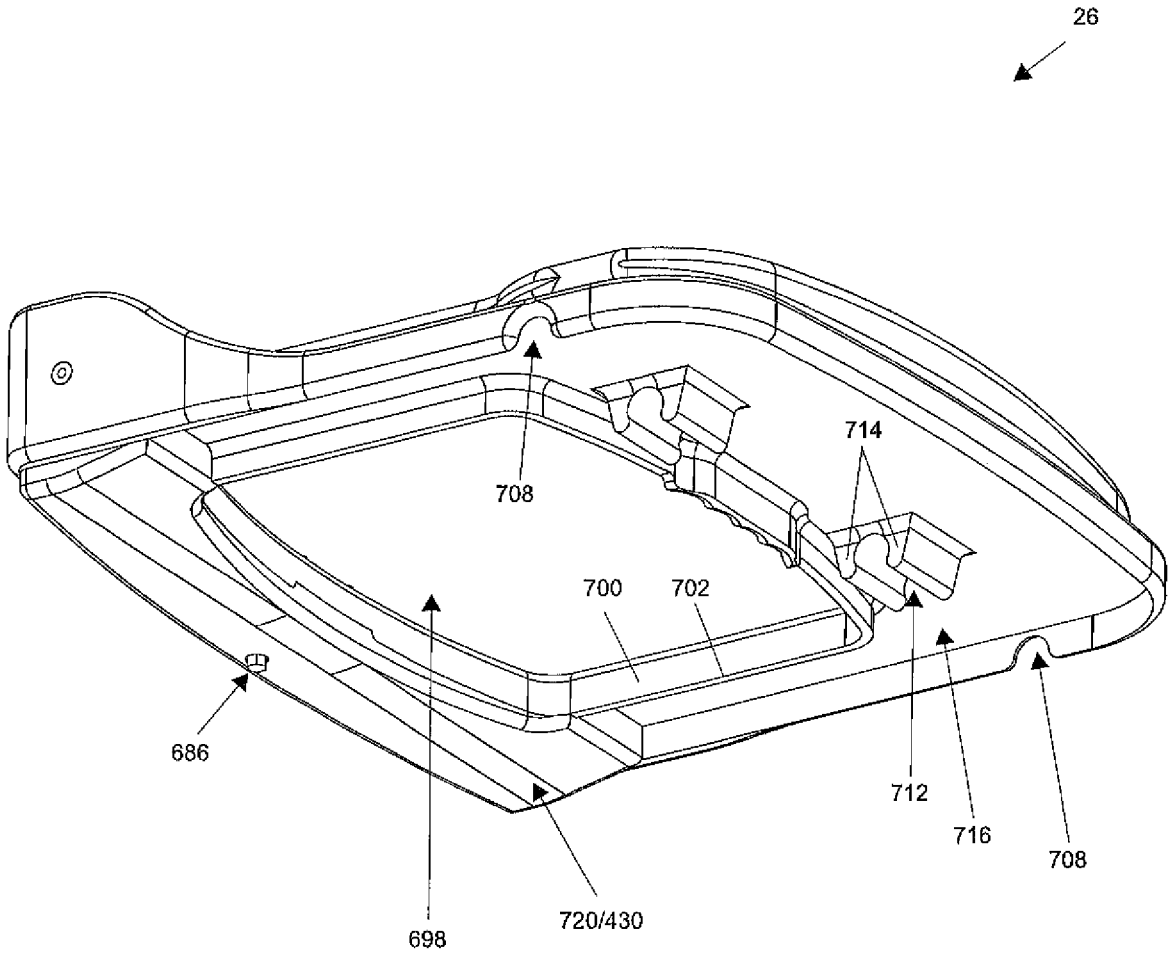
FIG. 56 is a perspective view of the support assembly in accordance with one or more arrangements, the view showing the support assembly having a center opening with sidewalls, a cylindrical cutaway, and crossbar connectors with cylindrical recesses and arms; the view also showing counterbalance housings with a lower cover.
Figure 57:
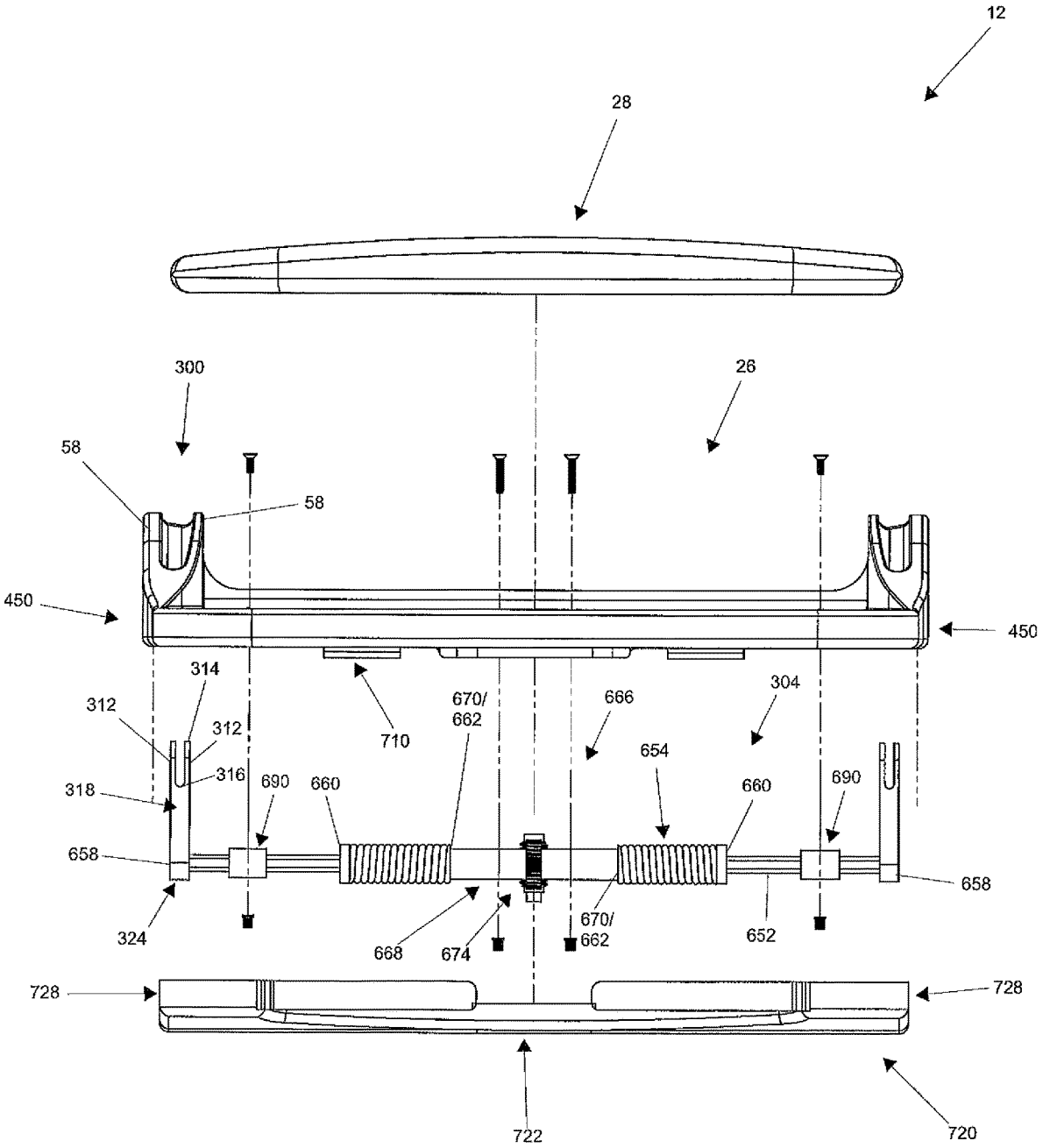
FIG. 57 is a back exploded view of the seat assembly, the view showing components of the seat assembly in accordance with one or more arrangements.
Figure 58:
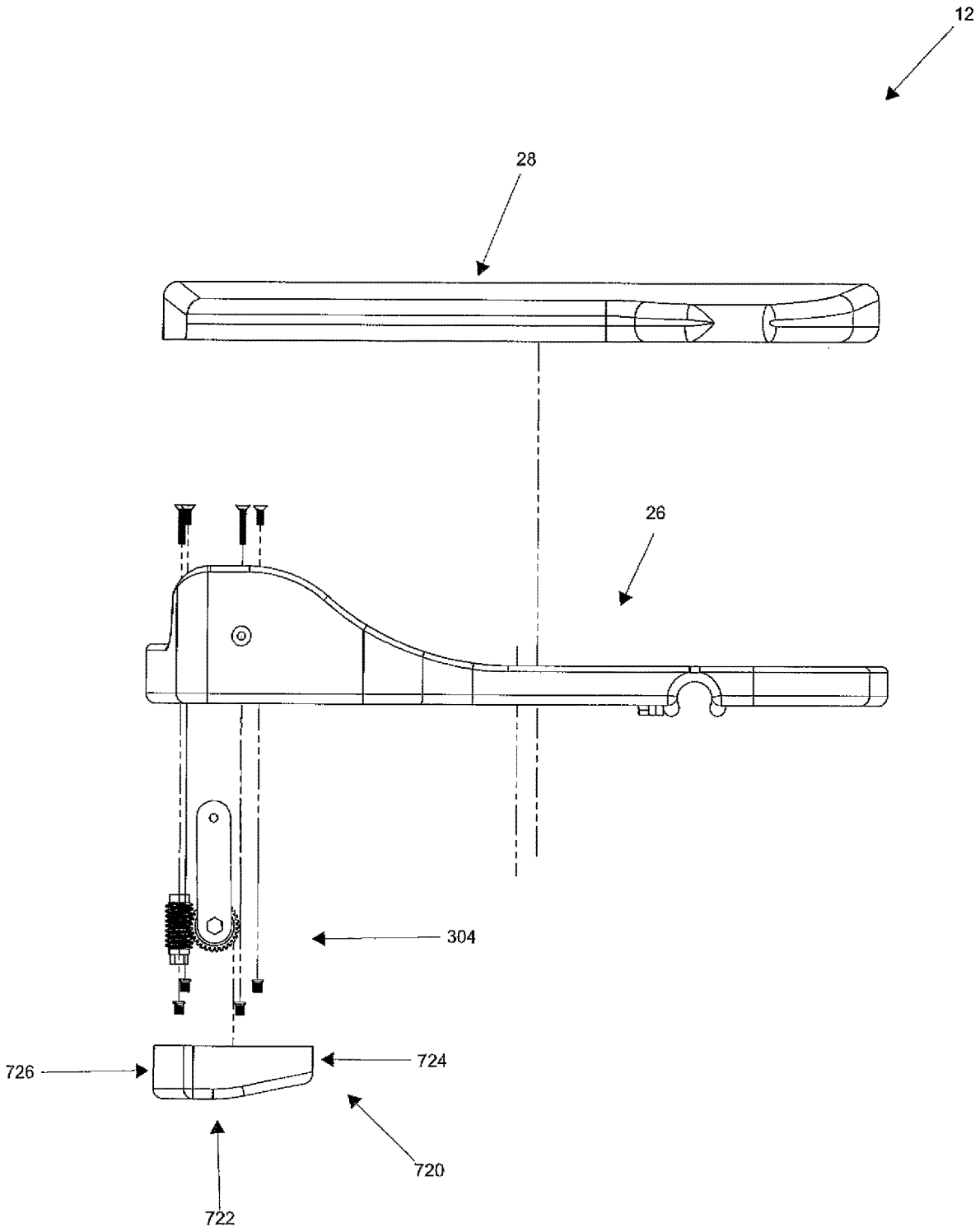
FIG. 58 is a side exploded view of the seat assembly, the view showing components of the seat assembly in accordance with one or more arrangements.
Figure 59B:
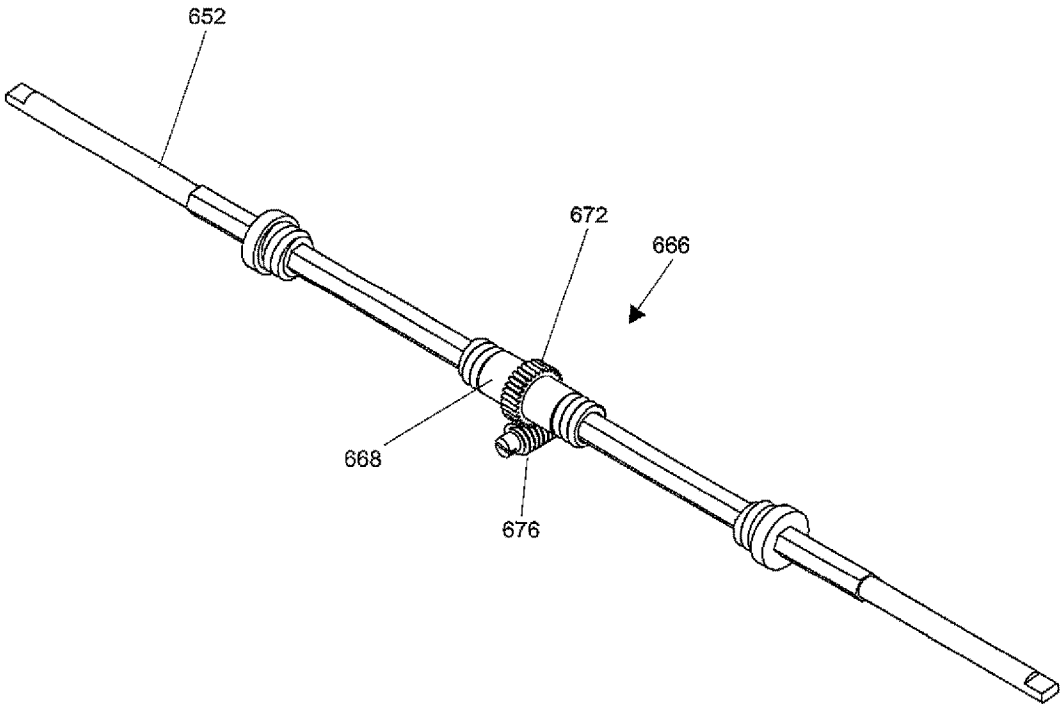
FIG. 59B is a perspective view of the tensioner assembly in accordance with one or more arrangements, the view showing the tube with teeth, the worm gear with helical features, and the axle of the counterbalance assembly.
Figure 59C:
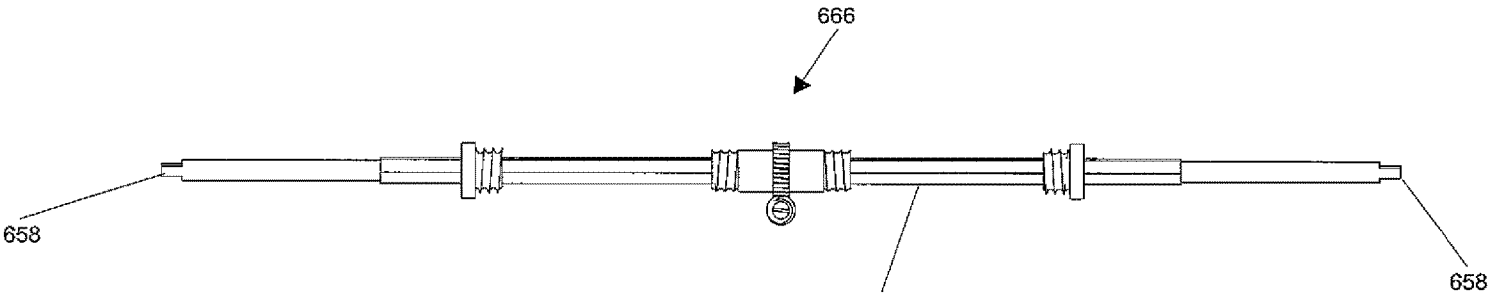
FIG. 59C is an elevation view of the tensioner assembly in accordance with one or more arrangements, the view showing the tube with teeth, the worm gear with helical features, and the axle of the counterbalance assembly.
Figure 59A:
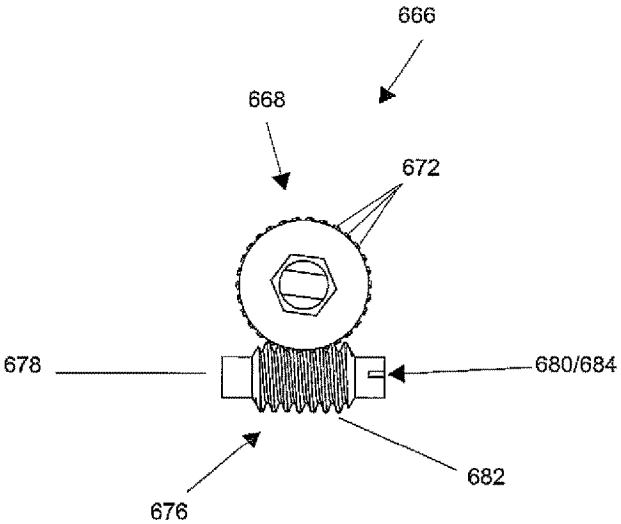
FIG. 59A is an elevation view of the tensioner assembly in accordance with one or more arrangements, the view showing the tube with teeth and the worm gear with helical features.
Figure 60:
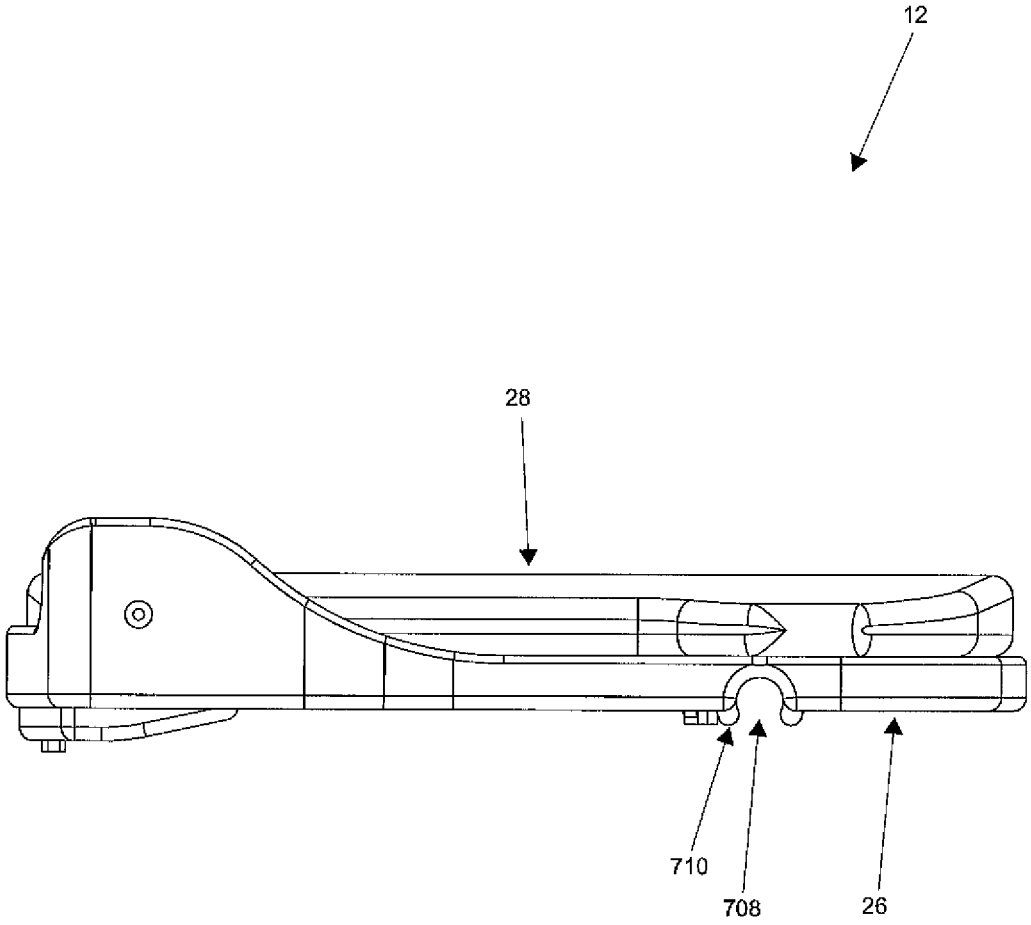
FIG. 60 is a side elevation view of the seat assembly in accordance with one or more arrangements, the view showing the seat assembly with a cushion and a support assembly with a cylindrical cutaway and crossbar connectors.
Figure 61:
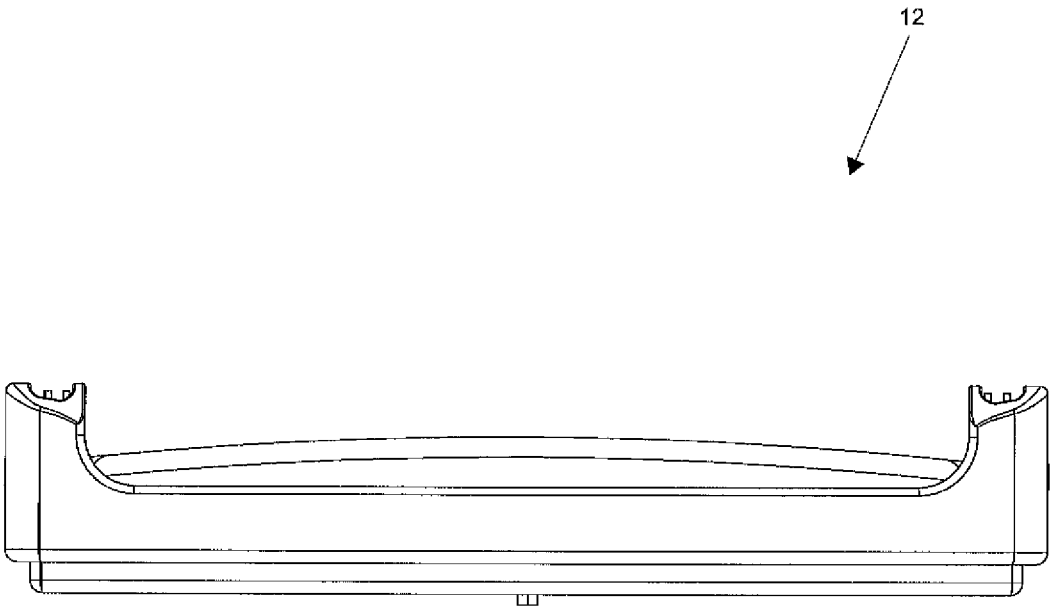
FIG. 61 is a rear elevation view of the seat assembly in accordance with one or more arrangements.
Figure 62:
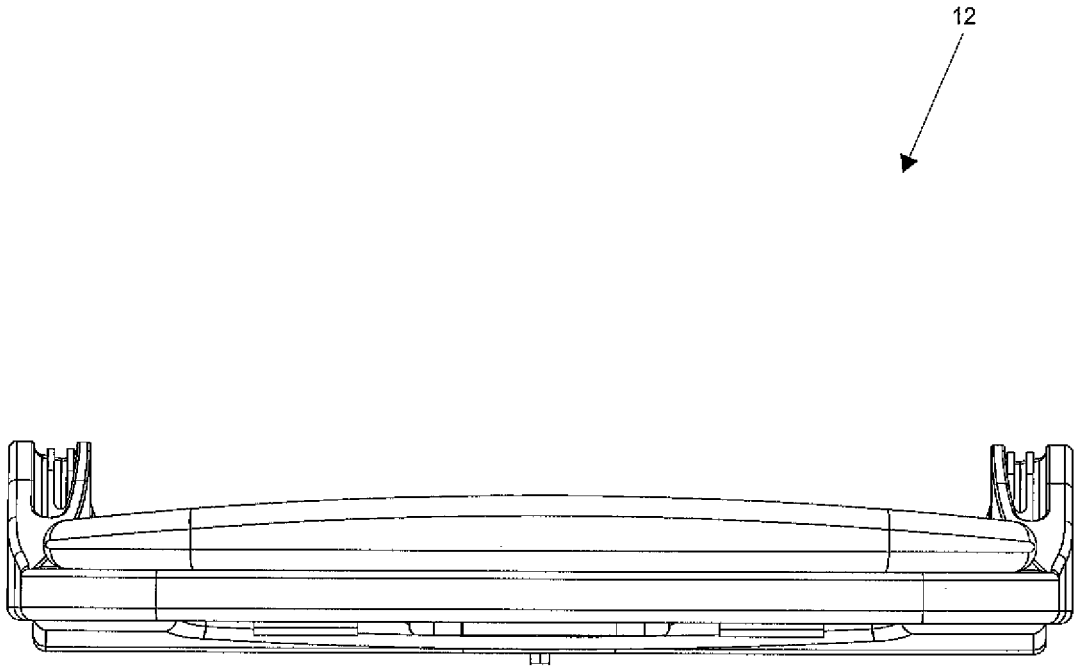
FIG. 62 is a front elevation view of the seat assembly in accordance with one or more arrangements.
Figure 63:
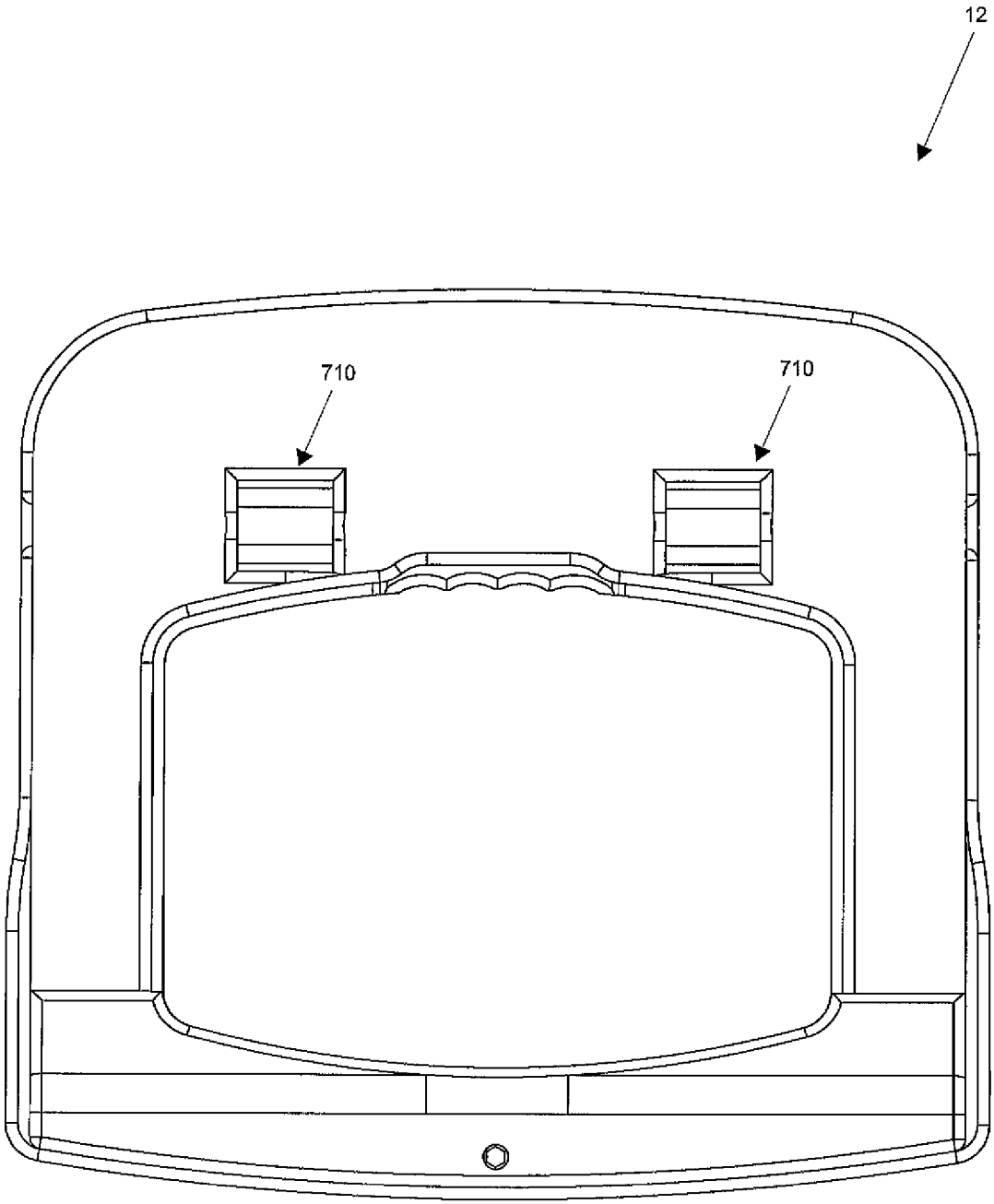
FIG. 63 is a bottom elevation view of the seat assembly in accordance with one or more arrangements, the view showing the seat assembly having crossbar connectors.
Figure 64:
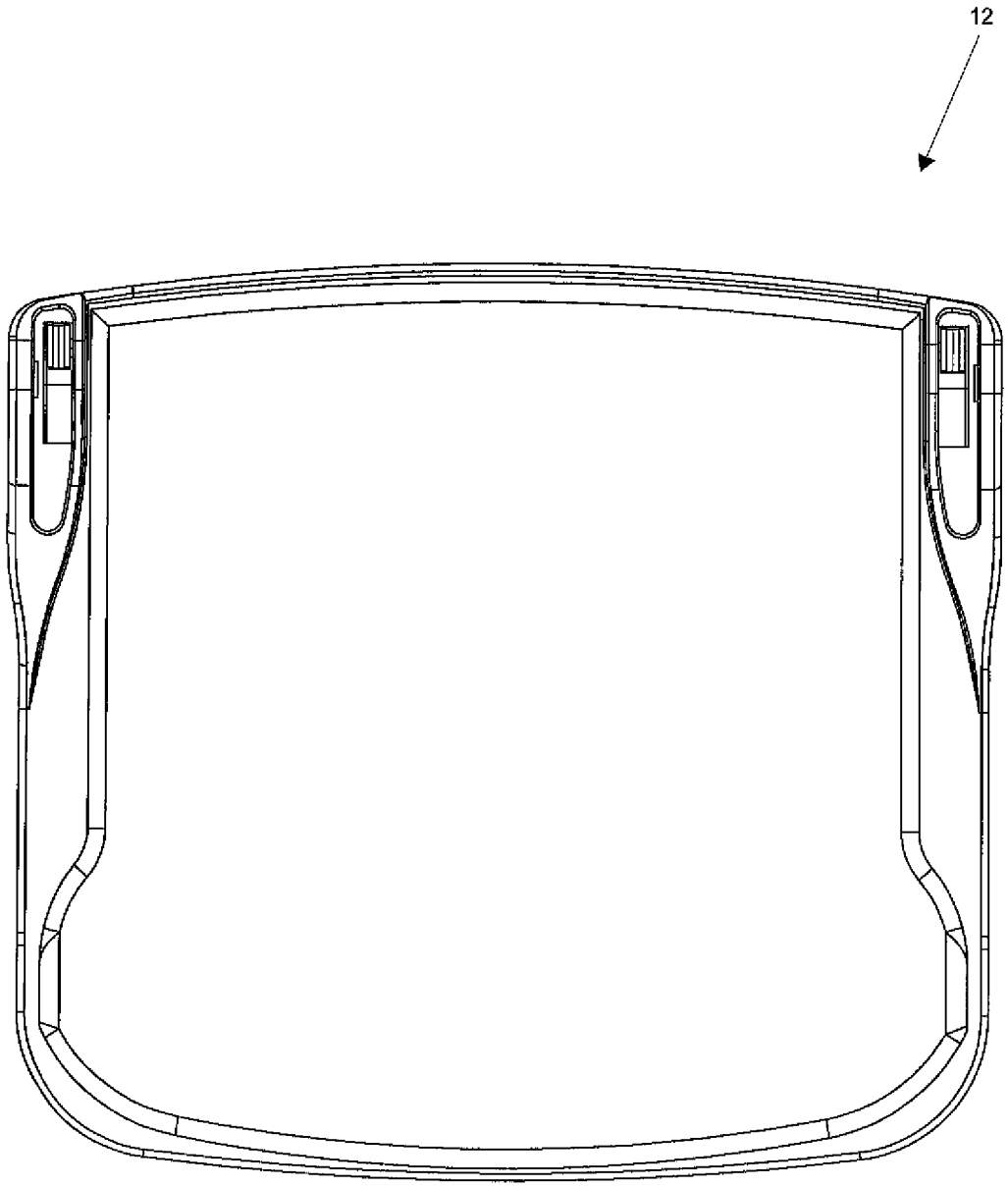
FIG. 64 is a top elevation view of the seat assembly in accordance with one or more arrangements.
Figure 65:
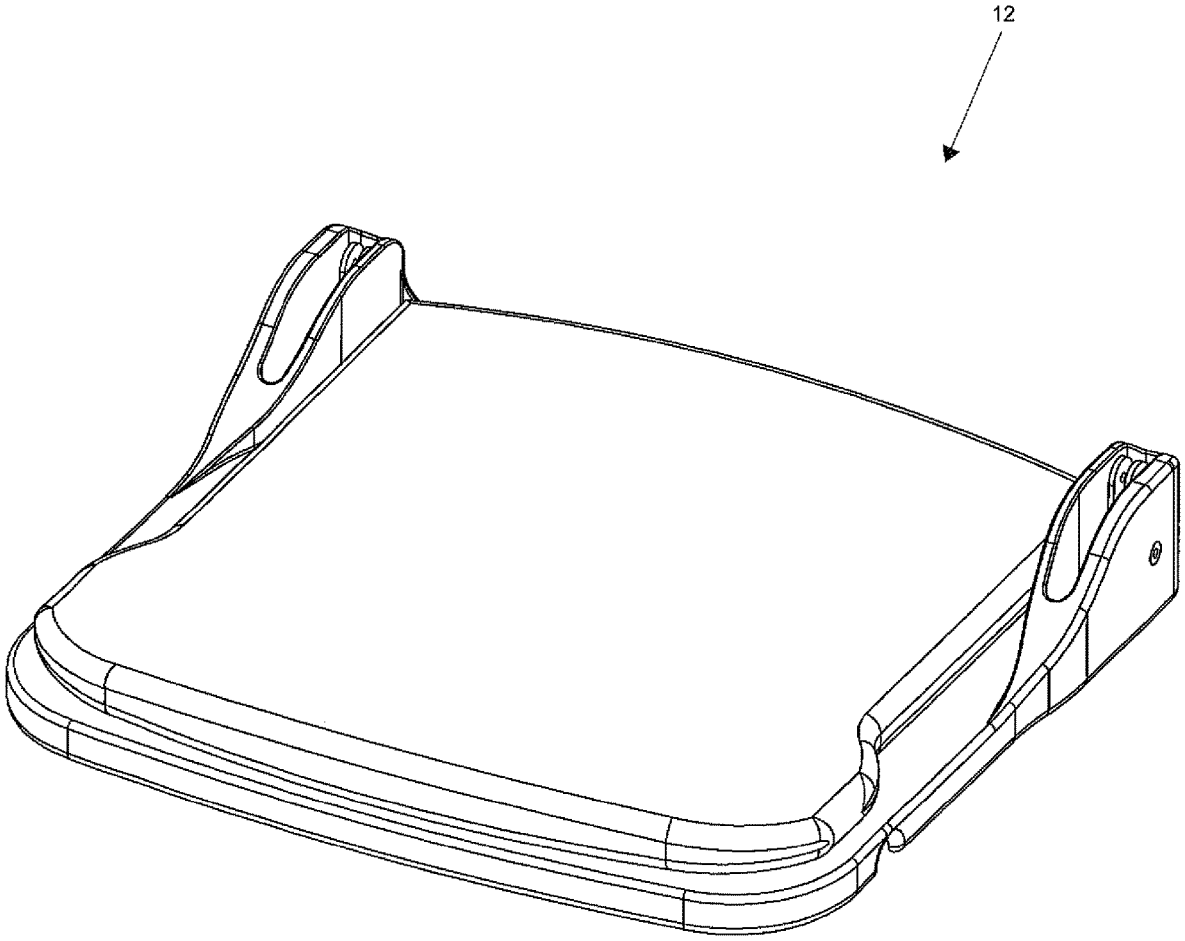
FIG. 65 is a perspective view of the seat assembly in accordance with one or more arrangements.
Figure 66:
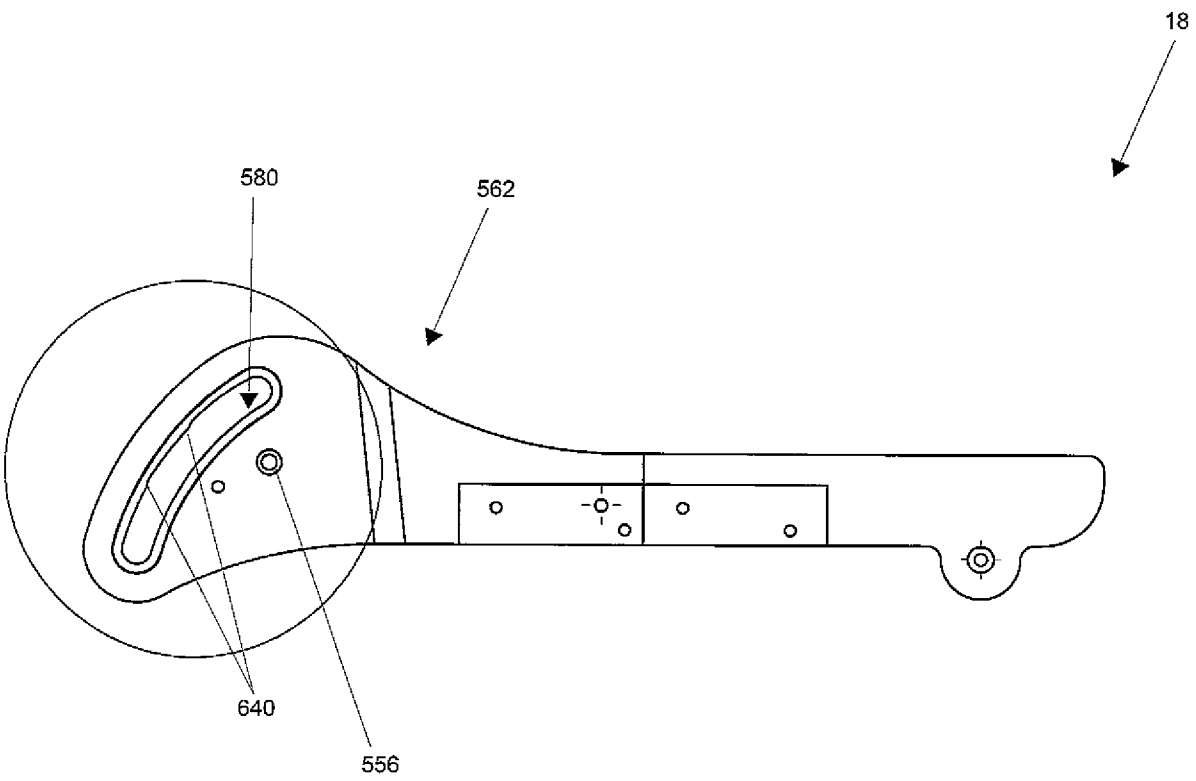
FIG. 66 is a side elevation view of the armrest assembly, the view showing the armrest assembly and portions of the reclining mechanism, including the upper guide assembly, guide member, and stop features of the reclining mechanism.
Figure 67:
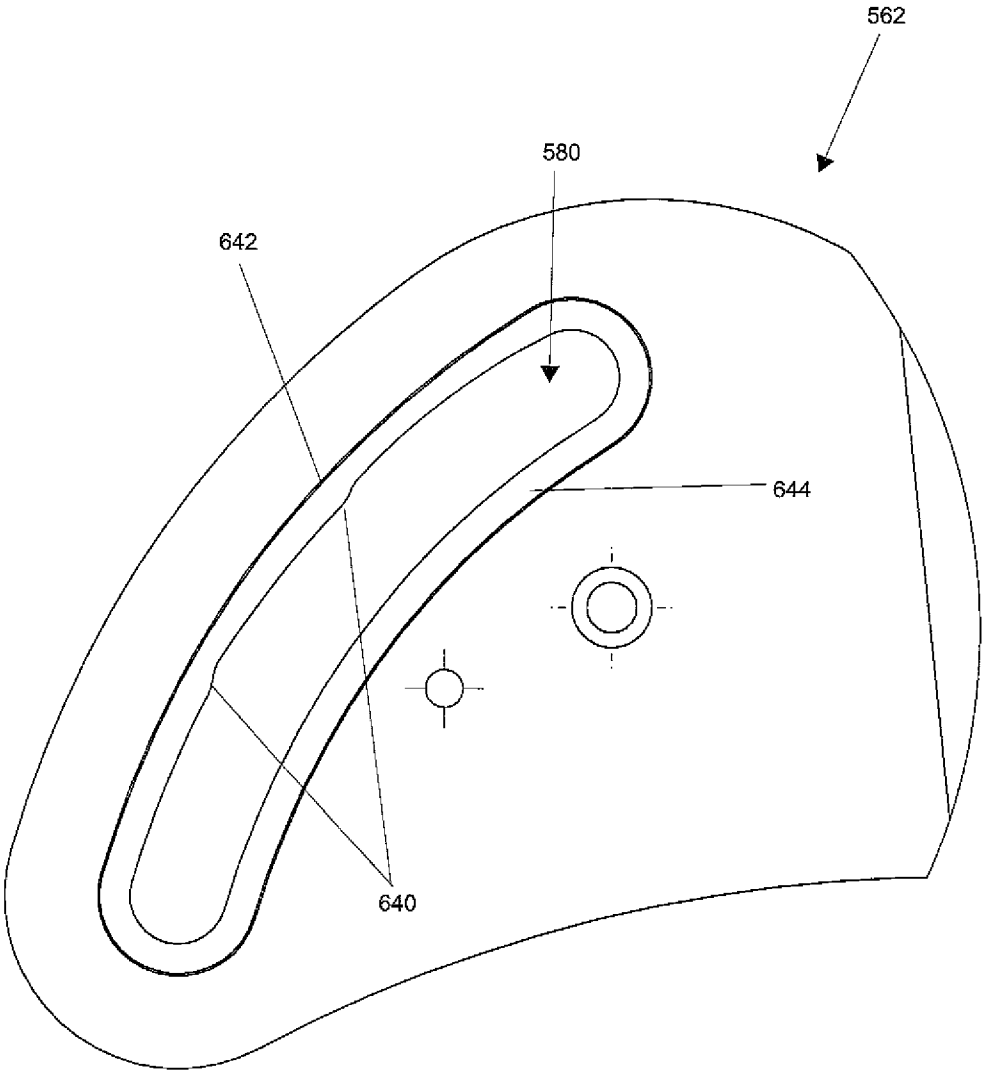
FIG. 67 is a section view of a portion of the reclining mechanism, the view showing the reclining mechanism having an upper guide assembly, a guide member, and stop features with an upper edge and a lower edge.
Figure 68:
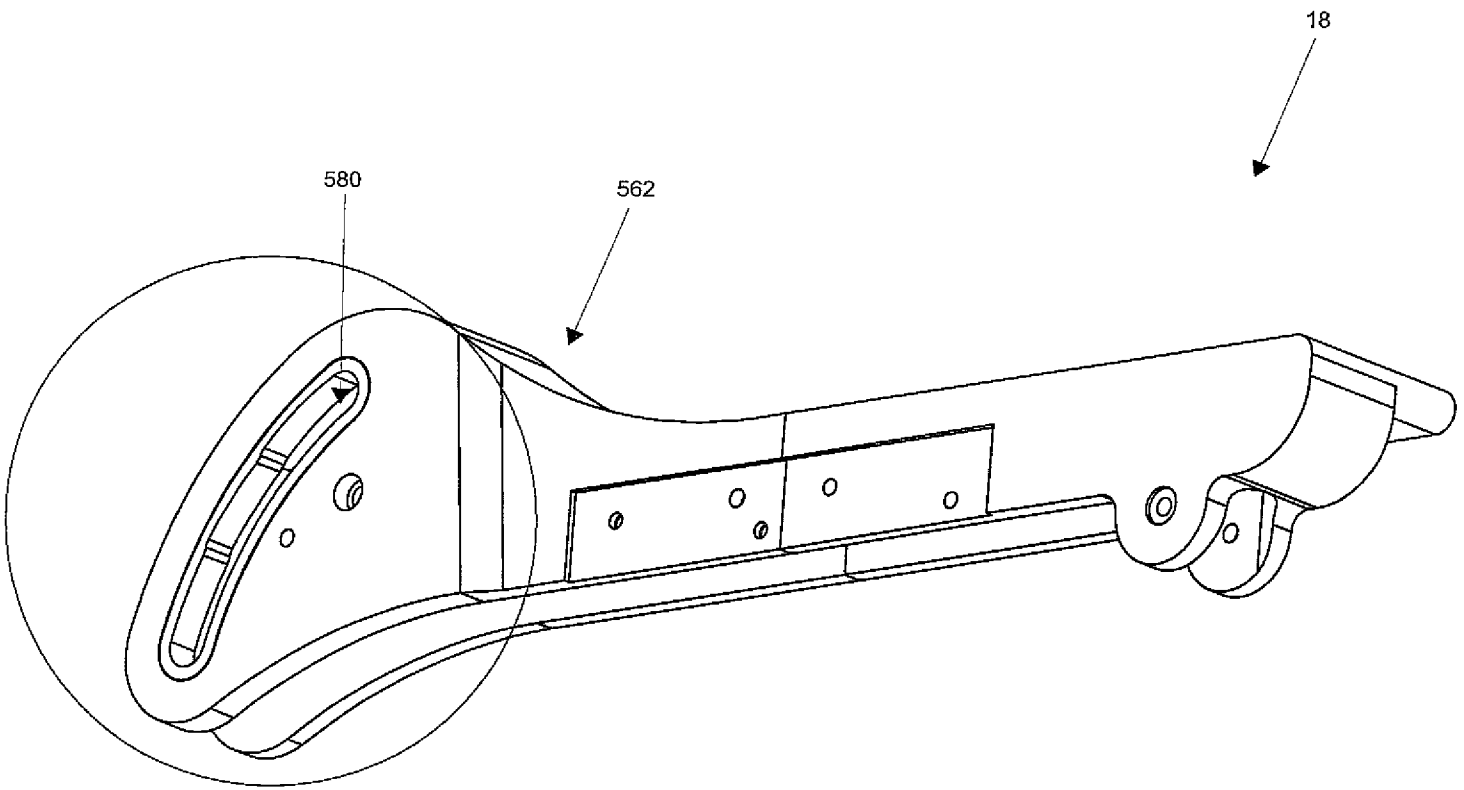
FIG. 68 is a perspective view of the armrest assembly, the view showing the armrest assembly and portions of the reclining mechanism, including the upper guide assembly, guide member, and stop features of the reclining mechanism.
Figure 69:
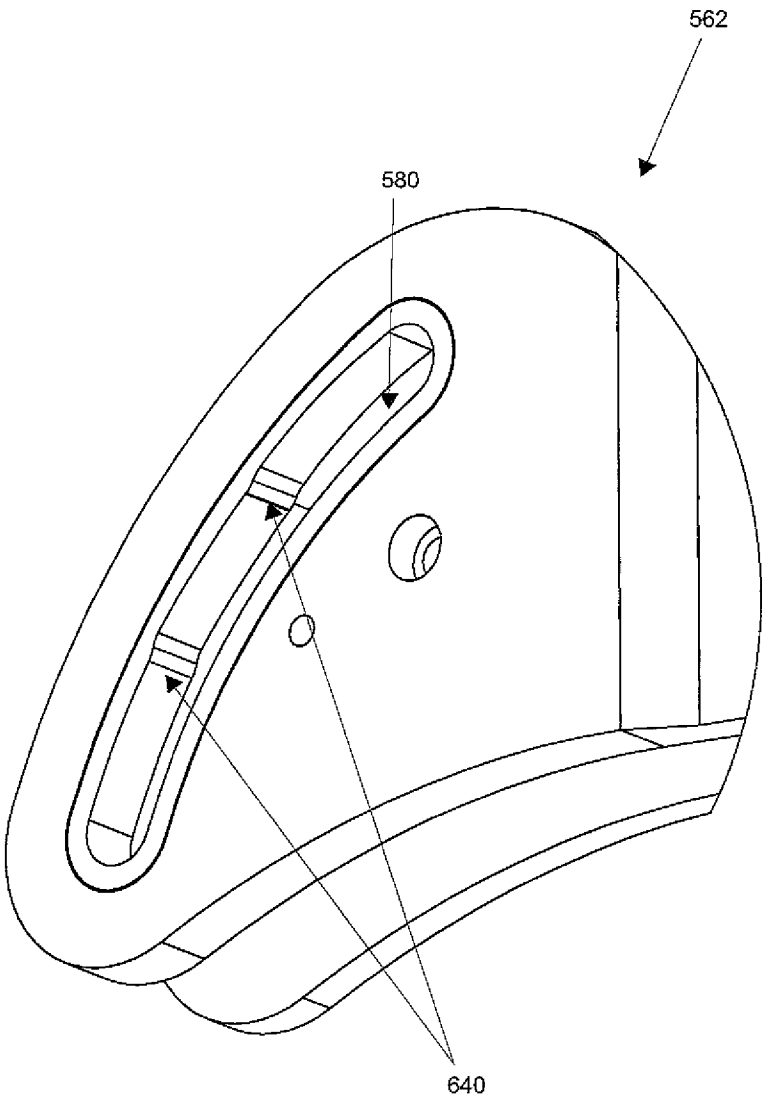
FIG. 69 is a section view of a portion of the upper guide assembly of the reclining mechanism, the view showing the reclining mechanism having an upper guide assembly, a guide member, and stop features.

With reference to FIGS. 36-69 an alternative arrangement of seating system 10 is presented. The arrangement shown in FIGS. 36-69 is similar to the arrangements shown in FIGS. 1-37 and as such, the disclosure related to the embodiment shown in FIGS. 1-35 applies to the embodiment shown in FIGS. 36-69 unless stated specifically herein. The primary difference presented in the arrangements shown in FIGS. 36-69 relates to reclining mechanism 22 and seat assembly 12 of system 10.

Reclining Mechanism 22:

Reclining mechanism 22 is formed of any suitable size, shape, and/or design and is configured to facilitate connection of backrest 14 with frame assembly 16 and facilitate movement of backrest 14 between up upright position and a reclined position. In the arrangement shown, as one example, reclining mechanism 22 is configured to recline backrest 14 by moving an upper end of backrest 14 (e.g., top edge 96) downward and rearward while also moving a lower end of backrest 14 (e.g., bottom edge 98) forward. In the arrangement shown, as one example, reclining mechanism 22 includes an upper guide assembly 562 similar to the arrangement shown in FIGS. 20-35, a lower guide assembly 300 similar to the arrangement shown in FIGS. 1-19, and counterbalance assembly 304.

Lower Guide Assembly 300:

Lower guide assembly 300 is formed of any suitable size, shape, and/or design and is configured to connect with and guide a lower portion of backrest 14 downward and forward along a defined path when backrest 14 is moved from an upright position to a reclined position. In the arrangement shown in FIGS. 36-69, as one example, lower guide assembly 300 includes a pair of links 310 positioned within slotted tracks 566, which are connected to top 30 of support assembly 26 of seat assembly 12.

Links 310 are formed of any suitable size, shape, and/or design, and are configured to provide a hinged connection with lower set of holes 182 of side bars 166 of back section 124 of frame assembly 16 and operably connect with counterbalance assembly 304. In this example arrangement, links 310 have a pair of parallel arms 312 having a rectangular planar shape extending between upper ends 314 and lower ends 316. In this example arrangement, arms 312 are connected together by central member 318 extending between arms 312 and downward from lower ends 316 to a lower end 324 of each link 310. In this example arrangement, upper ends 314 of arms 312 of links 310 have holes 322 to facilitate a hinged connection with lower set of holes 182 of side bars 166 of back section 124 of frame assembly 16.

In this example arrangement, lower ends 324 of links 310 have holes 320 to facilitate a fixed connection with axle 652 of counterbalance assembly 304 (e.g., by a fastener extending through holes 320 and 60). In this example arrangement, rotation of axle 652 of counterbalance assembly 304 causes upper ends 314 of arms 312 of links 310 and lower ends 174 of side bars 166 of back section 124 to move along a circular arc path about an axis of axle 652.

When backrest 14 is reclined by a user, axle 652 is rotated in a first direction and lower ends 174 of side bars 166 of back section 124 are moved downward and forward along the circular arc path. At the same time, guide member 580 is moved rearward and downward along a curved path within slotted track 242 from upper end 332 to lower end 334, thereby moving an upper portion of backrest 14 rearward and downward. Conversely, backrest 14 is moved upright when axle 652 is rotated in the opposite direction, which moves lower end of lower ends 174 of side bars 166 of back section 124 upward and rearward along the circular arc path. At the same time, guide member 580 is moved forward and upward along a curved path within slotted track 242 from upper end 332 to lower end 334, thereby moving an upper portion of backrest 14 rearward and downward.

Upper Guide Assembly 562:

Upper guide assembly 562 is formed of any suitable size, shape, and/or design and is configured to connect with and guide an upper portion of backrest 14 along a designated path when backrest 14 is moved from an upright position to a reclined position. In the arrangement shown, as one example, upper guide assembly 562 includes a guide member 580 connected to upper set of holes 184 of back section 124 and positioned within slotted track 242. In this example arrangement, guide member 580 is configured to move within slotted track 242 from an upper end 332 of slotted track 242 to a lower end 334 of slotted track 242 of connection assembly 238 of armrest assemblies 18.

In operation, when backrest 14 is reclined by a user, guide member 580 is moved rearward and downward along a curved path within slotted track 242 from upper end 332 to lower end 334, thereby moving an upper portion of backrest 14 rearward and downward. At the same time, lower guide assembly 300 moves a lower end of backrest 14 downward and forward. At the same time, counterbalance assembly 304, applies an opposing forward force to backrest 14 to provide comfortable support for an occupant.

Stop Features 640:

In one or more arrangements, reclining mechanism 22 includes one or more stop features 640 configured to facilitate positioning of system 10 at one or more intermediate positions between the upright position and the reclined position. In one or more arrangements, as one example, stop feature(s) 640 may be features formed within slotted channels 242 of connection assembly 238 of armrest assemblies 18 that guide member 580 of upper guide assembly 562 encounter as backrest 14 is moved between the upright and reclined positions.

In the arrangement shown, as one example, stop features 640 are protrusions that extend inward within slotted channels 242, thereby narrowing the channels at the intermediate positions. In this example arrangement, stop features 640 have an upper edge 642 and a lower edge 644. In this example arrangements, upper edges 642 protrude inward into slotted channels 242 more abruptly than lower edges 644. In this example arrangement, more force is required to move guide member 580 downward past the upper edges 642 than it does to move guide member 580 upward past the lower edges 644. Due to the slightly larger amount of force required to move guide member 580 past upper edges 642 of stop features 640, reclining mechanism 22 helps hold backrest 14 at one or more defined intermediate positions, thereby increasing reclining options for the occupant. Said another way, upper edges 642 of stop features 640 operate as ledges to hold guide member 580 above upper edges 642 until sufficient force is applied by a user to move guide member 580 downward past the upper edge 642 within the slotted channel 242

However, the embodiments are not so limited. Rather, it is contemplated that reclining mechanism 22 may utilize various methods and means for holding backrest 14 at one or more intermediate positions including but not limited to, for example, recesses, protrusions, indents, detents, holes, compressive fittings, frictional stops, magnetic components, gears, latches, non-linear springs, non-linear cams and pulleys and/or any other suitable means or methods known in the art.

Counterbalance Assembly 304:

Counterbalance assembly 304 is formed of any suitable size, shape, and design and is configured to apply a bias force sufficient to move backrest 14 to an upright position in the absence of a sufficient opposing force placed on backrest 14 (e.g., by an occupant leaning backward). In the arrangement shown, as one example, counterbalance assembly 304 is positioned within support assembly 26 of seat assembly 12 and includes axle 652, torsion springs 654, and a tensioner assembly 666, and rotational guides 690, among other components.

Axle 652 is formed of any suitable size, shape, and design and is configured to operably connect links 310 with torsion springs 654. In the arrangement shown, as one example, axle 652 has a hexagonal or cylindrical shape extending between opposing ends 658. In this example arrangement, rotational guides 690 are positioned on axle 652 proximate to ends 658. Rotational guides 690 are formed of any suitable size, shape, and design and are configured to hold axle 652 in position and facilitate rotation of axle 652 about a fixed axis relative to seat assembly 12. In this example arrangement, rotational guides 690 are cylindrical tube members positioned on axle 652 with axle 652 extending therethrough. In this example arrangement, rotational guides 690 are configured to be held within complementary cylindrical recesses 734 within counterbalance housing 430 that permit rotational guides 690 and axle 652 to be rotated.

In this example arrangement, opposing ends 658 of axle 652 are operably connected to links 310 of lower guide assembly 300. In this example arrangement, torsion springs 654 each have a first end 660 connected to axle 652 and a second end 662 connected to a tensioner assembly 666. When viewed from the left side, torsion springs 654 are tensioned to rotate axle 652 and links 310 clockwise in absence of a sufficient opposing force, thereby moving backrest 14 to the upright position.

Tensioner assembly 666 is formed of any suitable size, shape, and design and is configured to apply tension to torsion springs 654 so as to cause torsion springs 654 to apply the bias force, by rotating axle 652, to move backrest 14 to an upright position in the absence of a sufficient opposing force placed on backrest 14. In the arrangement shown, as one example, tensioner assembly 666 includes a generally cylindrical tube 668 extending between opposing ends 670, where tube 668 is operably connected to second ends 662 of torsion springs 654. In this example arrangement, axle 652 extends through tube 668 and is configured to freely rotate relative to tube 668. In this example arrangement, tube 668 has a set of teeth 672 formed on an exterior surface of the tube. In this example arrangement, tensioner assembly 666 includes a tensioner gear mechanism 674. Tensioner gear mechanism 674 is formed of any suitable size, shape, and design and is configured to engage teeth 672 of tube 668 and facilitate rotation of tube 668 to tension torsion springs 654. In the arrangement shown, as one example, tensioner gear mechanism 674 is formed of a high strength alloy such as, by way of example and not limitation, stainless steel, or any other high strength material. In an alternative arrangement, as one example, tensioner gear mechanism 674 may be formed of any metallic material or non-metallic material and the teeth 672 of tensioner gear mechanism 674 may be sufficiently wide in order to ensure adequate strength and rigidity of tensioner assembly 666. In the arrangement shown, as one example, tensioner gear mechanism 674 is a worm gear 676 positioned to engage teeth 672 and cause tube 668 to rotate when the worm gear 676 is rotated by a user. In this example arrangement, worm gear 676 has a generally cylindrical shape extending from an upper end 678 to a lower end 680 and has helical features 682 extending along an exterior surface of worm gear 676.

In this example arrangement, helical features 682 engage teeth 672 so as to cause tube 668 to rotate when worm gear 676 is rotated. In this example arrangement, worm gear 676 has a set of contact features 684 at lower end 680 to facilitate operable connection with a tool (e.g., a socket, wrench, screwdriver, or any other tool) for rotation of worm gear 676 by a user. In this example arrangement, features 684 at lower end 680 are accessible by a user via a hole 686 in bottom 722 of lower cover 720 of counterbalance housing 430 of seat assembly 12. However, the arrangements are not so limited. Rather, it is contemplated that tensioner assembly 666 may be implemented using various different arrangements of components and/or may be positioned at various locations within system 10 to facilitate tensioning of torsion springs 654.

Although some arrangements may be primarily described with reference to counterbalance assembly 304 having torsion springs 654 the embodiments are not so limited. Rather, it is contemplated that in various different arrangements counterbalance assembly 304 may utilize various mechanisms to move backrest 14 to the upright position including but not limited to, for example, one or more springs, one or more gas pistons, one or more gas springs, one or more hydraulic pistons, one or more actuators, one or more solenoids, one or more pneumatic members, and/or any other force generating means or combination thereof.

Seat Assembly 12:

Seat assembly 12 is formed of any suitable size, shape, and/or design and is configured to provide a surface for seating of an occupant thereupon. In the arrangement shown, as one example, seat assembly 12 includes a support assembly 26, a cushion 28, a counterbalance housing 430 for housing counter-balance assembly 304, among other components.

In this example arrangement, support assembly 26 is configured to operably connect with frame assembly 16 and reclining mechanism 22, support cushion 28 on a top 30 of support assembly 26. Counterbalance housings 430 are configured to connect with support assembly 26 and house counterbalance assembly 304.

Support Assembly 26:

Support assembly 26 is formed of any suitable size, shape, and/or design and is configured to provide a surface for seating of an occupant thereupon. In the arrangement shown, as one example, support assembly 26 has a generally rectangular planar shaped top 30 and a bottom 32 extending between a front edge 34, a back edge 36, and opposing side edges 38. In this example arrangement, support assembly 26 has an outer portion 40 positioned in an upper plane and a center opening 698. In this example arrangement, center opening 698 has sidewalls 700 that extend downward to lower edges 702. In this example arrangement, connection features 50 for connection of webbing (not shown) to outer portion 40 are omitted. Rather, in this example arrangement, cushion 28 is configured to provide a strong seating base while providing some give to provide a more comfortable seating surface for an occupant.

Additionally or alternatively, in one or more arrangements, support assembly may be configured to hold a foam insert 434 as described with reference to FIGS. 19-35 or may include webbing (not shown) that extends across center opening 698 to provide additional support as described with reference to FIGS. 1-19.

In the arrangement shown, support assembly 26 includes a front flange 446 extending downward from front edge 34 of support assembly 26, includes a rear flange 448 extending downward from back edge 36 of support assembly 26, and includes side flanges 450 extending downward from opposing side edges 38. Front flange 446, rear flange 448, and side flanges 450 provide additional rigidity to support assembly 26 and also help conceal counterbalance housing 430 and counterbalance assembly 304. However, the embodiments are not so limited. Rather, it is contemplated that in one or more arrangements front flange 446, rear flange 448, and/or side flanges 450 may be omitted.

In this example arrangement, support assembly 26 also includes tabs 58 that extends upward from a rearward end of support assembly 26 proximate to side flanges 450 and which form lower guide assembly 560 of reclining mechanism 22. In this example arrangement, tabs 58 include holes 60 to facilitate a hinged connection with lock assembly 20

In the arrangement shown, a forward end of support assembly 26 connects with and rests on an upper front crossbar 706 of frame assembly 16. In this example arrangement, side flanges 450 have cylindrical cutaways 708 located toward a front edge 34 of support assembly 26 and configured to receive upper front crossbar 706 when connected to support assembly 26. In this example arrangement, support assembly 26 includes a pair of crossbar connectors 710 on bottom 32 of support assembly 26. Crossbar connectors 710 are formed of any suitable size, shape, and design and are configured to receive and connect with upper front crossbar 706 to secure support assembly 26 of seat assembly 12 to frame assembly 16. In the arrangement shown, as one example, crossbar connectors 710 have semi cylindrical recesses 712 formed by arms 714 extending downward from bottom 32. In this example arrangement, arms 714 are closer together at a lower end to hold upper front crossbar 706 in semi cylindrical recesses 712, while permitting upper front crossbar 706 to be inserted into and remove from semi cylindrical recesses 712 when sufficient force is applied. However, the embodiments are not so limited. Rather, it is contemplated that in one or more arrangements, support assembly 26 may be connected to upper front crossbar 706 or other component of frame assembly 16 using various methods and/or means including but not limited to, for example, screws, bolts, clamps, pins, rivets, welding, snap connectors, friction fit connectors, stitching, hook and loop connectors, adhesives, chemical bonding, and/or any other process and/or means that results in a permanent or semi-permanent connection.

Counterbalance Housing 430:

In the arrangement shown, counterbalance assembly 304 of reclining mechanism 22 is positioned within a counterbalance housing 430 extending across bottom 32 of support assembly 26 proximate to back edge 36. Counterbalance housing 430 is formed of any suitable size, shape, and/or design and is configured to house counterbalance assembly 304 and facilitate connection between support assembly 26 and counterbalance assembly 304. In the arrangement shown, as one example, counterbalance housing 430 is an elongated enclosure formed by support assembly 26 and a lower cover 720.

Lower Cover 720:

In this example arrangement, lower cover 720 has a generally elongated rectangular shape configured to attach to bottom 32 of support assembly 26 proximate to back edge 36. In this example arrangement lower cover 720 includes generally rectangular bottom 722 extending between a front wall 724, a rear wall 726, and side walls 728, which extend upward from bottom 722.

Rotational Guide Supports 730/732:

In the arrangement shown, counterbalance housing 430 includes a first set of rotational guide supports 730 extending upward from bottom 722 of lower cover 720 and aligned with a second set of rotational guide supports 732 extending downward from bottom 32 of support assembly 26 within counterbalance housing 430. In this example arrangement, complementary cylindrical recesses 734 are formed in the first and second sets of rotational guide supports 730/732. Complementary cylindrical recesses 734 are configured to receive and hold rotational guides 690 of tensioner assembly 666 in position within counterbalance housing 430 while permitting rotational guides 690 and axle 652 to be rotated.

From the above discussion, it will be appreciated that the described system improves upon the state of the art. Specifically, one or more embodiments provide an improved folding chair: that has a compact reclining mechanism concealed within the chair that is configured to support an occupant in upright and reclined positions; that is strong, robust, and durable; that is comfortable; that is easy and intuitive to use; that is easy to manufacture; that is cost effective; that is high quality; that has a long useful life; and/or that is aesthetically pleasing among various other features and/or advantages.

It will be appreciated by those skilled in the art that other various modifications could be made to the device without parting from the spirit and scope of this disclosure. All such modifications and changes fall within the scope of the claims and are intended to be covered thereby.

What is claimed:

1. A seating system, comprising:
a frame assembly;
a seat assembly;
the seat assembly operably connected to the frame assembly;
a backrest assembly;
the backrest assembly operably connected to the frame assembly;
a counterbalance assembly;
wherein the backrest assembly is configured to move between an upright position and a reclined position;
wherein the counterbalance assembly is configured to apply a counterbalance force to the backrest assembly;
wherein the seating system is configured to move between a folded position and an unfolded position;
wherein the counterbalance assembly is positioned within the seat assembly.

2. The seating system of claim 1, wherein the backrest assembly is operably connected to the frame assembly by a reclining mechanism.

3. A seating system, comprising:
a frame assembly;
a seat assembly;
the seat assembly operably connected to the frame assembly;
a backrest assembly;
the backrest assembly operably connected to the frame assembly;
a counterbalance assembly;
wherein the backrest assembly is configured to move between an upright position and a reclined position;
wherein the counterbalance assembly is configured to apply a counterbalance force to the backrest assembly;

wherein the seating system is configured to move between a folded position and an unfolded position;

a housing connected to an underside of the seat assembly;

wherein the housing has a hollow interior;

wherein the counterbalance assembly is positioned within the hollow interior of the housing.

4. The seating system of claim 3, wherein the counterbalance assembly is configured to hold the backrest assembly at one or more intermediate positions between the upright position and the reclined position.

5. The seating system of claim 3, wherein the counterbalance assembly increases the counterbalance force applied to the backrest assembly at one or more intermediate positions between the upright position and the reclined position.

6. The seating system of claim 3, wherein the counterbalance assembly is configured to move the backrest assembly to the upright position in absence of an opposing force.

7. The seating system of claim 3, wherein the counterbalance assembly includes at least one spring.

8. The seating system of claim 3, wherein the backrest assembly is operably connected to the frame assembly by a reclining mechanism.

9. The seating system of claim 3, further comprising:

a reclining mechanism;

wherein the reclining mechanism is operably connected to the backrest assembly;

wherein the reclining mechanism is operably connected to the frame assembly;

wherein the reclining mechanism is configured to move the backrest assembly between the upright and the reclined position relative to the frame assembly.

10. A seating system, comprising:

a frame assembly;

a seat assembly;

the seat assembly operably connected to the frame assembly;

a backrest assembly;

the backrest assembly operably connected to the frame assembly;

a counterbalance assembly;

wherein the backrest assembly is configured to move between an upright position and a reclined position;

wherein the counterbalance assembly is configured to apply a counterbalance force to the backrest assembly;

wherein the seating system is configured to move between a folded position and an unfolded position;

wherein the counterbalance assembly includes at least one torsion spring.

11. A seating system, comprising:

a frame assembly;

a seat assembly;

the seat assembly operably connected to the frame assembly;

a backrest assembly;

the backrest assembly operably connected to the frame assembly;

a counterbalance assembly;

wherein the backrest assembly is configured to move between an upright position and a reclined position;

wherein the counterbalance assembly is configured to apply a counterbalance force to the backrest assembly;

wherein the seating system is configured to move between a folded position and an unfolded position;

wherein the counterbalance assembly includes a pair of torsion springs, with one torsion spring positioned adjacent each side of the backrest assembly.

12. A seating system, comprising:

a frame assembly;

a seat assembly;

the seat assembly operably connected to the frame assembly;

a backrest assembly;

the backrest assembly operably connected to the frame assembly;

a counterbalance assembly;

wherein the backrest assembly is configured to move between an upright position and a reclined position;

wherein the counterbalance assembly is configured to apply a counterbalance force to the backrest assembly;

wherein the seating system is configured to move between a folded position and an unfolded position;

a first adjustment member;

wherein the first adjustment member is operably connected to the counterbalance assembly;

wherein the first adjustment member is configured to increase and/or decrease the counterbalance force generated by the counterbalance assembly.

13. A seating system, comprising:

a frame assembly;

a seat assembly;

the seat assembly operably connected to the frame assembly;

a backrest assembly;

the backrest assembly operably connected to the frame assembly;

a reclining mechanism;

wherein the reclining mechanism is operably connected to the backrest assembly;

wherein the reclining mechanism is operably connected to the frame assembly;

a counterbalance assembly;

wherein the reclining mechanism is configured to move the backrest assembly between an upright position and a reclined position relative to the frame assembly;

wherein the counterbalance assembly is configured to apply a counterbalance force to the backrest assembly;

a housing connected to an underside of the seat assembly;

wherein the housing has a hollow interior;

wherein the counterbalance assembly is positioned within the hollow interior of the housing;

wherein the reclining mechanism includes:

an upper guide assembly;

wherein the upper guide assembly is configured to move an upper end of the backrest assembly when the backrest assembly is moved between the upright position and the reclined position;

a lower guide assembly;

wherein the lower guide assembly is configured to move a lower end of the backrest assembly when the backrest assembly is moved between the upright position and the reclined position.

14. A seating system, comprising:

a frame assembly;

a seat assembly;

the seat assembly operably connected to the frame assembly;

a backrest assembly;

the backrest assembly operably connected to the frame assembly;

a reclining mechanism;

wherein the reclining mechanism is operably connected to the backrest assembly;

wherein the reclining mechanism is operably connected to the frame assembly;

a counterbalance assembly;

wherein the reclining mechanism is configured to move the backrest assembly between an upright position and a reclined position relative to the frame assembly;

wherein the counterbalance assembly is configured to apply a counterbalance force to the backrest assembly;

a housing connected to an underside of the seat assembly;

wherein the housing has a hollow interior;

wherein the counterbalance assembly is positioned within the hollow interior of the housing;

wherein the reclining mechanism includes an upper guide assembly;

wherein the upper guide assembly is configured to move an upper end of the backrest assembly upward and forward when the backrest assembly is moved to the upright position;

wherein the upper guide assembly is configured to move the upper end of the backrest assembly downward and rearward when the backrest assembly is moved to the reclined position.

15. A seating system, comprising:

a frame assembly;

a seat assembly;

the seat assembly operably connected to the frame assembly;

a backrest assembly;

the backrest assembly operably connected to the frame assembly;

a reclining mechanism;

wherein the reclining mechanism is operably connected to the backrest assembly;

wherein the reclining mechanism is operably connected to the frame assembly;

a counterbalance assembly;

wherein the reclining mechanism is configured to move the backrest assembly between an upright position and a reclined position relative to the frame assembly;

wherein the counterbalance assembly is configured to apply a counterbalance force to the backrest assembly;

a housing connected to an underside of the seat assembly;

wherein the housing has a hollow interior;

wherein the counterbalance assembly is positioned within the hollow interior of the housing;

wherein the reclining mechanism includes a lower guide assembly;

wherein the lower guide assembly is configured to move a lower end of the backrest assembly upward and rearward when the backrest assembly is moved to the upright position;

wherein the lower guide assembly is configured to move the lower end of the backrest assembly downward and forward when the backrest assembly is moved to the reclined position.

16. A seating system, comprising:

a frame assembly;

a seat assembly;

the seat assembly operably connected to the frame assembly;

a backrest assembly;

the backrest assembly operably connected to the frame assembly;

a reclining mechanism;

wherein the reclining mechanism is operably connected to the backrest assembly;

wherein the reclining mechanism is operably connected to the frame assembly;

a counterbalance assembly;

wherein the reclining mechanism is configured to move the backrest assembly between an upright position and a reclined position relative to the frame assembly;

wherein the counterbalance assembly is configured to apply a counterbalance force to the backrest assembly;

a housing connected to an underside of the seat assembly;

wherein the housing has a hollow interior;

wherein the counterbalance assembly is positioned within the hollow interior of the housing;

wherein the reclining mechanism includes an upper guide assembly and a lower guide assembly;

wherein the upper guide assembly is configured to move an upper end of the backrest assembly upward and forward when the backrest assembly is moved to the upright position;

wherein the upper guide assembly is configured to move the upper end of the backrest assembly downward and rearward when the backrest assembly is moved to the reclined position;

wherein the lower guide assembly is configured to move a lower end of the backrest assembly upward and rearward when the backrest assembly is moved to the upright position;

wherein the lower guide assembly is configured to move the lower end of the backrest assembly downward and forward when the backrest assembly is moved to the reclined position.

17. A seating system, comprising:

a frame assembly;

a seat assembly;

the seat assembly operably connected to the frame assembly;

a backrest assembly;

the backrest assembly operably connected to the frame assembly;

a counterbalance assembly;

wherein the backrest assembly is configured to move between an upright position and a reclined position relative to the frame assembly;

wherein the counterbalance assembly is positioned within the seat assembly;

wherein the counterbalance assembly is configured to apply a counterbalance force to the backrest assembly;

wherein the seating system is configured to move between a folded position and an unfolded position;

wherein the counterbalance assembly includes at least one torsion spring.

18. The seating system of claim 17, wherein the counterbalance assembly includes a pair of torsion springs, with one torsion spring positioned adjacent each side of the backrest assembly.

19. The seating system of claim 17, wherein the counterbalance assembly is configured to hold the backrest assembly at one or more intermediate positions between the upright position and the reclined position.

20. The seating system of claim 17, wherein the counterbalance assembly is configured to hold the backrest assembly at one or more intermediate positions between the upright position and the reclined position;

wherein the one or more intermediate positions are approximately half way between the upright position and the reclined position.

21. The seating system of claim 17, wherein the counterbalance assembly is configured to move the backrest assembly to the upright position in absence of an opposing force.

22. The system of claim 17, further comprising a housing connected to an underside of the seat assembly;

wherein the housing has a hollow interior;

wherein the counterbalance assembly is positioned within the hollow interior of the housing.

23. A seating system, comprising:

a frame assembly;

a seat assembly;

the seat assembly operably connected to the frame assembly;

a backrest assembly;

the backrest assembly operably connected to the frame assembly;

a counterbalance assembly;

wherein the backrest assembly is configured to move between an upright position and a reclined position relative to the frame assembly;

wherein the counterbalance assembly is positioned within the seat assembly;

wherein the counterbalance assembly is configured to apply a counterbalance force to the backrest assembly;

wherein the backrest assembly is operably connected to the frame assembly by a reclining mechanism;

wherein the reclining mechanism includes an upper guide assembly;

wherein the upper guide assembly is configured to move an upper portion of the backrest assembly downward and rearward when the backrest assembly is moved to the reclined position;

wherein the reclining mechanism includes a lower guide assembly;

wherein the lower guide assembly is configured to move a lower portion of the backrest assembly downward and forward when the backrest assembly is moved to the reclined position.

24. A seating system, comprising:

a frame assembly;

a seat assembly;

the seat assembly operably connected to the frame assembly;

a backrest assembly;

the backrest assembly operably connected to the frame assembly;

a counterbalance assembly;

wherein the backrest assembly is configured to move between an upright position and a reclined position relative to the frame assembly;

wherein the counterbalance assembly is positioned within the seat assembly;

wherein the counterbalance assembly is configured to apply a counterbalance force to the backrest assembly;

wherein the backrest assembly is operably connected to the frame assembly by a reclining mechanism;

wherein the reclining mechanism includes an upper guide assembly;

wherein the upper guide assembly is configured to move an upper portion of the backrest assembly downward and rearward when the backrest assembly is moved to the reclined position;

wherein the reclining mechanism includes a lower guide assembly;

wherein the lower guide assembly is configured to move a lower portion of the backrest assembly forward when the backrest assembly is moved to the reclined position.

25. A seating system, comprising:

a frame assembly;

a seat assembly;

the seat assembly operably connected to the frame assembly;

a backrest assembly;

the backrest assembly operably connected to the frame assembly;

a counterbalance assembly;

wherein the backrest assembly is configured to move between an upright position and a reclined position relative to the frame assembly;

wherein the counterbalance assembly is positioned within the seat assembly;

wherein the counterbalance assembly is configured to apply a counterbalance force to the backrest assembly;

wherein the frame assembly includes a front leg section, a rear leg section, and a back section;

wherein the front leg section, rear leg section, and back section are connected to the seat assembly and backrest assembly by hinged connections;

wherein the hinged connections are configured to permit the front leg section, the rear leg section, and the back section to be folded into a folded position.

26. A seating system, comprising:

a frame assembly;

a seat assembly;

the seat assembly operably connected to the frame assembly;

a backrest assembly;

the backrest assembly operably connected to the frame assembly;

a counterbalance assembly;

wherein the backrest assembly is configured to move between an upright position and a reclined position relative to the frame assembly;

wherein the counterbalance assembly is positioned within the seat assembly;

wherein the counterbalance assembly is configured to apply a counterbalance force to the backrest assembly;

a lock assembly;

wherein the seating system is configured to move between a folded position and an unfolded position;

wherein the lock assembly is configured to hold the seating system in the unfolded position.

* * * * *